US005096804A

United States Patent [19]

Ikenoue et al.

[11] Patent Number: 5,096,804

[45] Date of Patent: Mar. 17, 1992

[54] SILVER HALIDE COLOR PHOTOGRAPHIC MATERIAL

[75] Inventors: Shinpei Ikenoue; Norihiko Sakata, both of Kanagawa, Japan

[73] Assignee: Fuji Photo Film Co., Ltd., Kanagawa, Japan

[21] Appl. No.: 648,326

[22] Filed: Jan. 29, 1991

Related U.S. Application Data

[63] Continuation of Ser. No. 255,010, Oct. 7, 1988, abandoned.

[30] Foreign Application Priority Data

Oct. 9, 1987 [JP] Japan ..... 62-253500
Oct. 9, 1987 [JP] Japan ..... 62-253501
Oct. 9, 1987 [JP] Japan ..... 62-253502

[51] Int. Cl.[5] ..... G03C 1/46

[52] U.S. Cl. ..... 430/503; 430/554; 430/555; 430/605

[58] Field of Search ..... 430/503, 554, 555, 605

[56] References Cited

U.S. PATENT DOCUMENTS 3,408,197 10/1968 McVeigh ..... 430/605
3,703,584 11/1972 Motter ..... 430/605
4,511,648 4/1985 Yamashita et al. ..... 430/503
4,594,313 6/1986 Furutachi et al. ..... 430/381
4,707,434 11/1987 Koboshi et al. ..... 430/393
4,745,048 5/1988 Kishimoto et al. ..... 430/376
4,748,105 5/1988 Kadota et al. ..... 430/393
4,818,671 4/1989 Ohbayashi et al. ..... 430/605

FOREIGN PATENT DOCUMENTS 122125 10/1984 European Pat. Off. .
167173 1/1986 European Pat. Off. .
63-194260 8/1988 Japan ..... 430/503
63-226651 9/1988 Japan ..... 430/503

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A silver halide color photographic material excellent in stability, which comprises at least one red-sensitive silver halide emulsion layer, at least one green-sensitive silver halide emulsion layer and at least one blue-sensitive silver halide emulsion layer on a support and having a specific photographic sensitivity of 320 or more, wherein the total silver content in said silver halide color photographic material is in the range of from 3.0 to 9.0 g/m$^2$ and the weight ratio of the amount of gold per unit area to the amount of silver incorporated per unit area is in the range of from $1\times10^{-8}$ to $6.0\times10^{-6}$.

13 Claims, No Drawings

SILVER HALIDE COLOR PHOTOGRAPHIC MATERIAL

This is a continuation of application Ser. No. 07/255,010, filed Oct. 7, 1988, abandoned.

FIELD OF THE INVENTION

The present invention relates to a color photographic light-sensitive material. More particularly, the present invention relates to a color photographic light-sensitive material which exhibits less increase in the generation of fog, a less deterioration in graininess and less decrease in the sensitivity due to aging between the preparation and the use thereof.

BACKGROUND OF THE INVENTION

In recent years, as the technique in photographing light-sensitive materials has progressed, high sensitivity light-sensitive materials have been put on the market in sequence. These high sensitivity light-sensitive materials also have made it possible to extend the application of photographing, e.g., to photographing in a dark room without using any strobe light, photographing of sports at a high shutter speed using a telephoto lens, and astronomical photography and other applications requiring a long time of exposure.

In order to provide a high sensitivity light-sensitive material, many efforts have been made. Many studies have been made to improve the shape, formation process, chemical sensitization and spectral sensitization of particulate silver halide, additives and structure of couplers. As a result, some useful inventions have been worked. However, the demand for high sensitivity light-sensitive materials has surpassed the progress of the technique in the art, and these inventions leave to be desired. It has therefore been the industry's usual practice to use particulate silver halide having a larger particle size in combination with other technique to provide a high sensitivity light-sensitive material. However, this practice has a great disadvantage that if a particulate silver halide having a larger size is used, the sensitivity can be raised to some degree but, so long as the silver halide content is kept constant, the number of particles in the silver halide emulsion is decreased and hence the number of development initiating points is decreased, greatly deteriorating the graininess of the light-sensitive material. In order to overcome such a disadvantage, many approaches have been known such as a method as described in British Patent No. 923,045 and JP-B-49-15,495 (the term "JP-B" as used herein means an "examined Japanese patent application") which comprises using a light-sensitive material comprising two or more emulsion layers having the same color-sensitivity and different sensitivities, i.e., different particle sizes of particulate silver halide, a method as described in JP-A55-62,454 (the term "JP-A" as used herein means an "unexamined Japanese patent application") which comprises using a high speed reaction coupler, a method as described in U.S. Pat. Nos. 3,227,554 and 3,632,435 which comprises using a so-called DIR coupler or DIR compound, a method as described in British Patent No. 2,083,640 which comprises using a coupler which produces a mobile dye, and a method as described in JP-A-60-128,443 which comprises using silver halide having a high average silver iodide content. These methods are excellent inventions having great effects. However, these methods leave to be desired with respect to the great demand for high sensitivity and high picture quality. In order to increase the number of development initiating points as much as possible while increasing the particle size of particulate silver halide to be incorporated in the emulsion, the high sensitivity color negative light-sensitive material has been designed to have a more content of particulate silver halide so far as the properties such as desilvering property upon blix permit.

The particulate silver halide to be used herein is normally subjected to chemical sensitization to provide the desired sensitivity and gradation.

The chemical sensitization of silver halide may be accomplished by any suitable known method, such as a sulfur sensitization process using a sulfur-containing compound capable of reacting with silver ion or active gelatin, reduction sensitization process using a reducing substance, noble metal sensitization process using gold or other noble metal compounds or combination thereof. Suitable sulfur sensitizing agents include thiosulfate, thiourea, thiazole and rhodanine. Specific examples of such compounds are described in U.S. Pat. Nos. 1,574,944, 2,410,689, 2,278,947, 2,728,668, 3,656,955, 4,030,928 and 4,067,740. Suitable reduction sensitizing agents include stannous salt, amine salt, hydrazine derivative, formamidinesulfinic acid and silane compound.

Specific examples of such a reduction sensitizing agent are describe in U.S. Pat. Nos. 2,487,850, 2,419,974, 2,518,698, 2,983,609, 2,983,610, 2,694,637, 3,930,867, and 4,054,458.

In order to effect noble metal sensitization, complex salts of the VIII group metal in the periodic complex. Specific examples of such noble metal complexes are described in U.S. Pat. Nos. 2,399,083 and 2,448,060, and British Patent 618,061.

In recent years, a silver halide emulsion having a higher sensitivity has been desired. It has been thought that a chemical sensitization process using a combination of a sulfur sensitizing agent and a noble metal sensitizing agent, particularly a gold-sulfur sensitizing process using a combination of a sulfur sensitizing agent and a gold sensitizing agent is indispensable to accomplish such an object.

In this case, the amount of such a sensitizing agent to be added can be determined by the state of the crystal particulate silver halide to be chemically sensitized (e.g., particle size or its distribution, halogen composition, crystal habit), environmental conditions (e.g., amount and type of binder used, pH, pAg, reaction temperature, reaction time), auxiliary agents for gold sensitization (e.g., accelerator such as thiocyanate or thioether compound, fog inhibitor such as thiosulfonate), and the type of sulfur sensitizing agent and gold sensitizing agent to be used.

A color photographic light-sensitive material normally comprises a silver halide emulsion which has been subjected to chemical sensitization in the manner as described above.

However, it has been found that a color photographic light-sensitive material thus prepared has some disadvantages.

Particularly, some deterioration cause such as an increase in the generation of fog, a reduction in the sensitivity or deterioration in the graininess between the preparation and the use of the light-sensitive material.

SUMMARY OF THE INVENTION

It is therefore an object of the present invention to provide a photographing color photographic light-sensitive material excellent in stability which exhibits less increase in the generation of fog, less decrease in the sensitivity and a less deterioration in the graininess due to aging after the preparation thereof.

The above and other objects of the present invention will become more apparent from the following detailed description and examples.

These objects of the present invention are accomplished with a silver halide color photographic material comprising at least one red-sensitive silver halide emulsion layer, at least one green-sensitive silver halide emulsion layers and at least one blue-sensitive silver halide emulsion layer on a support and having a specific photographic sensitivity of 320 or more, characterized in that the total silver content in the silver halide color photographic material is in the range of from 3.0 to 9.0 $g/m^2$ and the weight ratio of the amount of gold incorporated per unit area to the amount of silver incorporated per unit area is in the range of from $1\times10^{-8}$ to $6.0\times10^{-6}$.

DETAILED DESCRIPTION OF THE INVENTION

High sensitivity color negative films having a specific sensitivity of 400 or more which are now commercially available have a total silver content of about 10 $g/m^2$ and a total gold/total silver weight ratio of about $5\times10^{-6}$, a total silver content of about 8 $g/m^2$ and a total gold/total silver weight ratio of about $20\times10^{-6}$ or a total silver content of about 10 $g/m^2$ and a total gold/total silver weight ratio of about $13\times10^{-6}$.

Thus, commercially available films include those having a low total silver content and a high total gold/total silver ratio, those having a high total silver content and a low total gold/total silver ratio and those having a high total silver content and a high total gold/total silver ratio. Therefore, none of these films suggests the embodiments and effects of the present invention.

In a commercially available high sensitivity color negative film having a sensitivity of 320 or more, it is the industry's conventional practice to satisfy the desired high sensitivity and excellent graininess at the same time by increasing the silver content therein as described in JP-A-147744.

In general, commercially available high sensitivity color negative films are used by customers after they have passed half a near to one year from the preparation thereof. Studies of films which were returned to processing laboratories show that it is not seldom that films which have passed nearly two years are used by customers.

It was also found that films which were returned to processing laboratories exhibit some deterioration in the photographic properties such as increase in the generation of fog, deterioration in the graininess or decrease in the sensitivity.

The Inventors made various analysis. As a result, the Inventors found the following facts and thus worked out the present invention.

A high sensitivity color film was stored in a box made of lead blocks at room temperature in a tunnel under Mihoro Dam. As a result, the high sensitivity color negative film exhibited a drastically low deterioration in the photographic properties such as increase in the generation of fog, deterioration in the graininess and decrease in the sensitivity as compared to the high sensitivity color film which had been stored under ordinary conditions. The tunnel cuts cosmic rays, and the lead block cuts $\gamma$-rays. Thus, the above described storage condition features that the object is subject to the irradiation with an extremely small amount of natural radiation.

Accordingly, it was found that the deterioration of the properties of the high sensitivity color film is mainly caused by natural radiation.

Various experiments were made to investigate factors which relate to the deterioration in the properties due to natural radiation. As a result, a surprising fact was found that the lower the silver content is, or the lower the total gold/total silver weight ratio is, the less is the light-sensitive material to the effect of natural radiation.

A test made by the inventors shows that the graininess of a film having a high silver content is more excellent than that of a film having a low silver content shortly after the preparation thereof. However, the test shows that as time passes after the preparation the difference in the properties between the two films gradually becomes smaller and smaller due to the increase in the generation of fog, deterioration in the graininess and decrease in the sensitivity, and the latter film surpasses the former film eventually.

It was also found that a film having a lower total gold/total silver weight ratio exhibits a less increase in the generation of fog, less deterioration in the graininess and less decrease in the sensitivity than a film having a higher total gold/total silver weight ratio after the preparation thereof.

However, the decrease in the total silver content gives a side-effect that the resulting decrease in the number of pixels in the film causes a deterioration in the graininess.

Furthermore, the decrease in the total gold/total silver weight ratio gives a side-effect that the gradation becomes soft.

Then, the inventors combined a total silver content of 9.0 $g/m^2$ or less and a total gold/total silver weight ratio of $6.0\times10^{-6}$ or less. As a result, it was made possible to drastically minimize the deterioration in the properties of the high sensitivity color film due to natural radiation while minimizing the above described side-effects.

In general, a color negative light-sensitive material which comprises particulate silver halide in excess to coupler is subjected to a sensitive fluctuation in the properties due to the fluctuation in the fog of the emulsion particles. Thus, the present invention is extremely useful for color negative light-sensitive material.

The present invention overthrows the conventional concept and is novel and useful.

In the present invention, a specific photographic sensitivity as defined hereinafter is employed as the sensitivity of the photographic light-sensitive material for the reason as described below.

In general, ISO sensitivity, which is an international standard, is used as the sensitivity of a photographic light-sensitive material. In the standard of ISO sensitivity, it is prescribed that the light-sensitive material shall be developed 5 days after exposure in the manner specified by the manufacturer. In the present invention, the time between the exposure and the development was reduced to 0.5 to 6 hours, and the specific photographic sensitivity as described hereinafter is used so that a predetermined development process can be used to determine the sensitivity of the light-sensitive material.

The specific photographic sensitivity as used herein is determined by the following test method for ISO sensitivity in accordance with JIS K 7614-1981.

(1) Test conditions

The test is conducted in a room with a temperature of 20±5° C. and a relative humidity of 60±10%. The light-sensitive material specimens are stored under these conditions for 1 hour or longer before the test.

(2) Exposure i. The distribution of relative spectral energy of reference light on the exposed surface is as shown in Table A.

TABLE A

| Wavelength (nm) | Relative Spectral Energy (1) |
|---|---|
| 360 | 2 |
| 370 | 8 |
| 380 | 14 |
| 390 | 23 |
| 400 | 45 |
| 410 | 57 |
| 420 | 63 |
| 430 | 62 |
| 440 | 81 |
| 450 | 93 |
| 460 | 97 |
| 470 | 98 |
| 480 | 101 |
| 490 | 97 |
| 500 | 100 |
| 510 | 101 |
| 520 | 100 |
| 530 | 104 |
| 540 | 102 |
| 550 | 103 |
| 560 | 100 |
| 570 | 97 |
| 580 | 98 |
| 590 | 90 |
| 600 | 93 |
| 610 | 94 |
| 620 | 92 |
| 630 | 88 |
| 640 | 89 |
| 650 | 86 |
| 660 | 86 |
| 670 | 89 |
| 680 | 85 |
| 690 | 75 |
| 700 | 77 |

Note (1):
Value determined with the value at 560 nm as reference of 100 ii. The alteration of illuminance on the exposed surface is conducted by using an optical wedge. The optical wedge is to be used has a spectral transmission density fluctuation of 10% or less in a wavelength range of 360 to less than 400 nm and 5% or less in a wavelength range of 400 to 700 nm at any portion.

iii. The exposure time is 1/100 second.

(3) Development i. The light-sensitive material specimen is kept at a temperature of 20±5° C. and a relative humidity of 60±10% between the exposure and the development thereof.

ii. The development is completed in 30 minutes to 6 hours after the exposure.

iii. The development is effected under the following conditions:

| | |
|---|---|
| 1. Color development | 3 min. 15 sec., 38.0 ± 0.1° C. |
| 2. Bleach | 6 min. 30 sec., 38.0 ± 3.0° C. |
| 3. Rinse with water | 3 min. 15 sec., 24 to 41° C. |
| 4. Fixation | 6 min. 30 sec., 38.0 ± 3.0° C. |
| 5. Rinse with water | 3 min. 15 sec., 24 to 41° C. |
| 6. Stabilization | 3 min. 15 sec., 38.0 ± 3.0° C. |
| 7. Drying | 50° C. or lower |

The composition of the processing solutions to be used at the various steps will be shown hereinafter.

| | |
|---|---|
| **Color developing solution** | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-ethyl-N-β-hyroxyethylamino)-2-methylaniline sulfate | 4.5 g |
| Water to make | 1.0 l |
| pH | 10.0 |
| **Bleaching solution** | |
| Ferric ammonium ethylenediaminetetraacetate | 100 g |
| Disodium ethylenediaminetetraacetate | 10.0 g |
| Ammonium bromide | 150.0 g |
| Ammonium nitrate | 10.0 g |
| Water to make | 1.0 l |
| pH | 6.0 |
| **Fixing solution** | |
| Disodium ethylenediaminetetraacetate | 1.0 g |
| Sodium sulfite | 4.0 g |
| 70% aqueous solution of ammonium thiosulfate | 175.0 ml |
| Sodium bisulfite | 4.6 g |
| Water to make | 1.0 l |
| pH | 6.6 |
| **Stabilizing solution** | |
| Formalin (40%) | 2.0 ml |
| Polyoxyethylene-p-monononyl phenyl ether (average polymerization degree: 10) | 0.3 g |
| Water to make | 1.0 l |

(4) Density measurement

The density is represented in $\log_{10}(\Phi_0/\Phi)$ wherein $\Phi_0$ is illuminating light flux for density measurement and $\Phi$ is transmitting light flux at the measured portion. Referring to the geometric conditions for the density measurement, the illuminating light flux is a parallel light flux in the direction of the line normal to the specimen. As the transmitting light flux, all the light flux which has been diffused into a semi-space after being transmitted by the specimen is used. In the case where other measurement methods are used, correction is made by using a standard density piece. In the measurement, the emulsion film surface is opposed to the receptor. The density measurement is effected for blue, green and red status M densities. The spectral characteristics of blue, green and red status M densities are adjusted as the general characteristics of the light source, optical system, optical filter and receptor used in the densitometer are as shown in Table B.

TABLE B

| Spectral characteristics of status M density (represented in logarithm, with its peak as reference of 5.00) | | | |
|---|---|---|---|
| Wavelength nm | Blue | Green | Red |
| 400 | • | | |
| 410 | 2.10 | | |
| 420 | 4.11 | | |

TABLE B-continued

| Spectral characteristics of status M density (represented in logarithm, with its peak as reference of 5.00) | | | |
|---|---|---|---|
| Wavelength nm | Blue | Green | Red |
| 430 | 4.63 | * | |
| 440 | 4.37 | | |
| 450 | 5.00 | | * |
| 460 | 4.95 | | |
| 470 | 4.74 | 1.13 | |
| 480 | 4.34 | 2.19 | |
| 490 | 3.74 | 3.14 | |
| 500 | 2.99 | 3.79 | |
| 510 | 1.35 | 4.25 | |
| 520 | ** | 4.61 | |
| 530 | | 4.85 | |
| 540 | | 4.98 | |
| 550 | | 4.98 | |
| 560 | | 4.80 | |
| 570 | ** | 4.44 | * |
| 580 | | 3.90 | |
| 590 | | 3.15 | |
| 600 | | 2.22 | |
| 610 | | 1.05 | |
| 620 | | | 2.11 |
| 630 | | | 4.48 |
| 640 | | | 5.00 |
| 650 | | ** | 4.90 |
| 660 | | | 4.58 |
| 670 | | | 4.25 |
| 680 | | | 3.88 |
| 690 | | | 3.49 |
| 700 | | | 3.10 |
| 710 | | | 2.69 |
| 720 | | | 2.27 |
| 730 | ** | ** | 1.86 |
| 740 | | | 1.45 |
| 750 | | | 1.05 |
| | | | ** |

Note *: Slope of red: 0.260/nm; slope of green: 0.160/nm; slope of blue: 0.250/nm
Note **: Slope of red: 0.040/nm; slope of green: 0.120/nm; slope of blue: 0.220/nm (5) Determination of specific photographic sensitivity By using the results of density obtained under the processing conditions shown in the paragraphs (1) to (4), the specific photographic sensitivity is determined in the manner as described hereinafter.

i. The exposure corresponding to the value of 0.15 higher than the minimum blue, green and red densities are represented in lux·second to give $H_B$, $H_G$ and $H_R$, respectively.

ii. Whichever higher $H_B$ or $H_R$ (whichever has a lower sensitivity) is referred to as $H_S$.

iii. The specific photographic sensitivity S is calculated in accordance with the following equation:

$$S = \sqrt{\frac{2}{H_G \times H_S}}$$

The light-sensitive material of the present invention has a specific photographic sensitivity of 320 or more as determined by the above described method. If the light-sensitive material has a specific photographic material of less than 320, it is practically impossible to conduct photographing in a dark room without using a strobe light, photographing of sports at a high shutter speed using a telephoto lens, or astronomical photographing, and the probability of focuslessness or lack of exposure upon the ordinary photographing is increased.

The light-sensitive material of the present invention preferably has a specific photographic sensitivity of 350 or more, preferably not more than 6,400 and more preferably not more than 3,200.

As described above, the less the silver content in the light-sensitive material is, the less is the light-sensitive material subject to the effect of natural radiation. However, if the silver content is less than 3.0 g/m$^2$, the graininess immediately after the preparation is poor. This makes it impossible to secure the desired maximum density for the color light-sensitive material. Therefore, the light-sensitive material of the present invention has a silver content of 3.0 to 9.0 g/m$^2$, preferably 4.5 to 9.0 g/m$^2$, more preferably 5.0 to 8.0 g/m$^2$, particularly 5.5 to 7.0 g/m$^2$. Preferably the total silver content is at least 4.5 g/m$^2$. Preferably the total silver content is not more than 8.0 g/m$^2$.

The term "silver content" as used herein means the content of all silver compounds such as silver halide or metallic silver as calculated in terms of silver. The determination of the silver content in the light-sensitive material can be accomplished by any suitable known method such as atomic-absorption spectroscopy and fluorescent X-ray process.

As described above, in order to lighten the sideeffect of the reduction in the silver content, the reduction in the weight ratio of total gold/total silver is combined with the above described range of silver content.

However, it is preferred that the approach for providing a silver halide emulsion having a higher sensitivity or other approaches for improving the picture quality be combined with the present invention.

The light-sensitive material of the present invention comprises at least one red-sensitive silver halide emulsion layer, at least one green-sensitive silver halide emulsion layers and blue-sensitive silver halide emulsion layers. It is preferable that an optional color-sensitive emulsion layer is formed of two or more emulsion layers having different sensitivities. If a color-sensitive layer is formed of three emulsion layers, an approach for improving the graininess may be preferably used. These approaches are described in British Patent No. 923,045, and JP-B-49-15,495.

In the color photographic light-sensitive material, when a color-sensitive emulsion layer is formed of two or more emulsion layers having different sensitivities, the silver content in an emulsion layer having a higher sensitivity is increased to utilize the effect of eliminating the graininess. This design is a common sense to obtain a color negative photographic light-sensitive material having a high picture quality. However, it was found that a high sensitive color photographic light-sensitive material having a specific photographic sensitivity of 320 or more has an unexpected disadvantage that if the silver content in an emulsion layer having a higher sensitivity is increased, it gives a greater aging deterioration after the storage as compared to the case where the silver content in an emulsion layer having a low sensitivity is increased. Therefore, it is preferred that the silver content in the emulsion layer having the highest sensitivity in the emulsion layers constituting a color-sensitive layer be not too high. The silver content in the respective emulsion layer having the highest sensitivity in the red-sensitive layer, the green-sensitive layer and the blue-sensitive layer is preferably in the range of 0.3 to 2.5 g/m$^2$, more preferably 0.4 to 2.0 g/m$^2$, particularly 0.5 to 1.7 g/m$^2$.

Specific examples of approaches for providing a high sensitivity which can be combined with the present invention will be described hereinafter, but the present invention should not be construed as being limited thereto.

(1) Yellow filter dyes, (2) Sensitizing dyes, particularly supersensitizing dyes as described hereinafter, (3) Core/shell type double-structured particulate silver halide in which the silver iodide density in the core is greater than that in the shell, (4) Multi-structured particulate silver halide in which the density of silver iodide in each layer is precisely controlled, (5) Tabular particulate silver halide having an aspect ratio of 5 or more, (6) Monodisperse particulate silver halide, (7) Two-equivalent couplers, (8) High speed reaction couplers, (9) Inverted layer structure, unit layer structure,

(10) Technique to make all emulsion layers have an average silver iodide content of 8 mol%.

In order to satisfy the desired high sensitivity and high picture quality at the same time, various inventions have been worked out on the order of layer arrangement. These approaches may be preferably combined with the present invention (See the above described approach (9)). These inventions on the order of layer arrangement are described in, for example, U.S. Pat. Nos. 4,184,876, 4,129,446, 4,186,016, 4,186,011, 4,267,264, 4,173,479, 4,157,917, and 4,165,236, British Patents 1,560,965, 2,138,962, and 2,137,372, and JP-A-59-177,552, 59-180,556, and 59-204,038.

Alternatively, a light-insensitive layer may be present interposed between two or more emulsion layers having the same sensitivity.

A reflective layer comprising finely divided particulate silver halide may be provided under a higher sensitive layer, particularly under a high sensitive blue-sensitive layer, to improve the sensitivity. This approach is described in, for example, JP-A-59-160,135.

In general, the red-sensitive emulsion layer comprises a cyan-forming coupler, the green-sensitive emulsion layer comprises a magenta-forming coupler and the blue-sensitive emulsion layer comprises a yellow-forming coupler. However, different combinations may be optionally used. For example, an infrared-sensitive layer may be combined with the above described layer structure to provide a light-sensitive material for use in false color photography or exposure to semiconductor laser.

Alternatively, as described in U.S. Pat. No. 3,497,350 or JP-A-59-214,853, the color sensitivity may be properly combined with a dye-forming coupler, and the layer thus obtained may be provided farthest from the support.

The photographic emulsion layer in the silver halide photographic material of the present invention may comprise any silver halide such as silver bromide, silver bromoiodide, silver bromochloroiodide, silver bromochloride or silver chloride. A preferred silver halide composition is silver bromoiodide containing 30 mol% or less of silver iodide. A particularly preferred silver halide composition is silver bromoiodide containing 2 to 20 mol% of silver iodide. In order to attain a high sensitivity and a high picture quality at the same time, the average silver iodide content in silver halide to be incorporated in all the emulsion layers is preferably 8 mol% or more as described in JP-A-60-128443. It has been known that the increase in the average silver iodide content in silver halide provides a remarkable improvement in graininess. However, when the silver iodide content exceeds a certain value, some disadvantages appear, such as delay in development, desilvering or fixation. Nevertheless, in the present invention, since the light-sensitive material has a small silver content, such disadvantages cannot easily appear even if the silver iodide content is increased.

The particulate silver halide to be incorporated in the photographic emulsion layer in the silver halide photographic material of the present invention may preferably have a double structure having a core substantially comprising silver bromoiodide containing 5 mol% or more of silver iodide and a shell covering the core and substantially comprising silver bromide or silver bromoiodide having a lower silver iodide content than the core. The silver iodide content in the core is more preferably in the range of 10 mol% or more, particularly 20 to 44 mol%. The silver iodide content in the shell is preferably of 5 mol% or less.

The core may uniformly contain silver iodide or may have a multiple structure comprising phases having different silver iodide contents. In the latter case, the phase having the highest silver iodide content preferably have a silver iodide content of 5 mol% or more, more preferably 10 mol% or more, and the silver iodide content in the shell is preferably lower than that in the phase having the highest silver iodide content in the core. The term "material substantially comprising silver bromoiodide" means a material which mainly comprising silver bromoiodide but may comprise other components (e.g., AgCl in the amount of not more than 1 mol%.

A further preferred embodiment of the particulate, silver halide to be incorporated in the photographic emulsion layer in the silver halide photographic material of the present invention is a particulate silver halide which exhibits two maximum diffractions, one corresponding to the core portion and the other to the shell portion, and one minimum diffraction interposed there between, the diffraction intensity corresponding to the core portion being 1/10 to 3/1 of that corresponding to the shell portion, on a curve of diffraction intensity vs. diffraction angle of (220) plane of silver halide obtained with $k\beta$-rays from Cu in a diffraction angel ($2\theta$) range of 38° to 42°. Particularly, the diffraction intensity ratio is preferably in the range of 1/5 to 3/1, and more preferably $\frac{1}{3}$ to 3/1.

By using a particulate silver halide having such a double structure, it is made possible to use a silver bromoiodide emulsion having a high iodine content without causing any delay in development. Thus, a light-sensitive material which can exhibit an excellent graininess even with a small coated amount of silver can be accomplished.

Another preferred embodiment of the particulate silver halide to be incorporated in the photographic emulsion layer in the silver halide photographic material of the present invention is a particulate silver halide having inside a silver bromoiodide phase forming a core portion thereof and containing 10 to 40 mol% of silver iodide, said silver bromoiodide phase being covered by a silver halide phase forming a shell portion thereof and having a lower silver iodide content, and furthermore the surface thereof having a silver iodide content of 5 mol% or more. The silver iodide composition of the shell portion may be uniform or ununiform. The term "surface having a silver iodide content of 5 mol% or more" means a surface having an average silver iodide content of 5 mol% or more as determined by X-ray photoelectron spectroscopy process. The average silver iodide content of the surface of the particulate silver halide is preferably in the range of 7 to 15 mol%. Such a particulate silver halide is described in detail in Japanese Patent Application No. 61-253370. Such a particulate silver halide exhibits an excellent graininess and may be preferably used in the present invention.

A further preferred embodiment of the particulate silver halide to be incorporated in the photographic emulsion layer in the silver halide photographic material of the present invention is a particulate silver halide having an internal core substantially comprising silver bromide and/or silver iodide and a plurality of outer shells substantially comprising silver bromide and/or silver bromoiodide, wherein the outermost core has a silver iodide content of 10 mol% or less, a high silver iodide content core having a silver iodide content of 6 mol% or more higher than the outermost core is provided inside the outermost core, and an intermediate core having a middle silver iodide content between that of the two cores is provided between the two cores, the silver iodide content in the intermediate core being 3 mol% or more higher than that in the outermost core. Such a particulate silver halide is described in detail in JP-A-61-245151. Such a particulate silver halide, too, exhibits an excellent graininess and may be preferably used in the present invention.

A further preferred embodiment of the particulate silver halide to be incorporated in the photographic emulsion layer in the silver halide photographic material of the present invention is a particulate silver halide having a monodispersibility as defined hereinafter. Particularly, when the value obtained by dividing the standard deviation S of particle diameters by the mean particle diameter $\bar{r}$ and multiplying the quotient by 100 (hereinafter referred to as "fluctuation coefficient") is 16 or less, a monodispersibility is accomplished, as defined by the following equation:

$$\frac{S}{\bar{r}} \times 100 \leqq 16\%$$

wherein S represents a general standard deviation as used in statistics. The term "particle diameter" as used herein means the diameter in the case of spherical particulate silver halide or the diameter as calculated in terms of circle having the same area as a projected area in the case of particulate silver halide having other particulate shapes. The term "mean particle diameter" as used herein means the average value of particle diameters. The mean particle diameter $\bar{r}$ can be defined by the following equation:

$$\bar{r} = \frac{\Sigma n_i r_i}{\Sigma n_i}$$

wherein the number of particles having a particle diameter $r_i$ is $n_i$.

Such a monodisperse particulate silver halide may have a double structure or multiple structure as described above.

Such a monodisperse particulate silver halide may have any structure such as that of a cube, octahedron, tetradecahedron, sphere, or tablet (plate).

Such a monodisperse particulate silver halide exhibits an excellent graininess. A monodisperse particulate silver halide having a size range giving a less light scattering can provide images having excellent sharpness. Such a monodisperse particulate silver halide is described in detail in U.S. Pat. Nos. 4,444,877, and 4,446,228, and JP-A-54-48521, 54-99419, 56-16124, 56-78831, 57-182730, 58-49938, 58-37635, 58-106532, 58-107530, 58-126531, 58-149037, 59-10947, 59-29243, 59-72440, 59-140443, 59-148049, 59-177535, and 59-152438.

A further preferred embodiment of the particulate silver halide to be incorporated in the present light-sensitive material is a tabular particulate silver halide having an aspect ratio of 5 or more. Such a particulate silver halide gives a less light scattering and hence a high image sharpness, and thus is preferably used in the present invention. Such tabular particulate silver halide is described in detail in U.S. Pat. Nos. 4,434,226, 4,414,310, 4,433,048, and 4,439,520, and British Patent 2,112,157.

In order to improve the sharpness of images the most effectively, it is preferred that the blue-sensitive layer comprise tabular particulate silver halide while the green-sensitive layer and the red-sensitive layer comprise monodisperse particulate silver halide. This approach is described in detail in Japanese Patent Application No. 61-235763.

The silver halide emulsion layer to be used in the present invention may preferably comprise chemically-sensitized particulate silver halide containing metallic impurities other than gold and iridium in the total amount of 3 ppm or less. The use of such a silver halide emulsion makes it possible to obtain a high sensitivity silver halide photographic material.

The preparation of such a silver halide emulsion having a remakably small content of metallic impurities other than gold and iridium can be accomplished not only by purifying essential materials for the silver halide emulsion, i.e., water, hydrophilic colloid such as gelatin, soluble silver salt such as silver nitrate, and soluble halogenated alkali such as KBr, KCl, KI, NaBr and NaCl to remove metallic impurities therefrom but also by preventing metallic impurities from entering into the system from the reactor upon the preparation thereof or properly combining technique for adjusting reaction temperature or reaction conditions.

The preparation of the photographic emulsion to be used in the present invention can be accomplish by any suitable method as described in P. Glafkides, *Chimie et Physique Photographique*, Paul Montel, 1967; G. F. Duffin, *Photographic Emulsion Chemistry*, The Focal Press, 1966; and V. L. Zelikman et al, *Making and Coating Photographic Emulsion*, The Focal Press, 1964. Particularly, the preparation of the present silver halide photographic emulsion can be accomplished by any process such as acidic process, neutral process or ammonia process. The process for the reaction of the soluble silver salt with the soluble halide salt can be accomplished by single jet process, double jet process, or combination thereof.

The process for the reaction of the soluble silver salt with the soluble halide salt can be accomplished by a process in which particles are formed in excess silver ions (so-called reverse mixing process).

One form of the double jet process is a so-called controlled double jet process in which the pAg of the liquid in which silver halide is formed is kept constant. This process can provide a silver halide emulsion having a regular crystal structure and a nearly uniform particle size.

Two or more silver halide emulsions which have been separately prepared may be used in admixture.

Suitable particulate silver halide include a particulate silver halide having on the external surface a crystal plane defined by the mirror index (nnl) (in which n is a natural number satisfying the relationship $n \geqq 2$) as described in Kokai Giho (Japanese Published Technical Report) 86-9,598.

Alternatively, a particulate silver halide having a hollow conduction portion extending from the surface to the interior thereof as described in JP-A-61-75337 may be preferably used. Such a particulate silver halide having a large specific surface area can easily be made sensitive as compared to a conventional particulate silver halide having the same volume particularly when color-sensitized. Such a particulate silver halide may be more effectively used in combination with the present invention.

A composite particulate silver halide obtained by the epitaxial growth on a host particle of silver salt having a different composition as described in JP-A-57-133540, 58-108526, and 59-162540 may be preferably used in the present invention. Such a particulate silver halide exhibits a high sensitivity and a high contrast and there may be preferably used to embody the present invention.

A silver halide emulsion which has been grown in the presence of tetrazaindene as described in JP-A-61-14630 ad 60-122935 has a high silver iodide content and an excellent monodispersibility, exhibiting a high sensitivity and an excellent graininess. Such a silver halide emulsion may be preferably used as a suitable silver halide emulsion for the present invention.

Alternatively, a silver halide emulsion which has been subjected to gold-sulfur sensitization or gold-selenium sensitization in the presence of a nitrogen-containing heterocyclic compound as described .in JP-A-58-126526 exhibits less fog and higher sensitivity, and can be therefore used as a suitable silver halide emulsion for the present invention.

Furthermore, a slightly roundish cubic or tetradecahedral silver halide crystal as described in JP-A-59-149345 and 59-149344 can provide a high sensitivity and therefore be used as a suitable particulate silver halide for the present invention.

In the process of formation or physical ripening of particulate silver halide, cadmium salt, zinc salt, lead salt, thallium salt, iridium salt, or complex salt thereof, rhodium salt or complex salt thereof, or iron salt or complex salt thereof may be present.

In particular, an emulsion of particulate silver halide which has been formed in the presence of iridium provides a high sensitivity as described in JP-B-43-4935 and 45-32738. Such a silver halide emulsion may be preferably used in the present invention.

After being sedimented or physically ripened, the photographic emulsion may be normally subjected to removal of soluble salts. To this end, a known noodle rinsing process in which gelatin is gelled may be used. Alternatively, a sedimentation (or flocculation) process using an inorganic salt comprising polyvalent anions (e.g., sodium sulfate), an anionic surface active agent, an anionic polymer (e.g., polystyrenesulfonic acid) or a gelatin derivative (e.g., aliphatic acylated gelatin, aromatic acylated gelatin, aromatic carbamoylated gelatin) may be used.

The silver halide emulsion to be incorporated in the present color light-sensitive material may be preferably subjected to chemical sensitization with an ordinary sulfur sensitizing agent and a gold sensitizing agent in combination.

If the gold/silver ratio is decreased merely by decreasing the amount of gold to be incorporated, it causes some troubles such as low contrast. Therefore, the gold/silver ratio may be preferably decreased by an effective gold sensitization with a small amount of a gold compound. More preferably, gold and/or gold compounds which are not present inside and on the particulate silver halide (hereinafter referred to as "free gold and/or gold compounds") may be removed after the chemical sensitization and before the coating of the light-sensitive material on a support. Specifically, the free gold and/or gold compounds may be removed by rinsing with water after a chemical sensitization with a gold compound. A general procedure of such a rinse is described in *Research Disclosure* RD No. 17,643, Dec. 1978, IIA. Examples of suitable methods for the removal or reduction of the amount of free gold (compounds) will be described hereinafter.

(a) A method which comprises processing an emulsion which has been gold-sensitized with a porous adsorbent or ion exchange resin by the time when it is coated on a support to remove a gold sensitizing agent remaining in the binder phase by an adsorption effect.

The term "porous adsorbent" as used herein means a porous solid adsorbent (adsorption medium) having a large surface area. Specific examples of such a porous solid adsorbent include activated carbon, active alumina, active clay, silica-based adsorbent (preferably water-resistant), and inorganic porous adsorbents such as zeolite-based adsorbent, porous glass and porous ceramic.

Among these adsorbents, activated carbon is most preferably used.

Specific examples of the ion exchange resin include cation exchange resins (e.g., Amberlite IR-120 (Rohm & Haas Inc.)), anion exchange resins (e.g., Diaion SA-21A (Mitsubishi Chemical Industries Ltd.), Dowex 1×8 (Dow Chemical)), and amphoteric ion exchange resins and chelat resins (e.g., Diaion CR-20 (Mitsubishi Chemical Industries Ltd.)).

These ion exchange resins are commercially available in many varieties depending on their application.

Among these ion exchange resins, anion exchange resins, amphoteric ion exchange resins and chelate resins may be preferably used in the present invention. Anion exchange resins are most preferably used.

Specific examples of usage of these adsorbents and ion exchange resins are described in detail in JP-A-61-219948 and 219949.

(b) A method which comprises rinsing an emulsion which has been gold-sensitized with water by the time when it is coated on a support.

The rinsing process may be accomplished by a known flocculation process or noodle process. The rinsing solution to be used in this process may be only water or an aqueous solution of halogenated alkali, thiocyanate or sulfite.

(c) A method which comprises subjecting an emulsion which has been gold-sensitized to centrifugal separation or other mechanical separation process to remove the binder phase containing a gold sensitizing agent left therein by a necessary amount, and then adding a further necessary amount of a binder.

(d) A method which comprises using a smaller amount of gelatin as a diluent in order to decrease the amount of gelatin present in the silver halide emulsion upon the gold sensitization.

(e) A method which comprises the combined use of a gold compound with a palladium compound, such as palladium chloride.

Methods (a) to (e) may be used singly or in combination.

These methods make it possible to decrease the proportion of a gold sensitizing agent in the gelatin phase of the silver halide emulsion. By attaining a weight ratio of total gold to total silver of from $1\times10^{-8}$ to $6.0\times10^{-6}$, the objects of the present invention can be accomplished. The less the amount of gold is, the greater is the effect of the present invention. The ratio is preferably in the range of from $2\times10^{-8}$ to $4\times10^{-6}$, particularly from $1\times10^{-7}$ to $2\times10^{-6}$.

As a suitable gold sensitizing agent for the present invention there may preferably be used a gold complex as described in U.S. Pat. No. 2,399,083.

Particularly preferred among these compounds are chloroauric acid, potassium chloroaurate, potassium aurithiocyanate, auric trichloride, sodium aurithiosulfate, and auric-5-sulfobenzothiazole-2-sulfide chloride.

In the present invention, sulfur sensitization process is preferably used in combination with the above described gold sensitization process.

Examples of suitable sulfur sensitizing agents which can be used in the present invention include thiosulfates, thioureas, thiazoles, rhodanines and other compounds as described in U.S. Pat. Nos. 1,574,944, 2,410,689, 2,278,947, 2,728,668, 3,656,955, 4,030,928 and 4,067,740. Particularly preferred among these compounds are thiosulfates, thioureas and rhodanines.

In general, the red-sensitive silver halide emulsion layer, green-sensitive silver halide emulsion layer and blue-sensitive silver halide emulsion layer which constitute a color photographic light-sensitive material each consists of two or more light-sensitive layers having different sensitivities to provide a wide exposure latitude, and improved graininess (as described in British Patent 923,045 and JP-B-49-15495 (The term "JP-B" as used herein means an "examined Japanese patent publication")). These light-sensitive layers may comprise particulate silver halide having various sizes. Most preferably, a gold compound may be used in a substantial proportion to the total surface area of the particulate silver halide (surface area of one particle x number of particles). However, the objects of the present invention can be accomplished only by decreasing the amount of a gold compound to be used in the gold sensitization of the particulate silver halide in the layer having the highest sensitivity in the red-sensitive layer, the green-sensitive layer and the blue-sensitive layer. In this case, the movement or rearrangement of gold may occur during the preparation or storage of the light-sensitive material.

When the weight ratio of total gold to total silver is $6\times10^{-6}$ or less, the effect of using a reduction sensitization process becomes higher.

Suitable reduction sensitizing agents include stannous salts, amine salts, hydrazine derivatives, formamidinesulfinic acid and silane compounds. Specific examples of these compounds are described in U.S. Pat. No. 2,487,850, 2,419,974, 2,518,698, 2,983,609, 2,983,610, 2,694,637, 3,930,867, and 4,054,458.

The reduction sensitization may also be accomplished by any suitable method as described in JP-A-4887825, JP-B-58-1410, and U.S. Pat. No. 4,175,970. Alternatively, the light-sensitive material may be sensitized with hydrogen gas as described in T. A. Babcock et al., Photographic Science & Engineering, 19, pp.211"214, 49-55, 1975.

The determination of gold may be preferably effected by a simple and accurate analysis such as atomicabsorption spectroscopy. In the Examples of the present invention, Hitachi, Ltd.'s polarization Zeeman atomicabsorption spectrometer Type 180-80 was used. A 5-mmϕ specimen punched out from a coat of light-sensitive material on a support was subjected to high temperature carbon furnace atomic-absorption spectroscopy.

Preferably, 70% or more, particularly preferably 80% or more, of the total amount of gold is present in the silver halide particle phase (including surface) rather than a hydrophilic colloid layer such as gelatin layer.

The proportion of gold in the silver halide particle phase can be determined by the following analysis:

(i) A coat on a support is swollen with water. A silver halide emulsion is then peeled off the support by an enzymatic decomposition or acid decomposition. The silver halide emulsion is then subjected to centrifugal separation so that a silver halide particle solid phase and a binder phase are separated from each other. These phases are then subjected to the above described analysis to determine the amount of a gold sensitizing agent (including gold or gold compounds).

(ii) When a coat on a support is fully washed with a dilute (e.g., 0.01%) aqueous solution of sodium thiosulfate in such a manner that the silver halide incorporated therein is not fixed, almost all the amount of the gold sensitizing agent in the binder phase is washed out. By determining the total amount of the gold sensitizing agent incorporated in the coat before and after being rinsed with sodium thiosulfate, the amount of the gold sensitizing agent incorporated in the silver halide particle solid phase and the binder phase can be found.

The method (ii) is described in detail in P. A. Fälens, "Photographische Korrespondenz", Vol. 104, pp. 137-146, 1968.

In the present invention, the method (ii) may be preferably used.

The term "total amount of gold" to be incorporated in a unit area of the light-sensitive material means the total amounts of gold sensitizing agents (gold and gold compounds) incorporated in a unit area of all layers including silver halide emulsion layers in the light-sensitive material prepared (amount of gold determined by atomic-absorption spectroscopy).

If the silver halide particle phase has a small proportion of gold, i.e., the binder phase has a large proportion of gold, gold diffuses or moves to the silver halide particle phase between the chemical sensitization and the coating of the light-sensitive material on a support or with time after the coating. Thus it is considered that it makes the light-sensitive material more easily susceptible to undesirable changes in photographic properties such as sensitivity, gradation or fog due to aging.

When the specific sensitivity of the lightsensitive material exceeds 320, the fog due to natural fog begins to cause some troubles. Such troubles can be drastically eliminated when the weight ratio of total gold to total silver is from $1\times10^{-8}$ to $6\times10^{-6}$, and the total amount of silver is from 3 to 9.0 g/m$^2$.

In a commercially available high sensitivity color negative film having a sensitivity of 320 or more, it is the industry's conventional way to satisfy the desired high sensitivity and excellent graininess at the same time by increasing the silver content therein, as described in JP-A-58-147744.

The photographic emulsion to be used in the present invention may be optionally subjected to spectral sensitization with a methine dye or the like. Examples of such a dye include cyanine dye, merocyanine dye, composite cyanine dye, composite merocyanine dye, holopolar cyanine dye, hemicyanine dye, styryl dye and hemioxonol dye. Particularly preferred among these dyes are cyanine dye, merocyanine dye and composite merocyanine dye. Any of nuclei which are commonly used as basic heterocyclic nucleus for cyanine dye can be applied to these dyes. Examples of suitable nucleus which can be applied to these dyes include pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus and nucleus obtained by fusion of alicyclic hydrocarbon rings to these nucleus or nucleus obtained by fusion of aromatic hydrocarbon rings to these groups, e.g., indolenine nucleus, benzindolenine nucleus, indole nucleus, bezoxazole nucleus, naphthooxazole nucleus, benzothiazole nucleus, naphthothiazole nucleus, benzoselenazole nucleus, benzimidazole nucleus and quinoline nucleus. These nucleus may be applied to carbon atoms in the dyes.

Examples of suitable nucleus which can be applied to merocyanine dye or composite merocyanine dye include those having a ketomethylene structure such as pyrazoline5-one nucleus, thiohydantoin nucleus, 2-thiooxazolidine2,4-dione nucleus, thiazolidine-2,4-dione nucleus, rhodanine nucleus, thiobarbituric acid nucleus and other 5- or 6-membered heterocyclic nucleus.

Examples of useful sensitizing dyes include those described in German Patent 929,080, U.S. Pat. Nos. 2,231,658, 2,493,748, 2,503,776, 2,519,001, 2,912,329, 3,656,959, 3,672,897, 3,694,217, 4,025,349, and 4,046,572, British Patent 1,242,588, and JP-B-44-14030, and 52-24844.

These sensitizing dyes may be used singly or in combination. Such a combination of sensitizing dyes may be often used for the purpose of supersensitization. Typical examples of such a combination of sensitizing dyes are described in U.S. Pat. Nos. 2,688,545, 2,977,299, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281, and 1,507,803, JP-B-43-4936, and 53-12375, and JP-A-52-110618, and 52-109925.

The present photographic emulsion may comprise a dye which itself does not have a spectral sensitizing effect or a substance which does not substantially absorb visible light but exhibits a supersensitizing effect together with the above described sensitizing dye. Examples of such a dye or substance which may be incorporated in the emulsion include aminostyryl compounds substituted by nitrogen-containing heterocyclic groups as described in, for example, U.S. Pat. Nos. 2,933,390 and 3,635,721, aromatic organic acid-formaldehyde condensates as described in U.S. Pat. Nos. 3,743,510, cadmium salts and azaindene compounds. Combinations as described in U.S. Pat. Nos. 3,615,613, 3,615,641, 3,617,295 and 3,635,721 are particularly useful.

The silver halide emulsion to be incorporated in a color photographic light-sensitive material having a specific photographic sensitivity of 320 or more as determined in the manner defined herein may be subjected to spectral sensitization in the manner as described above to increase the sensitivity to visible light in a necessary wavelength range. In order to minimize the deterioration in the properties due to natural radiation, the sensitivity of the silver halide emulsion to natural radiation may be preferably as low as possible. A study made by the inventors shows that the sensitivity of a silver halide emulsion to radiation has a good correlation with the so-called inherent sensitivity and does not necessarily correlate with the so-called color sensitization sensitivity. Therefore, in order to minimize the deterioration in the properties due to natural radiation while maintaining the high light sensitivity, an emulsion having a high color sensitization sensitivity but a low inherent sensitivity may be preferably used. To this end, the above described supersensitizers which increase only the color sensitization sensitivity without changing the inherent sensitivity are particularly preferred. Alternatively, a sensitizing dye may be incorporated as much as possible so far as the color sensitization sensitivity is not lowered too much. Thus, a so-called inherent desensitization can be effected to lower the inherent sensitivity. Furthermore, tabular particulate silver halide having a high efficiency of color sensitization with a sensitizing dye and an aspect ratio of 5 or more may be preferably used.

The preparation of tabular particulate silver halide can be easily accomplished by any suitabel method as described in Gutoff, *Photographic Science and Engineering*, Vol. 14, pp. 248-257, 1970, U.S. Pat. Nos. 4,434,226, 4,414,310, 4,433,048, and 4,439,520, and British Patent 2,112,157.

The photographic emulsion layer to be used in the present invention may comprise color couplers as dye-forming substances.

Examples of magenta couplers which may be used for this purpose include 5-pyrazolone coupler, pyrazolobenzimidazole coupler, cyanoacetyl coumarone coupler and open-chain acylacetonitrile coupler. Examples of yellow couplers which may be used for this purpose include acylacetamide coupler (e.g., benzoylacetanilides and pivaloylacetanilides). Examples of cyan couplers which may be used for this purpose include naphthol coupler and phenol coupler. These couplers are preferably nondiffusive compounds containing ballast groups in its molecule or polymerized compounds.

From the stoichiometrical standpoint of view, couplers are generally divided into two groups: two-equivalent coupler which develops a color in a proportion of 1 mol per 2 mol of silver halide and four-equivalent coupler which develops a color in a proportion of 1 mol per 4 mol of silver halide. Two-equivalent couplers are preferred to four-equivalent couplers because of its higher efficiency of use of silver. However, two-equivalent couplers are disadvantageous in that they have a high fog increasing rate, especially by heat.

When a silver halide color photographic material is brought into contact with formaldenhyde gas before being color developed, a coupler incorporated therein reacts with formaldehyde to consume itself and gives undesirable products which cause deterioration in photographic properties such as decrease in color density, color stain, and increase in the generation of fog. The use of a two-equivalent coupler, especially, a two equivalent magenta coupler has a great effect of minimizing the deterioration in photographic properties due to formaldehyde.

It was found that the effect of the present invention becomes more remarkable when a silver halide emulsion having a weight ratio of total gold to total silver of from $1\times10^{-8}$ to $6\times10^{-6}$ and a two-equivalent coupler are used in combination.

In the present invention it is preferable that when the silver halide color photographic material contains a two-equivalent magenta coupler the total silver content in the photographic material is 6.5 g/m$^2$ or less.

In the present invention, a two-equivalent coupler is preferably incorporated in at least a green-sensitive silver halide emulsion layer. If the two-equivalent coupler is incorporated in red-sensitive and blue-sensitive silver halide emulsion layers as well, remarkable effects of improving sensitivity, providing higher contrast, saving silver and shortening the processing time can be attained.

When color-sensitive layers are each formed of two or more layers having different sensitivities, such a two-equivalent coupler may be preferably incorporated in the respective layer having the highest sensitivity in the red-sensitive layer, the green-sensitive layer and the blue-sensitive layer. In general, the layer having the highest sensitivity has the highest silver content and hence the highest ratio of silver to coupler and can most easily exhibit fog. Therefore, a color light-sensitive material comprising a two-equivalent coupler in layers having the highest sensitivity exhibits a further remarkable effect of the present invention.

A so-called high speed reaction coupler having a high coupling reactivity exhibits a high efficiency of use of an oxidation product of a developing agent and therefore may be preferably used in the present invention. The effect of the present invention becomes more remarkable when a color negative light-sensitive material comprising such a high speed reaction coupler, preferably in layers having the highest sensitivity is used, as in the case of a color negative light-sensitive material comprising a two-equivalent coupler.

The coupling reactivity of a coupler can be determined as a relative value by a process which comprises color development of an emulsion comprising a mixture of two couplers M and N which provide mutually distinctively separable dyes and measurement of the amount of the respective dyes in the resulting color images.

Assuming that the maximum density and the halfway color density of coupler M and coupler N are $(DM)_{max}$ and DM and $(DN)_{max}$ and DN, respectively, the ratio of reactivity of the two couplers RM/RN is given by the following equation:

$$\frac{RM}{RN} = \frac{\log\left(1 - \frac{DM}{(DM)_{max}}\right)}{\log\left(1 - \frac{DN}{(DN)_{max}}\right)}$$

That is, the coupling reactivity RM/RN can be determined from the slope of the straight line obtained by plotting on a rectangular two axis system of log $$\left(1 - \frac{D}{D_{max}}\right)$$

of several sets Of DM's and DN's obtained by color development of an emulsion comprising a mixture of couplers M and N which has been exposed to light by stages.

By using the coupler N as a reference, the relative coupling reactivity RM/RN of vatious couplers can be determined in the manner as described above.

As such a reference coupler N, there can be used any of the following couplers:

With respect to cyan couplers,

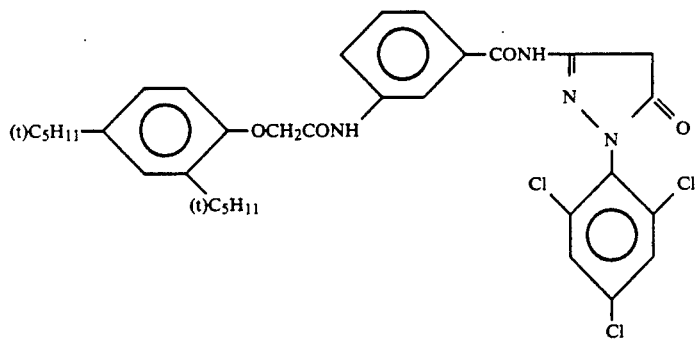

With respect to magenta couplers and yellow couplers,

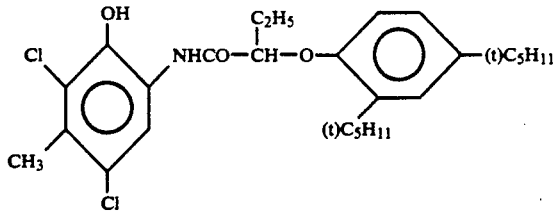

As suitable high speed reaction couplers for the present invention there may be preferably used those having an RM/RN value (as determined with the above described coupler N as a reference) of 1.5 or more for cyan couplers, 2.5 or more for magenta couplers and more than 1 for yellow couplers.

Specific examples of suitable high speed reaction couplers which can be used in the present invention will be shown hereinafter, but the present invention should not be construed as being limited thereto. The figure in the parenthesis indicate RM/RN values as determined with the above described coupler N as a reference.

Examples of cyan couplers
(CYAN-1)
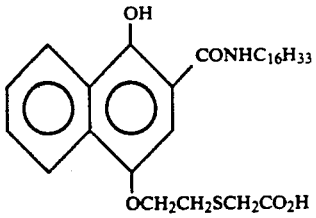
(2.9)
(CYAN-2)
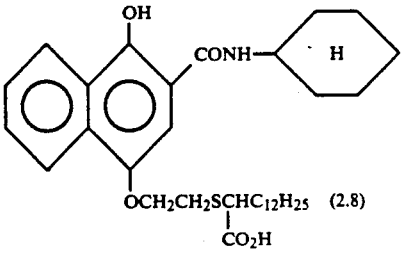
(2.8)
(CYAN-3)
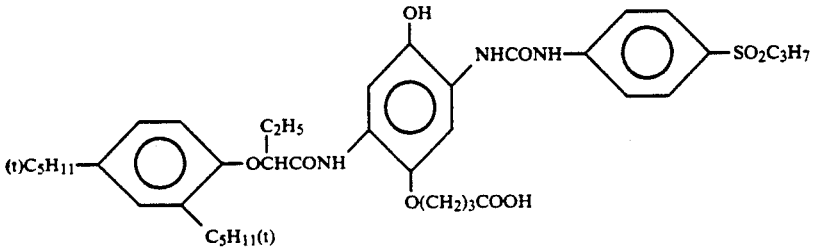
(3.2)
(CYAN-4)
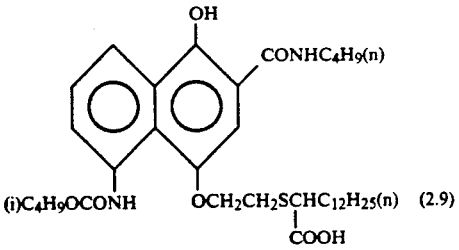
(2.9)
(CYAN-5)
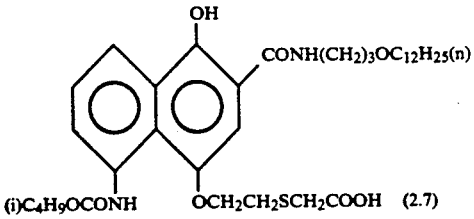
(2.7)
(CYAN-6)
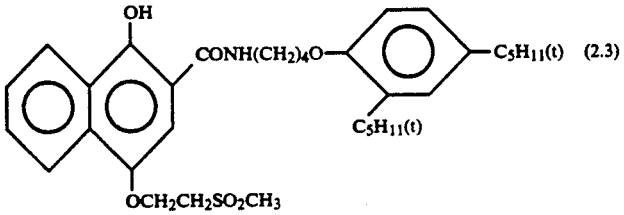
(2.3)
Examples of magenta couplers -continued
(MAGENTA-1)
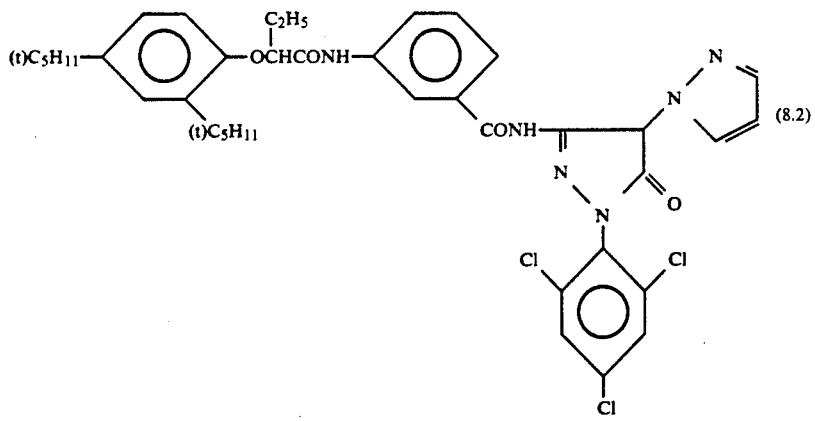
(8.2)
(MAGENTA-2)
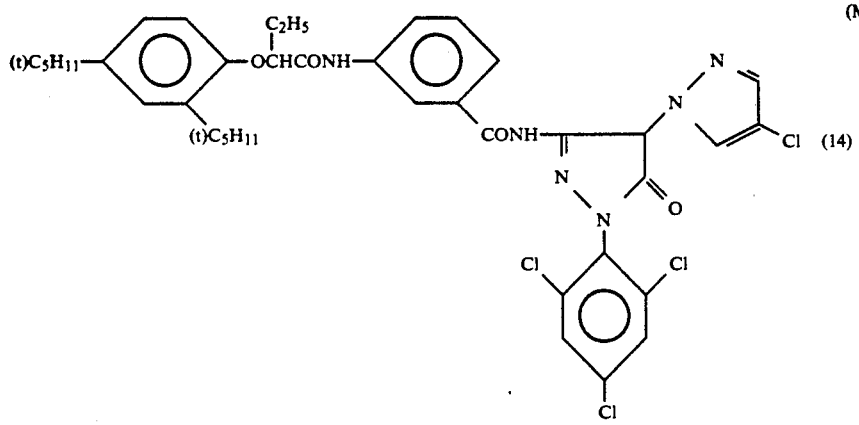
(14)
(MAGENTA-3)
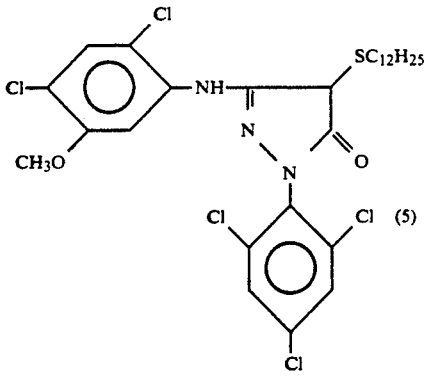
(5)
(MAGENTA-4)
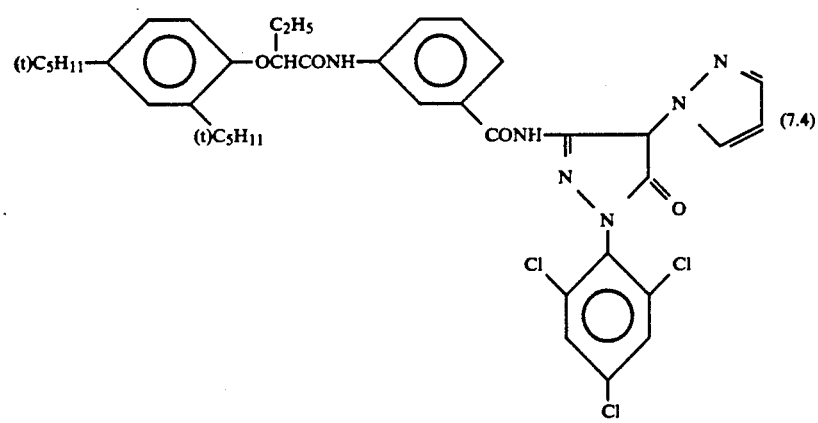
(7.4)

-continued
(MAGENTA-5)
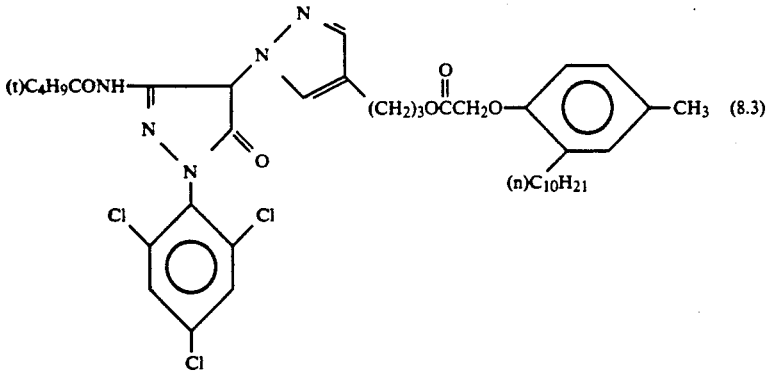
(8.3)
(MAGENTA-6)
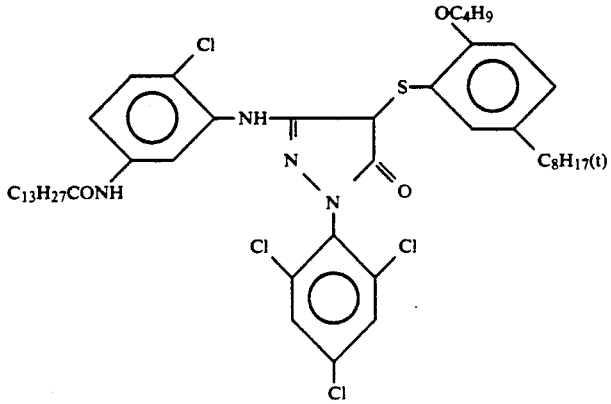
(7.5)
(MAGENTA-7)
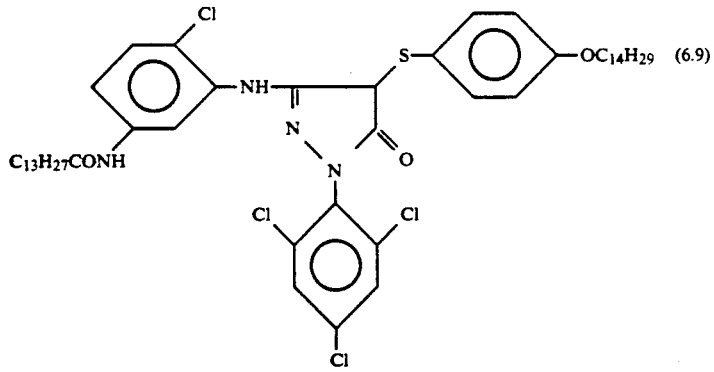
(6.9)
(MAGENTA-8)
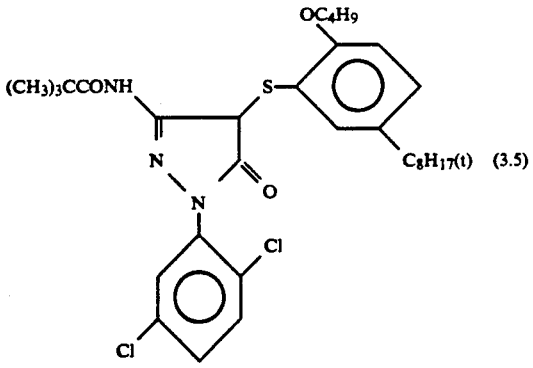
(3.5)

-continued
(MAGENTA-9)
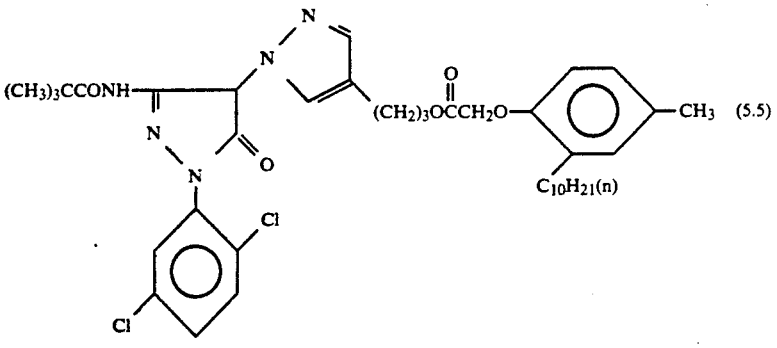
(5.5)
(MAGENTA-10)
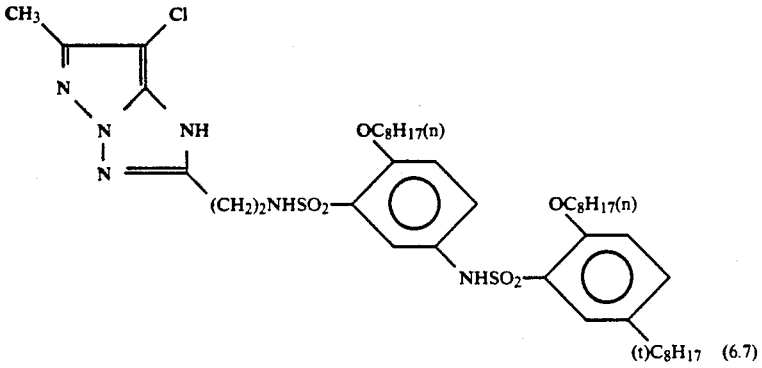
(6.7)
(MAGENTA-11)
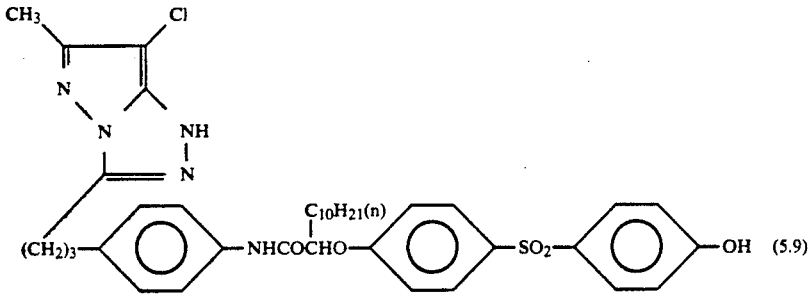
(5.9)
Examples of yellow couplers
(YELLOW-1)
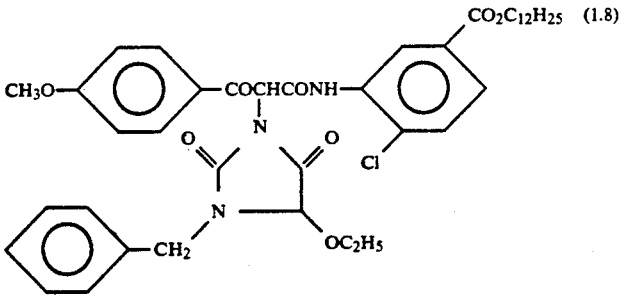
(1.8)
(YELLOW-2)
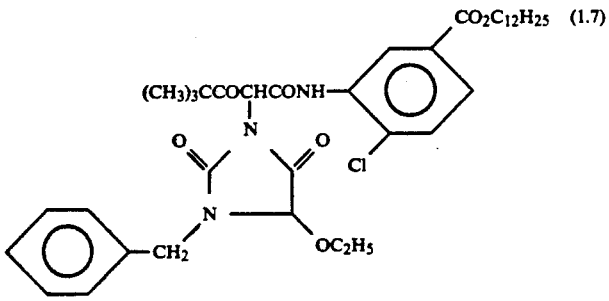
(1.7)

-continued (YELLOW-3)

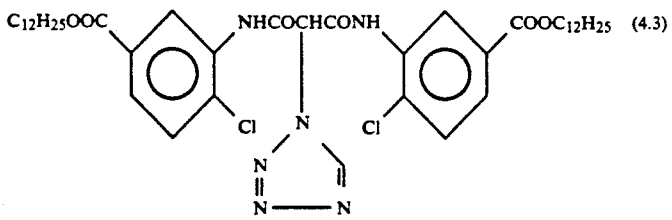

(YELLOW-4)

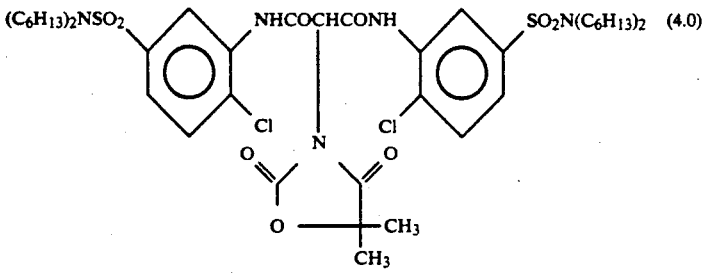

(YELLOW-5)

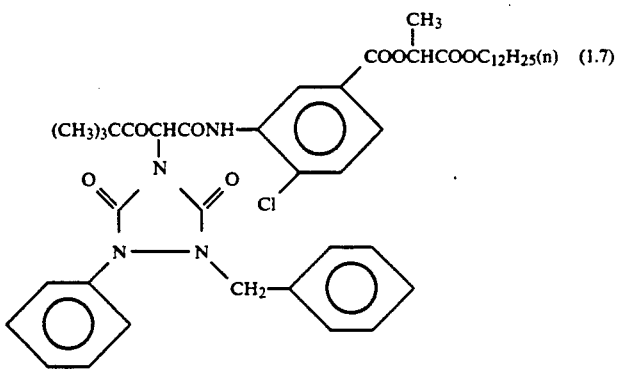

In the present invention, such as high speed reaction coupler may be preferably incorporated in at least a unit emulsion layer having the highest sensitivity among various color-sensitive layers. The amount of such a high speed reaction coupler to be used is not specifically limited. In general, the amount of such a high speed reaction coupler to be used is preferably in the range of 0.005 to 0.1 mol per 1 mol of silver for high speed reaction cyan coupler, 0.005 to 0.1 mol of silver for high speed reaction magenta coupler and 0.005 to 0.1 mol per 1 mol of silver for high speed reaction yellow coupler.

In the present invention, it is possible to improve the covering power and hence the sensitivity or graininess by using a nondiffusive coupler which forms a dye having a proper diffusivity as claimed in U.S. Pat. No. 4,420,556 (claims 1, 3 through 8) and JP-A-59-191036. The synthesis of these nondiffusive couplers maybe easily accomplished by any suitable method as described in U.S. Pat. Nos. 4,420,556 and 4,264,723, and JP-A-59-191036, 56-1,938, 57-3934, and 53-105226.

Specific examples of these nondiffusive couplers will be shown hereinafter.

(Y-1)

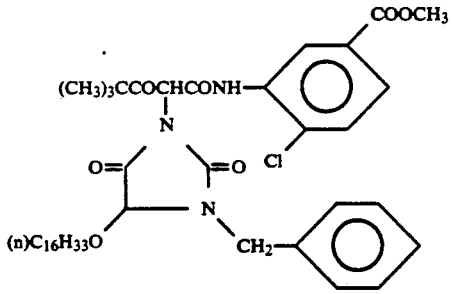

-continued
(Y-2)
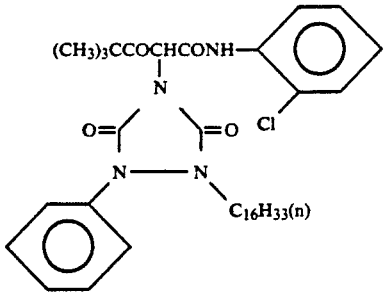
(Y-3)
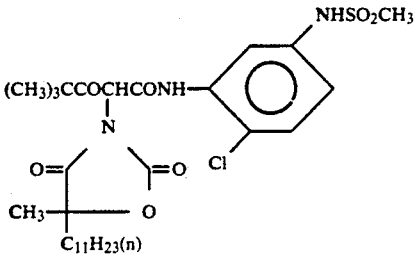
(Y-4)
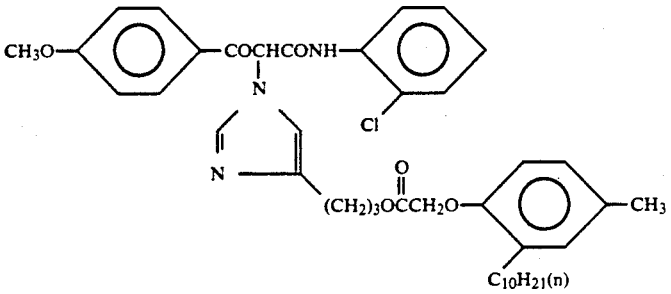
(Y-5)
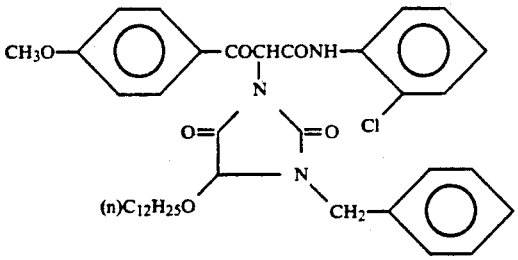
(Y-6)
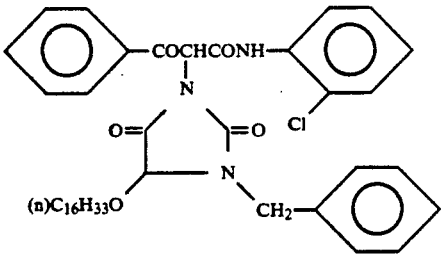
(Y-7)
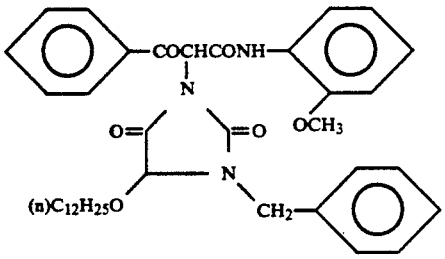

-continued
(M-1)
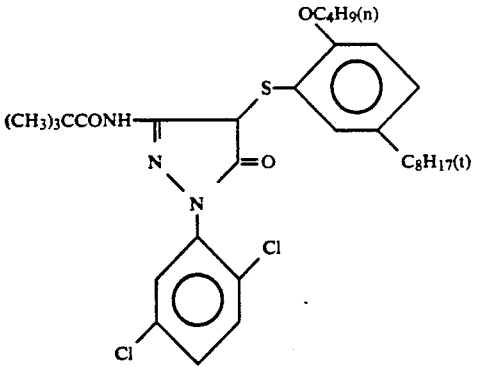
(M-2)
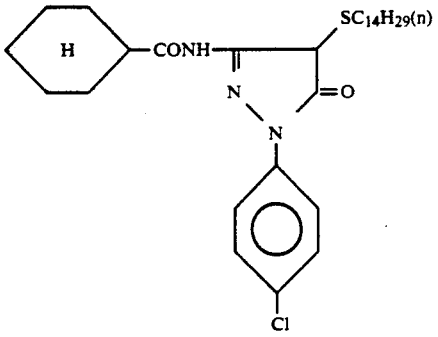
(M-3)
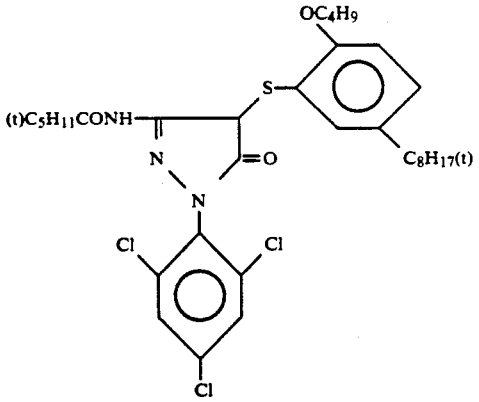
(M-4)
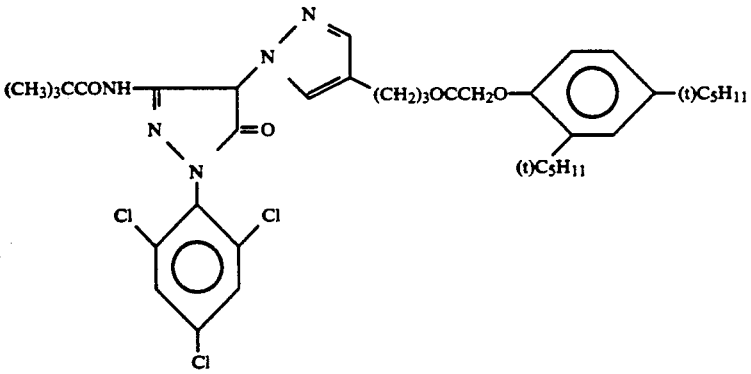

-continued (C-1)

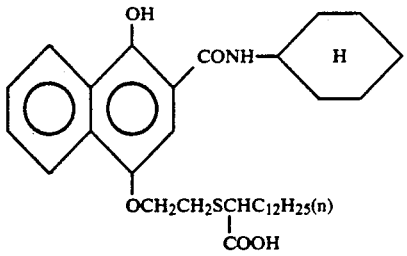

(C-2)

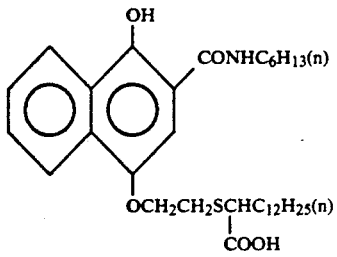

(C-3)

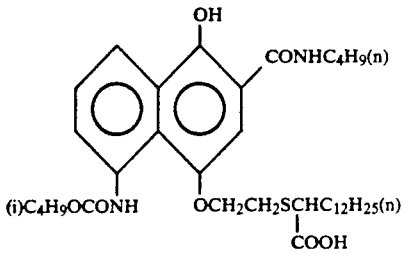

(C-4)

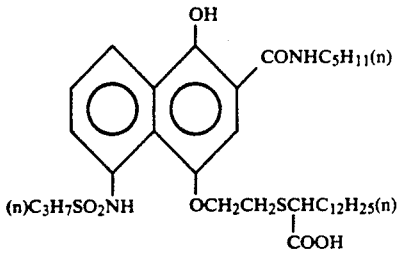

(C-5)

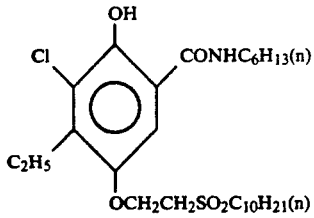

Typical examples of nucleus of two-equivalent yellow couplers are described in U.S. Pat. Nos. 2,875,057, 2,407,210, 3,265,506, 2,298,443, 3,048,194, and 3,447,028. Preferred among these yellow couplers are acylacetamide derivatives such as benzoylacetanilide and pivaloylacetanilide.

Therefore, as yellow coupler residual groups (Cp) there may be preferably used those represented by the general formulas (I) and (II):

(I)

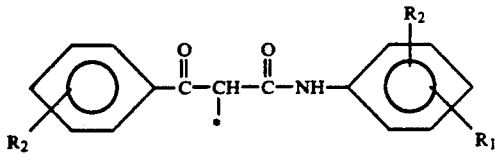

-continued (II)

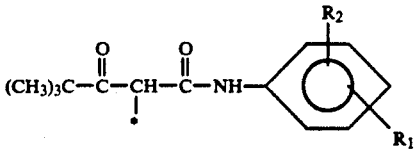

wherein * represents the position at which the coupling-off group (described later) is bonded to the two-equivalent yellow coupler; $R_1$ represents a $C_{8-32}$ nondiffusive group if the coupling-off group is free of a nondiffusive group, or a hydrogen atom, one or more halogen atoms, lower alkyl group, lower alkoxy group or $C_{8-32}$ nondiffusive group if the coupling-off group contains a nondiffusive group (coupler as described in British Patent 2,083,640); and $R_2$ represents a hydrogen atom, one or more halogen atoms, lower alkyl group, lower alkoxy group or $C_{8-32}$ nondiffusive group, with the proviso that if there are two or more $R_2$ groups, these $R_2$ groups may be the same or different.

Examples of coupling-off groups of two-equivalent yellow couplers are described in JP-B-49-12660, 49-12661, 49-13576, 51-10,783, 51-25733, and 54,38497, JP-A-47-26133, 48-44834, 48-73147, 49-10736, 49-1229, 50-6341, 50-34232, 50-117423, 51-102636, 50-158329, 51-17438, 51-3631, 51-26039, 51-50734, 51-53825, 51-89730, 52-28318, 52-58922, 52-90932, 53-135625, 54-48541, 54-121126, 54-99433, and 54-13329, Research Disclosure No. 180,531, and U.S. Pat. No. 3,894,875, and 3,933,501. Preferred among these groups are (active point of coupler)-O-acyl-substituted, -hydrantoin-substituted, -urazole-substituted, -monoxoimido-substituted, -pyridanone compound-substituted and -sulfonyl-substituted groups.

Typical examples of nucleus of two-equivalent magenta couplers are described in U.S. Pat. Nos. 2,600,788, 2,369,489, 2,343,703, 2,311,082, 3,152,896, 3,519,429, 3,062,653, 2,908,573, and 3,733,335, and British Patent 1,334,515. Preferred among these magenta couplers are pyrazolones or pyrazoloazoles (e.g., pyrazolopyrazole, pyrazoloimidazole, pyrazolotriazole, pyrazolotetrazole). The effect of the present invention becomes remarkable particularly when a pyrazoloazole type magenta coupler is used.

Therefore, as magenta coupler residual groups (Cp) there may be preferably used those represented by the general formulas (III), (IV) and (V). The effect of the present invention becomes remarkable particularly when a coupler represented by the general formula [V] is used.

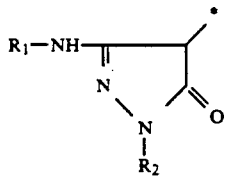
(III)

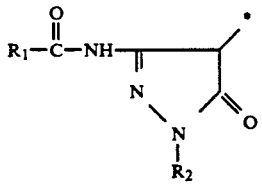
(IV)

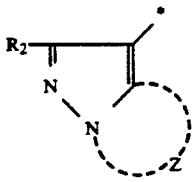
(V)

wherein $R_1$ represents a $C_{8-32}$ nondiffusive group when the coupling-off group is free of a nondiffusive group, or a hydrogen atom, one or more halogen atoms, lower alkyl group, lower alkoxy group or $C_{8-32}$ nondiffusive group if the coupling-off group contains a nondiffusive group (coupler as described in British Patent No. 2,083,640); $R_2$ represents a hydrogen atom, one or more halogen atom, lower alkyl group, lower alkoxy group or $C_{8-32}$ nondiffusive group with the proviso that if there are two or more $R_2$ groups, these $R_2$ groups may be the same or different; and * represents the position at which the coupling-off group (described later) is bonded to the two-equivalent magenta coupler.

Examples of coupling-off group of two-equivalent magenta couplers are described in JP-B-49-37854, 50-37540, 51-10100, and 52-34937, and JP-A-49-29638, 49-129538, 50-13041, 50-122935, 50-159336, 51-3232, 51-3233, 51-17437, 51-16929, 51-20826, 51-36938, 51-108842, 51-112341, 51-112343, 52-58922, 53-123129, 54-33032, 54-49539, 54-80744, 54-85724, 55-62454, 55-83044, 55-118034, 56-38043, 56-38044, 56-40825, 56-126833, 57-4044, 57-35858, 57-96334, 57-96335, and 57-96337. Preferred among these groups are nitrogen-containing heterocyclic group-substituted groups such as azole (e.g., pyrazole, imidazole, triazole)alkylthio compound-substituted and -arylthio compound-substituted groups), aryloxy compound-substituted groups, acyloxy compound-substituted groups, and groups substituted by compounds complexed with an arylaldehyde or alkylaldehyde group.

Examples of nucleus of two-equivalent cyan couplers are described in U.S. Pat. Nos. 2,772,162, 2,895,826, 3,022,836, 3,034,892, 2,474,293, 2,423,730, 2,367,531, and 3,041,236. Preferred among these compounds are phenols or naphthols.

Therefore, as cyan coupler residual groups (Cp) there may be used those represented by the general formulas (VI), (VII), (VIII) and (IX).

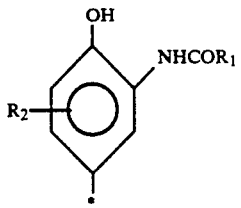
(VI)

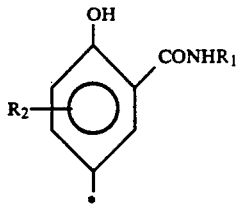
(VII)

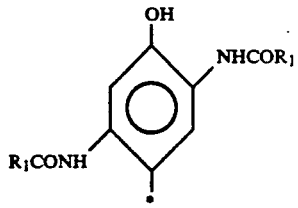
(VIII)

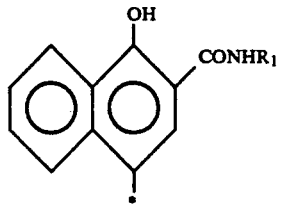
(IX)

wherein * represents the position at which the coupling-off group is bonded to the two-equivalent cyan coupler; $R_1$ represents a $C_{8-32}$ nondiffusive group if the coupling-off group is free of a nondiffusive group, or a hydrogen atom, one or more halogen atoms, lower alkyl group, lower alkoxy group or $C_{8-32}$ nondiffusive group if the coupling-off group contains a nondiffusive group (coupler as described in British Patent 2,083,640}; and $R_2$ represents a hydrogen atom, one or more halogen atoms, lower alkyl group, lower alkoxy group or $C_{8-32}$ nondiffusive group, with the proviso that if there are two or more $R_2$ groups, these $R_2$ groups, may be the same or different.

Examples of coupling-off group of two-equivalent cyan couplers are described in JP-B-49-17735, and 57-4896, JP-A-47-21139, 47-37425, 50-10135, 50-25228, 50-91323, 50-117422, 50-120334, 50-130441, 51-17437, 51-21828, 51-25828, 51-108841, 51-110328, 51-146828, 52-18315, 52-20023, 52-555529, 52-90932, 53-39126, 53-39745, 53-45524, 53-47827, 53-52423, 53-105226, 54-14736, 54-48237, 54-66129, 55-32071, 55-65957, 56-1938, 56-6234, 56-12643, 56-27147, 55-65957, 56-80044, 56-126832, and 57-200039, and U.S. Pat. Nos. 3,749,735, 3,737,315, 3,839,044, and 4,228,233. Preferred among these groups are arylalkoxysubstituted groups, alkylalkoxy-substituted groups, carbonylmethoxy-substituted groups, halogen atom (F, Cl, Br or I)-substituted groups, sulfonyloxy compound-substituted groups and sulfonamide compound-substituted groups.

Cyan couplers which can be preferably used in the present invention can be represented by the general formula (X). These cyan couplers are described in detail in JP-A-60-237448, 61-153640, and 61-145557.

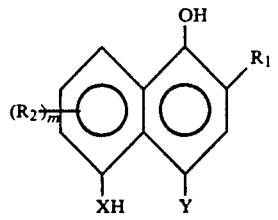

(X)

wherein $R_1$ represents $—CONR_3R_4$, $—NHCOR_3$, $—NHCOOR_5$, $—NHSO_2R_5$, $—NHCONR_3R_4$ or $—NHSO_2NR_3R_4$ in which $R_3$ and $R_4$ each represents a hydrogen atom, aliphatic group, aromatic group or heterocyclic group and $R_5$ represents an aliphatic group, aromatic group or heterocyclic group; $R_2$ represents a group substitutable by naphthol; m represents an integer 0 to 3; X represents an oxygen atom, sulfur atom, HN<, $R_6N$< or $R_6OCON$< in which $R_6$ has the same meaning as $R_5$; and Y represents a hydrogen atom or a group which undergoes a coupling reaction with an oxidation product of an aromatic primary amine developing agent to be separated therefrom. The term "aliphatic group" as used herein means a straight-chain, branched or cyclic alkyl, alkenyl or alkynyl group which may be substituted. The term "aromatic group" as used herein means a substituted or unsubstituted monocyclic or condensed heterocyclic group.

Specific examples of two-equivalent couplers which can be used in the present invention will be shown hereinafter, but the present invention should not be construed as being limited thereto.

2-Equivalent yellow coupler

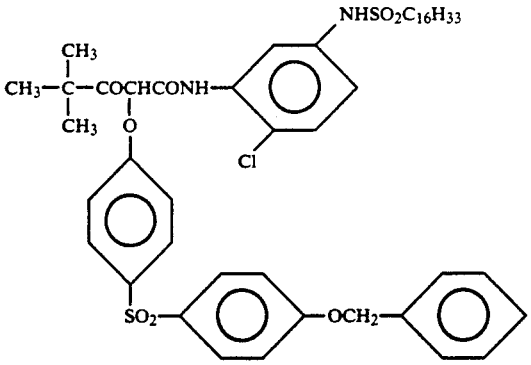

Y-1

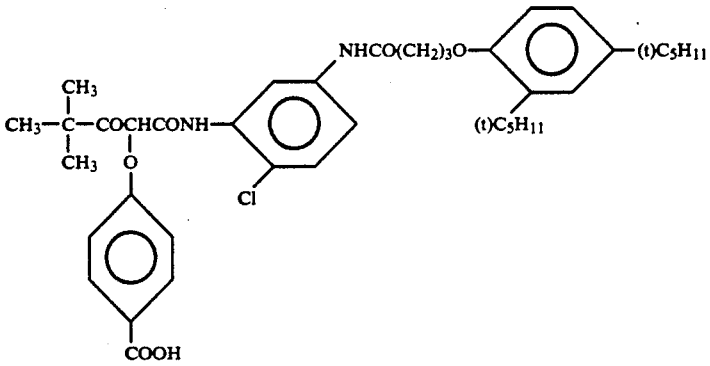

Y-2

-continued
Y-3
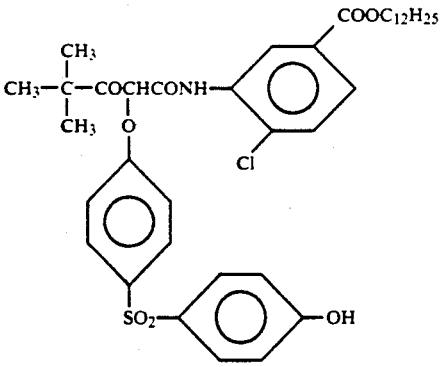
Y-4
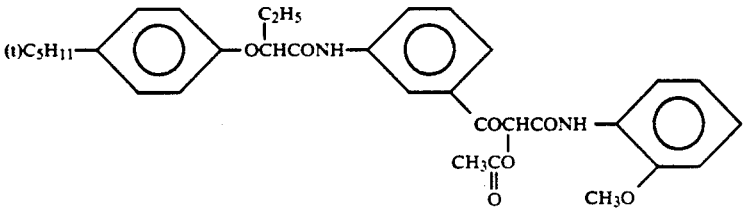
Y-5
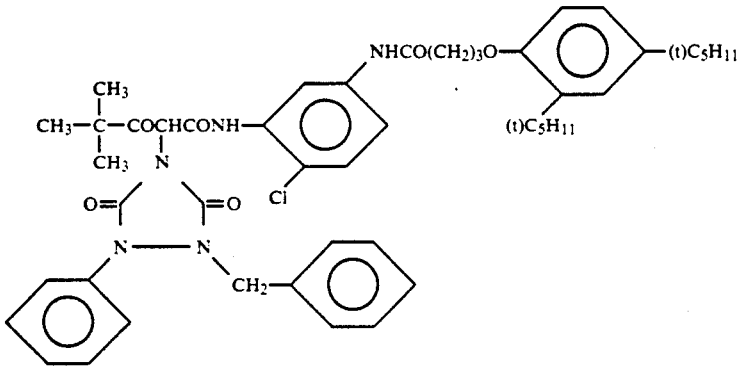
Y-6
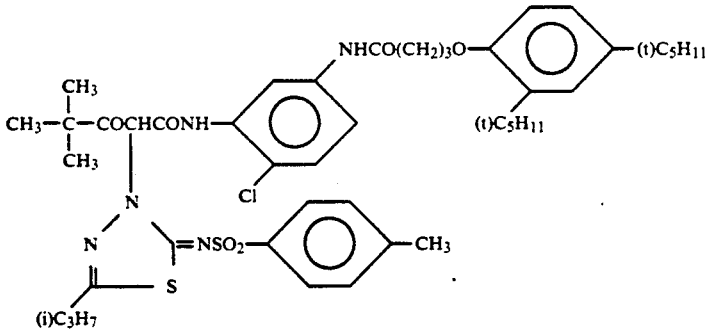
Y-7
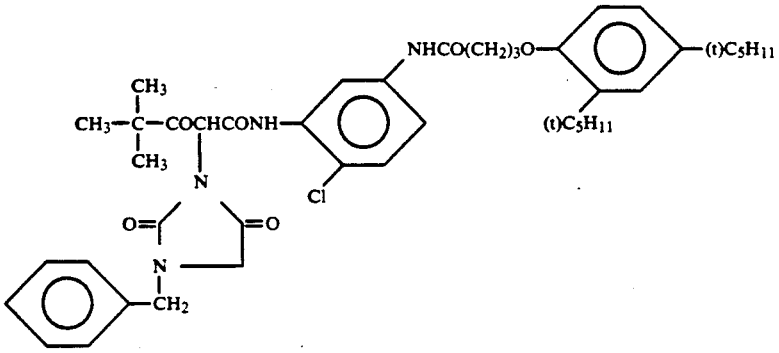

-continued
Y-8
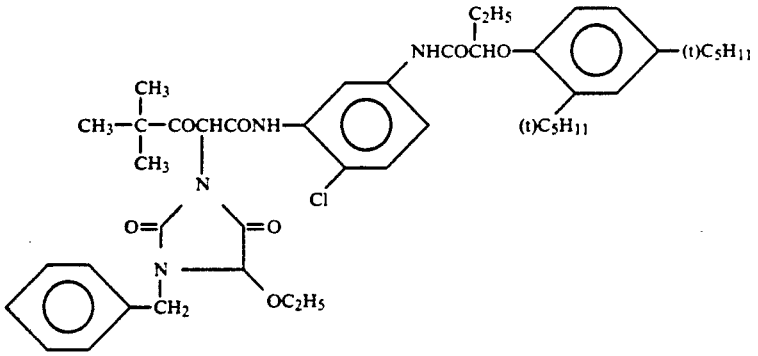
Y-9
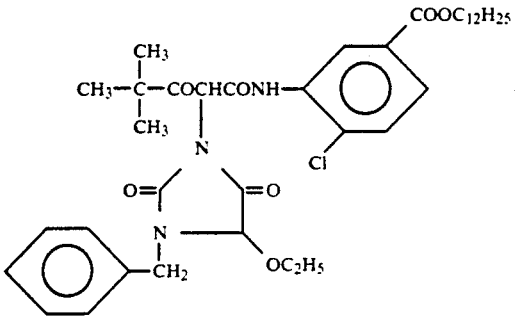
Y-10
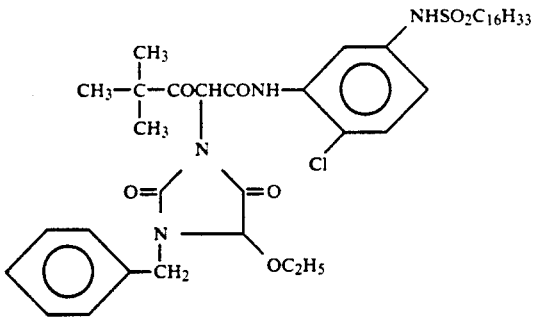
Y-11
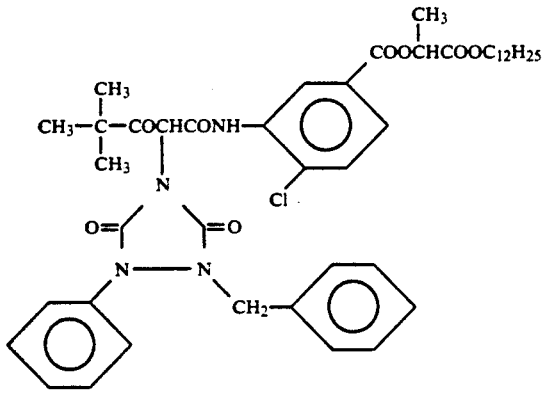

-continued
Y-12
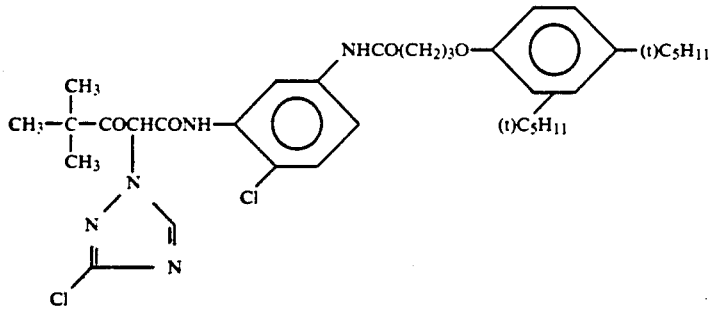
Y-13
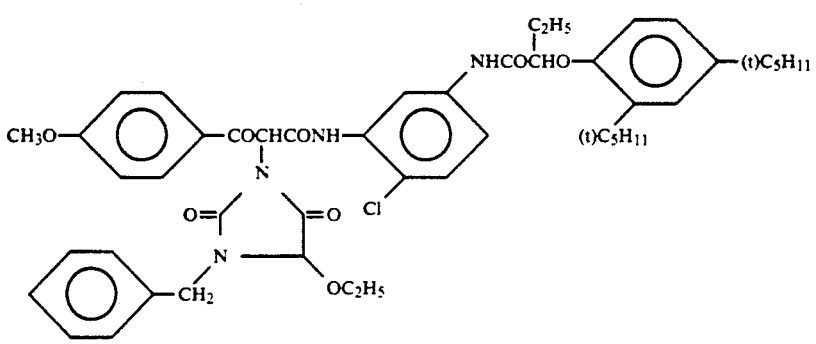
Y-14
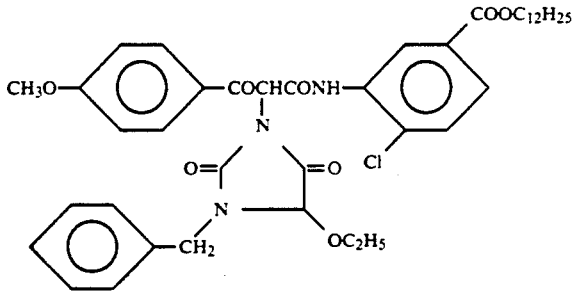
Y-15
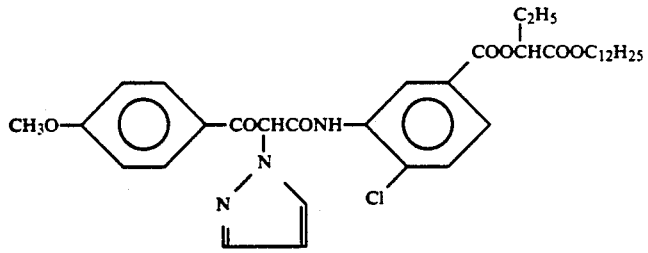
Y-16
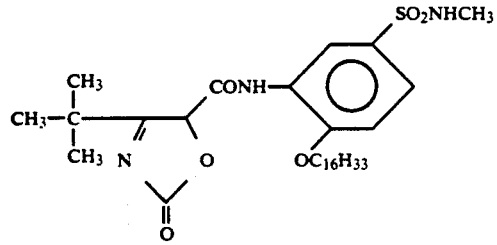

-continued
Y-17
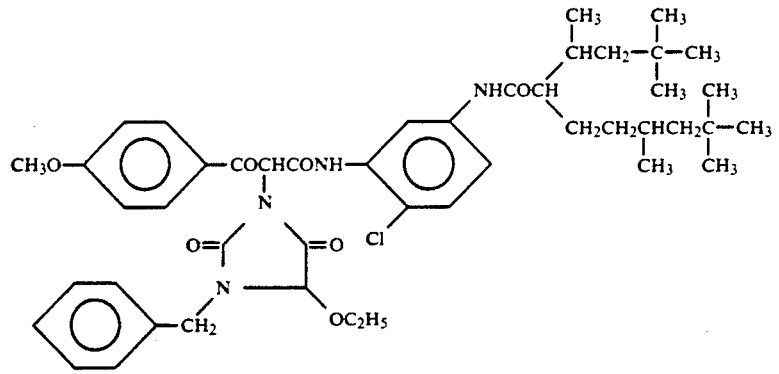
Y-18
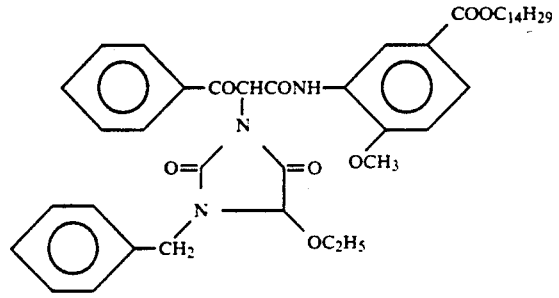
Y-19
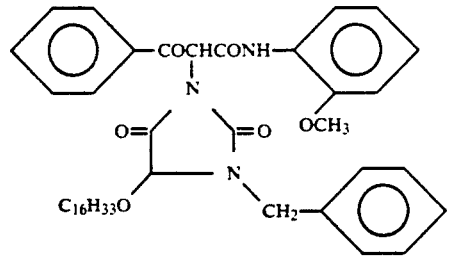
Y-20
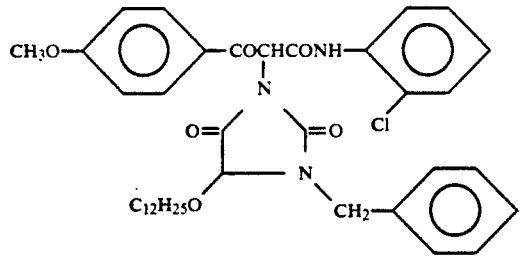
Y-21
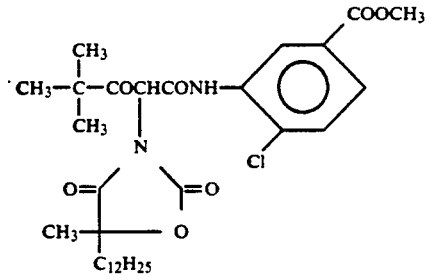

-continued
Y-22
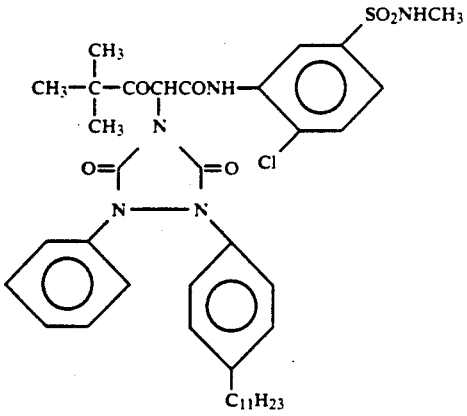
Y-23
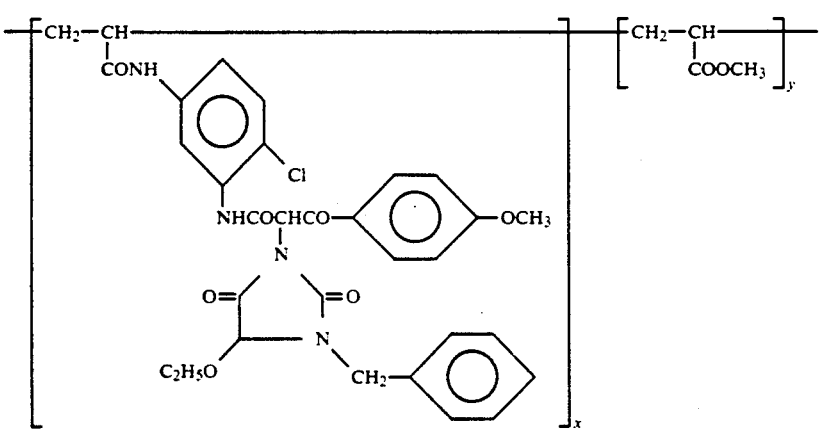
x:y = 30:70 (weight ratio, the same hereinafter)
2-Equivalent magenta coupler
M-1
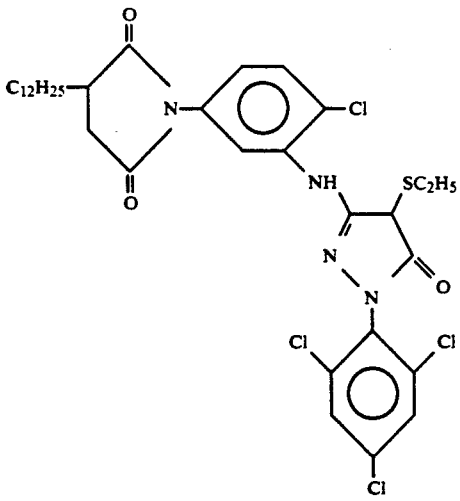

-continued
M-2
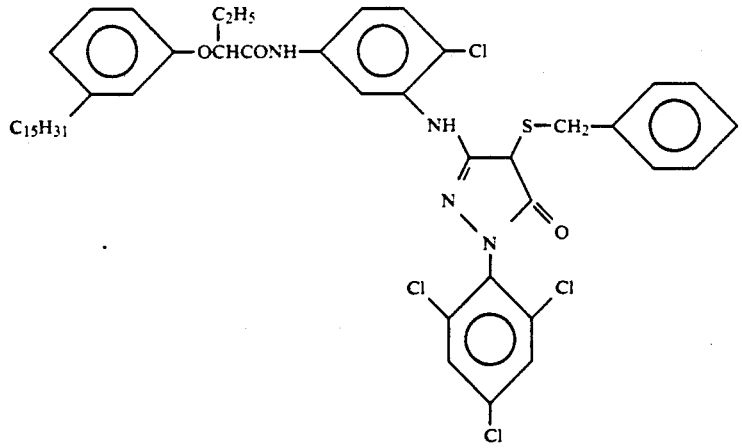
M-3
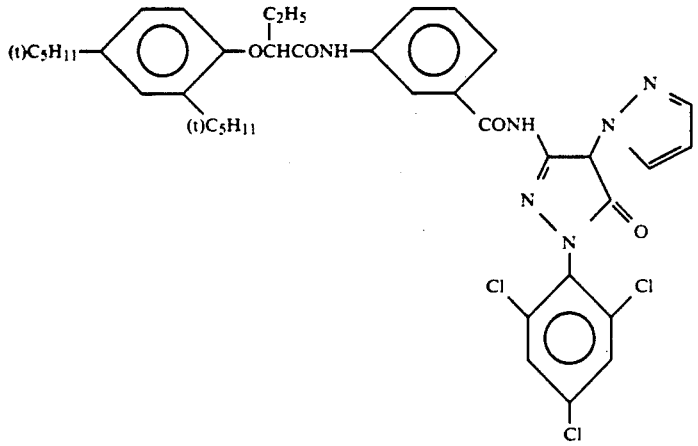
M-4
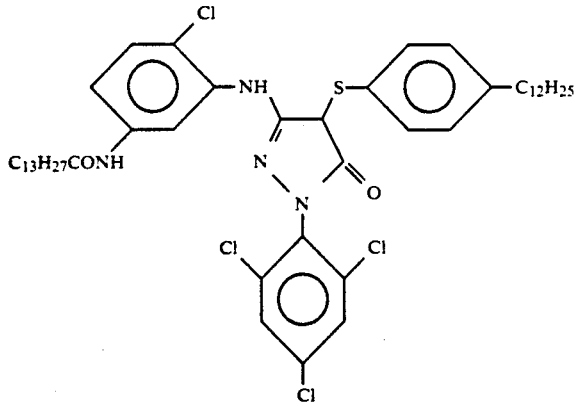
M-5
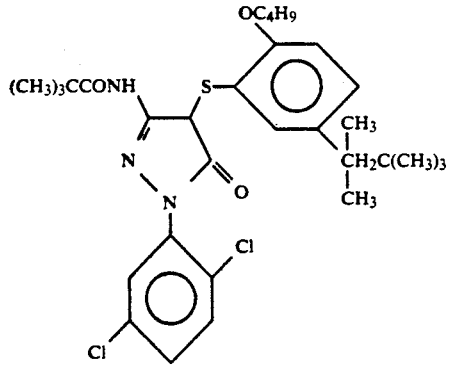

-continued
M-6
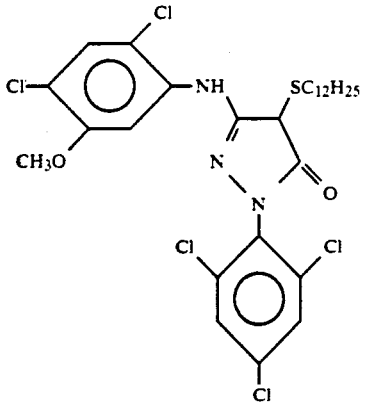
M-7
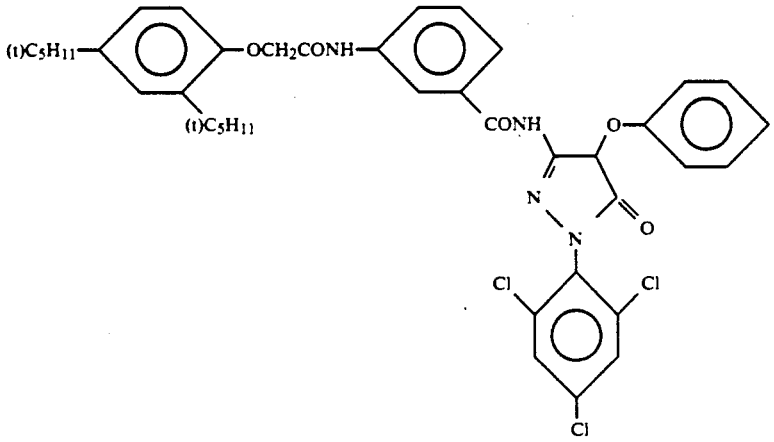
M-8
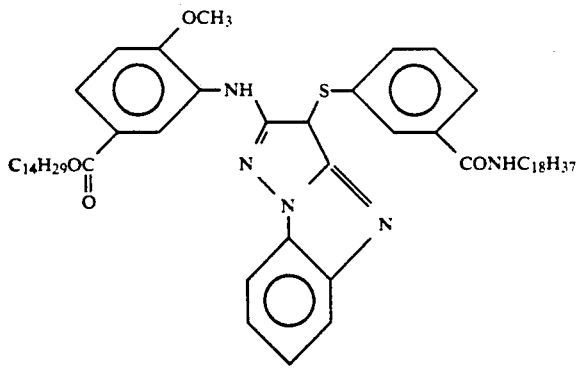
M-9
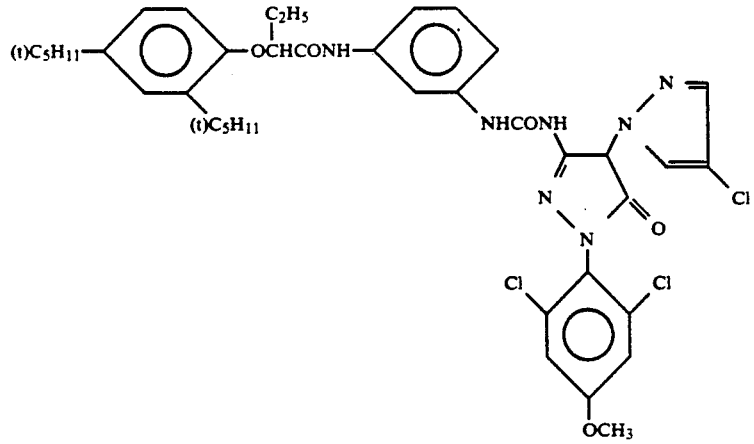

-continued
M-10
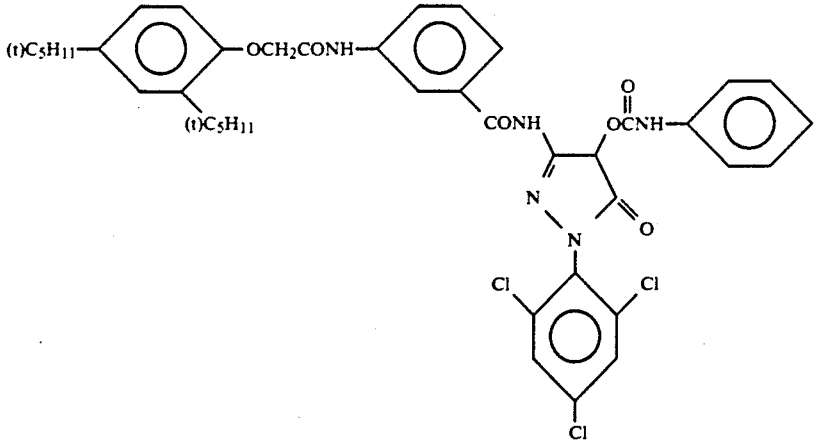
M-11
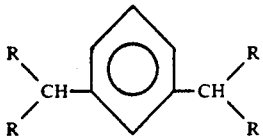
wherein R represents
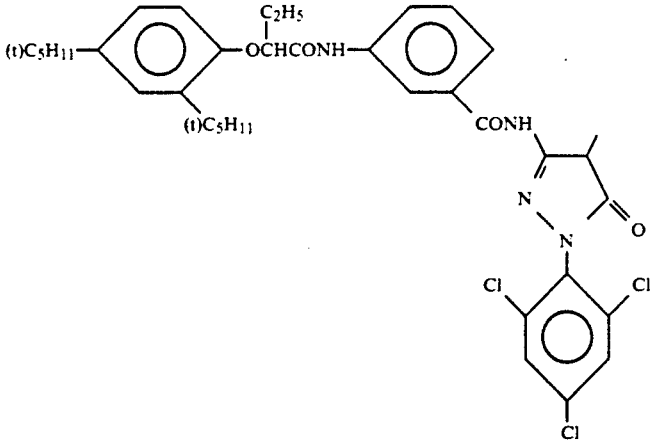
M-12
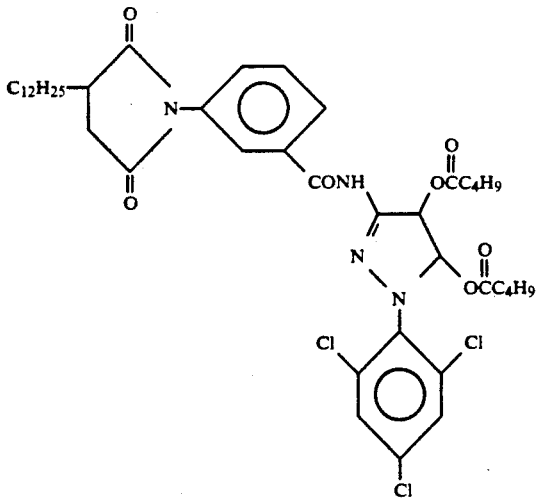

-continued
M-13
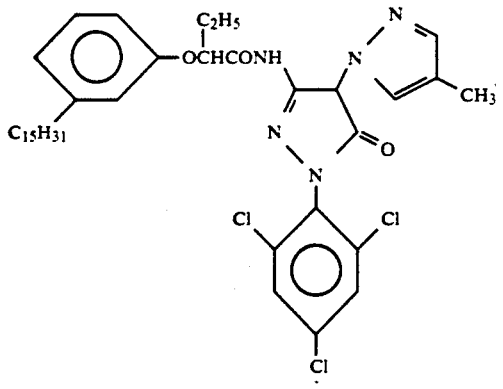
M-14
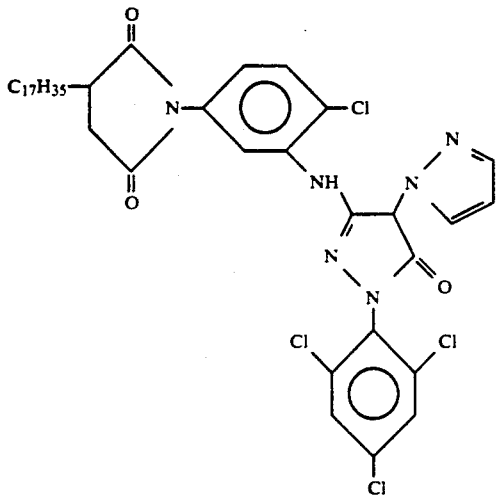
M-15
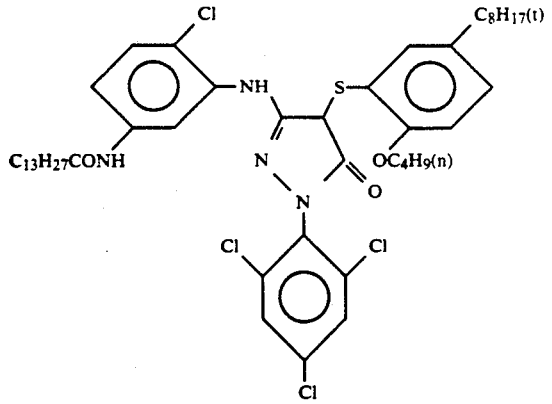
M-16
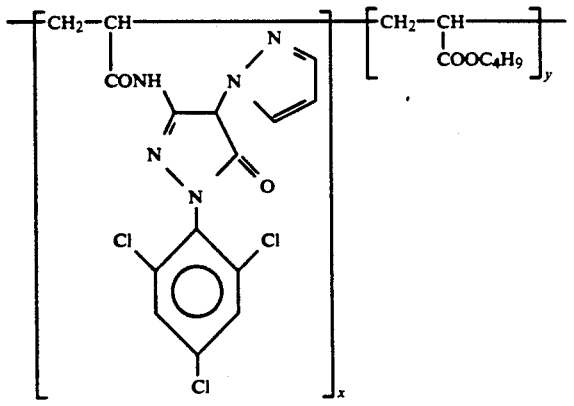

-continued
x:y = 45:55
M-17
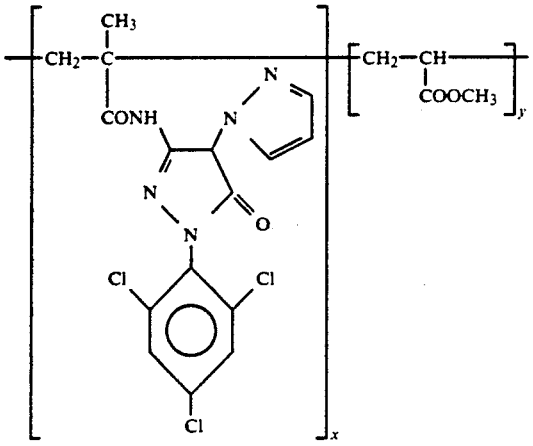
x:y = 50:50
M-18
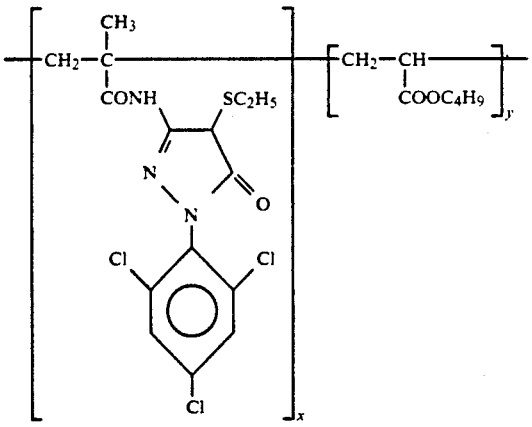
x:y = 30:70
M-19
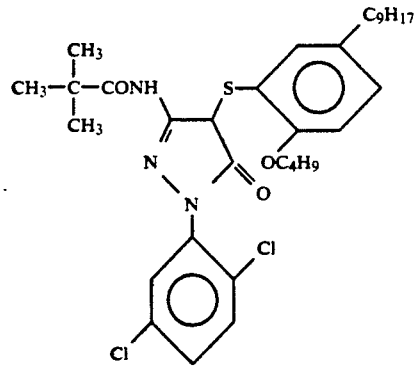

-continued
M-20
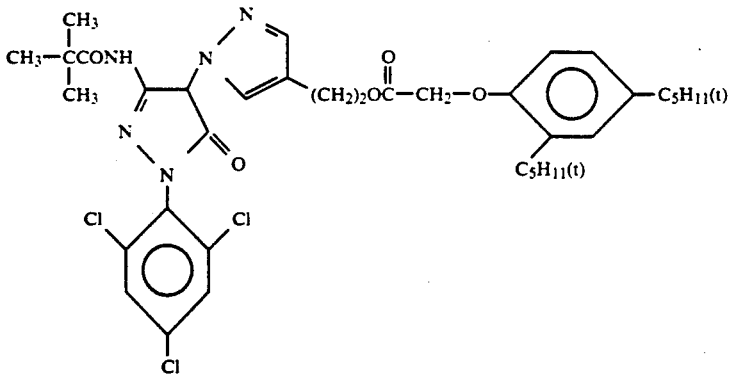
M-21
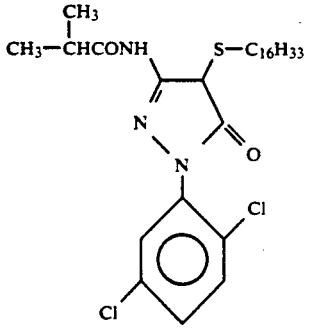
M-22
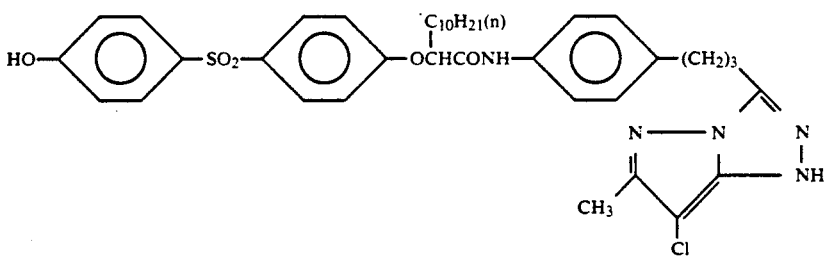
M-23
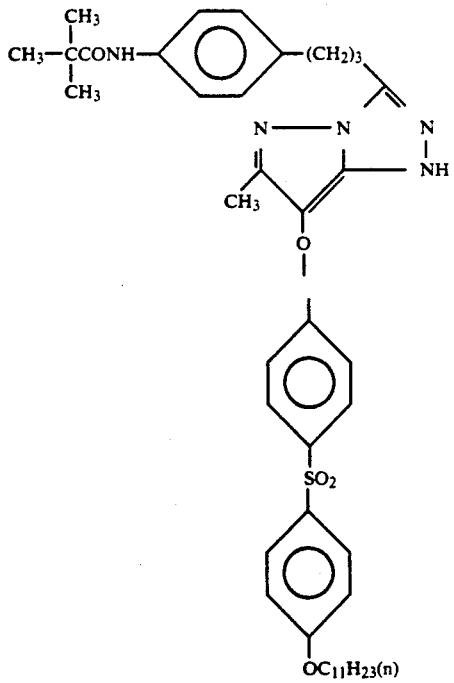

-continued
M-24
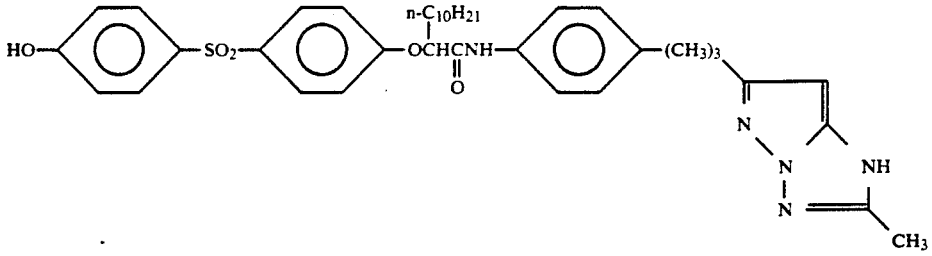
M-25
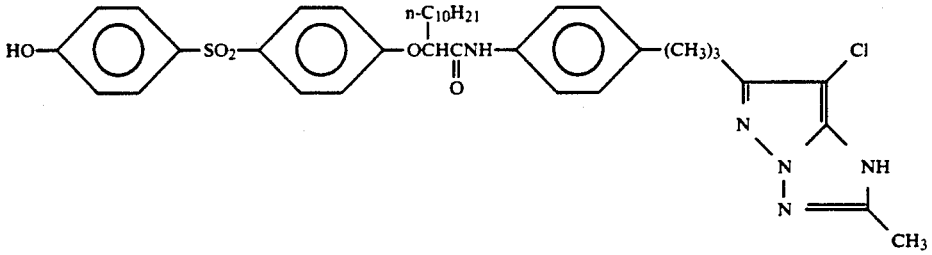
M-26
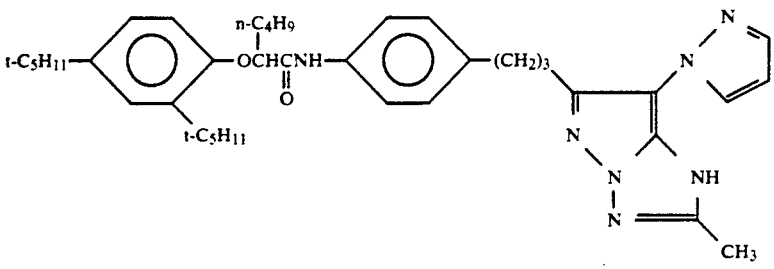
M-27
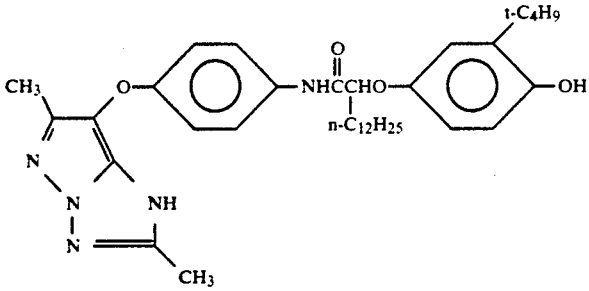
M-28
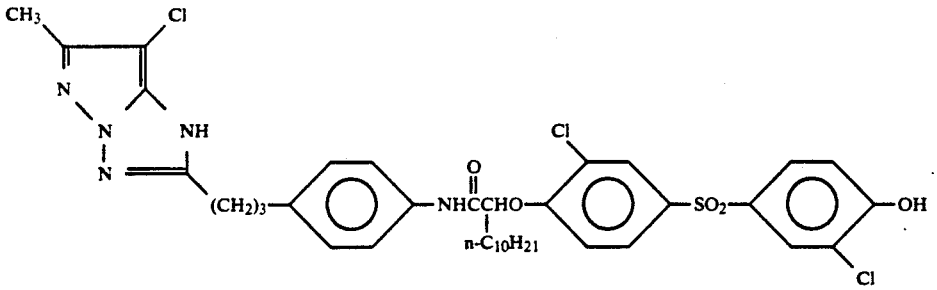
M-29
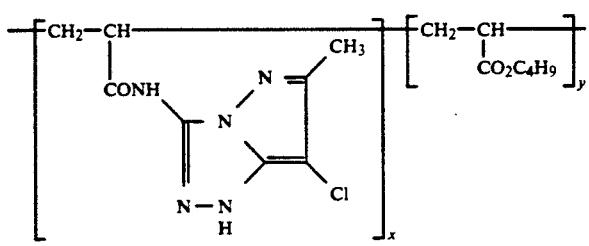
x:y = 50:50
(by weight, hereinafter the same)

-continued
M-30
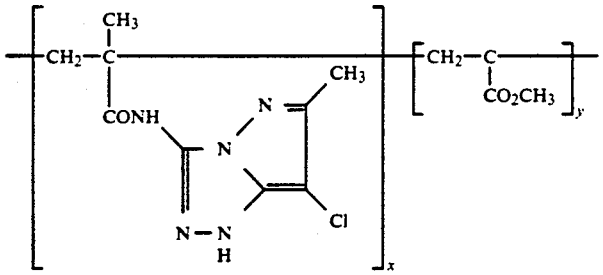
x:y = 40:60
M-31
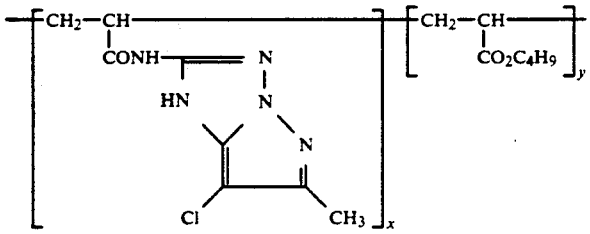
x:y = 50:50
M-32
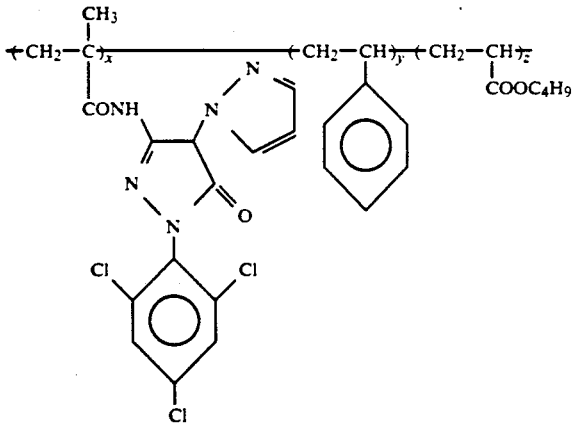
x:y:z = 50:25:25
M-33
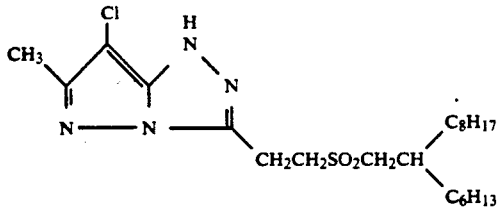
Cyan coupler
C-1
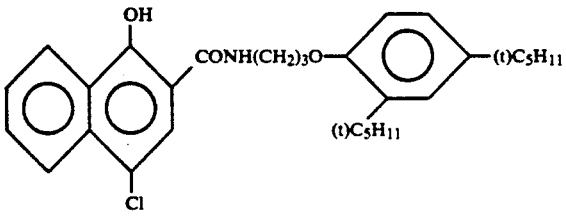

-continued
C-2
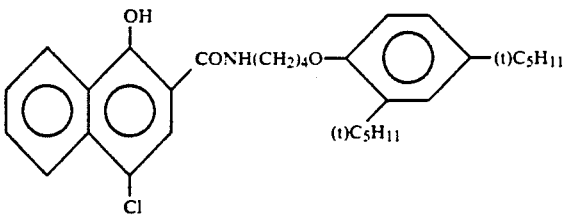
C-3
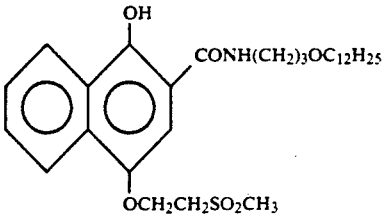
C-4
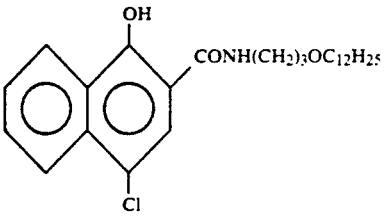
C-5
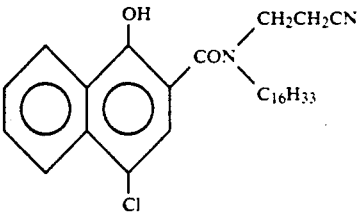
C-6
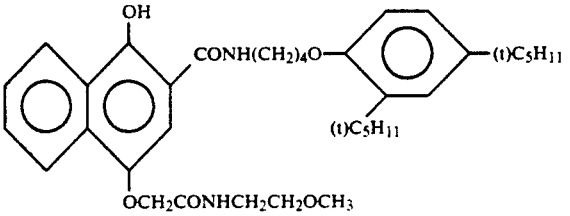
C-7
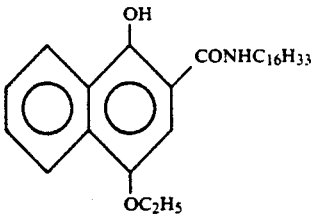
C-8
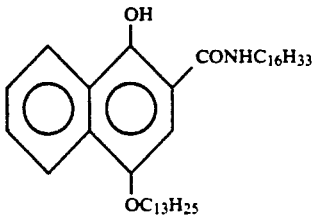

-continued
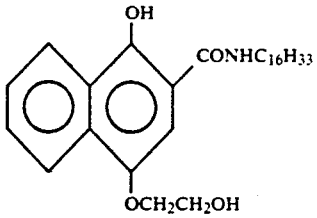
C-9
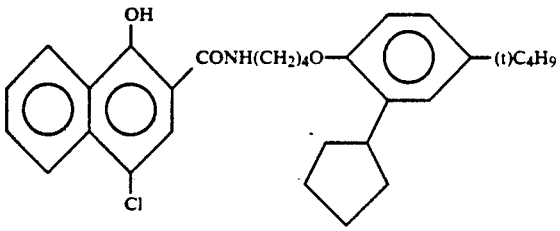
C-10
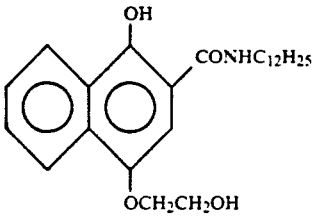
C-11
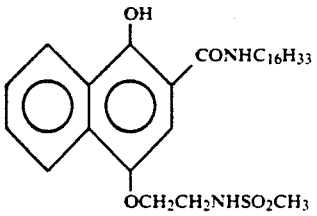
C-12
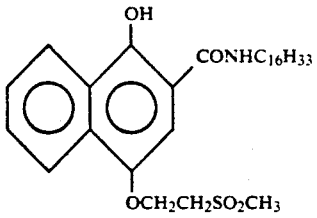
C-13
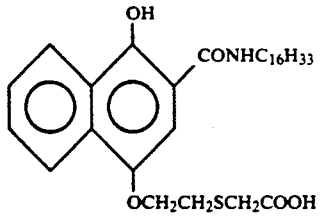
C-14
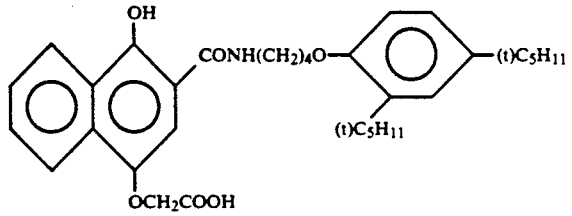
C-15

-continued
C-16
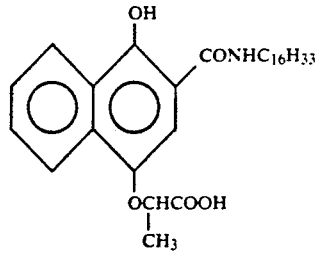
C-17
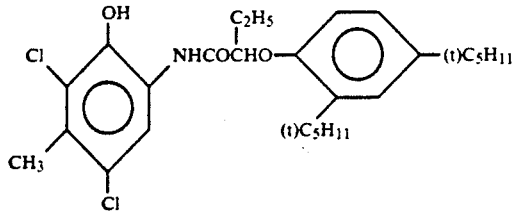
C-18
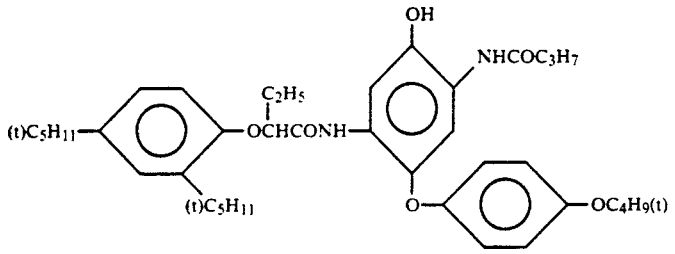
C-19
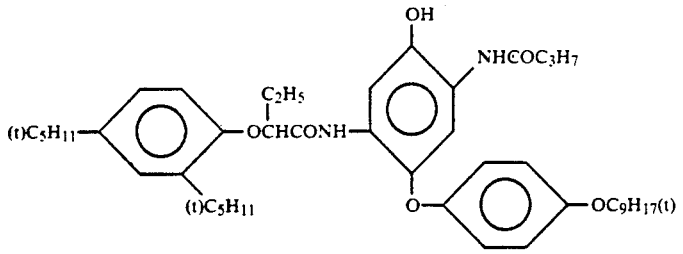
C-20
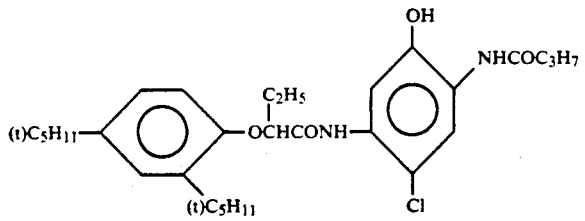
C-21
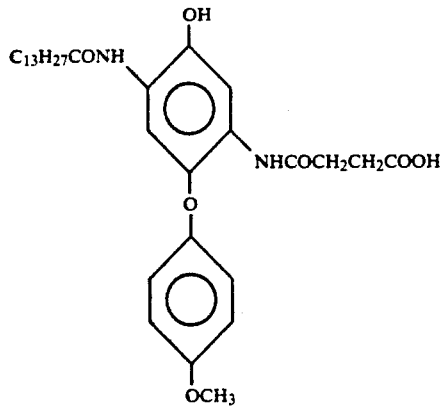

-continued
C-22
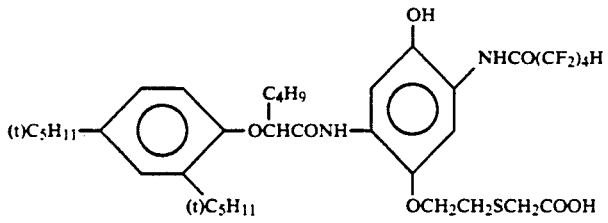
C-23
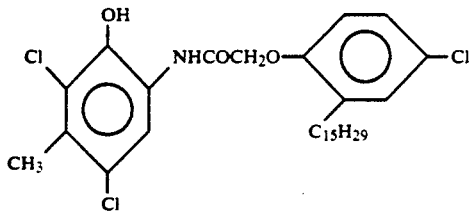
C-24
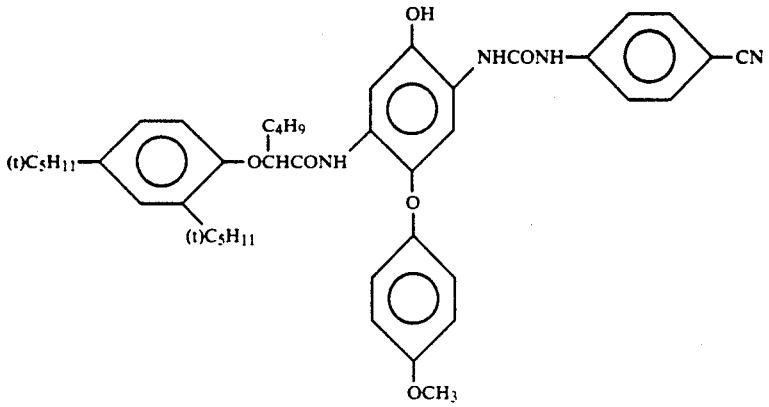
C-25
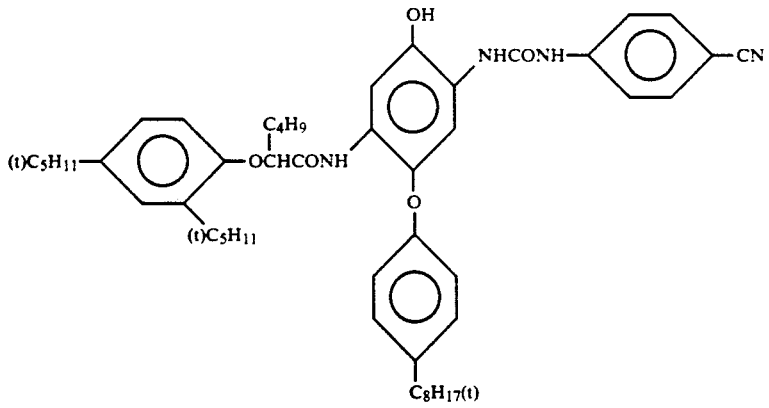
C-26
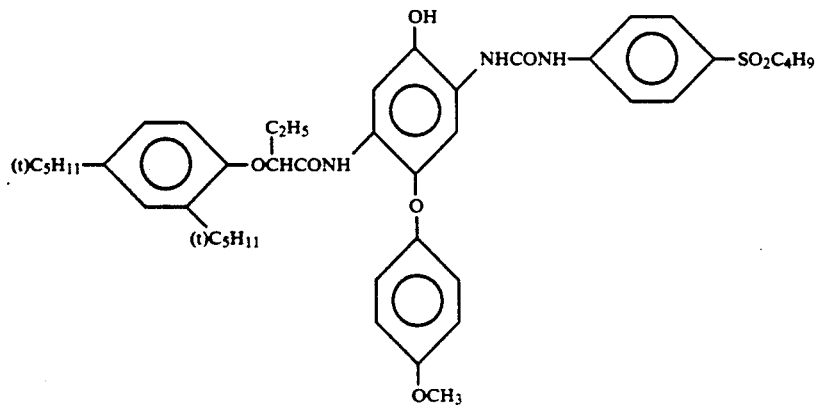

-continued
C-27
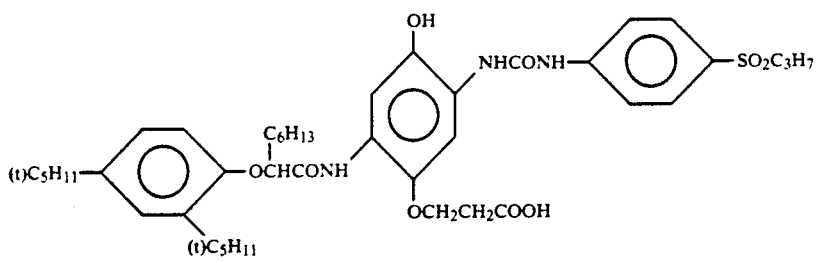
C-28
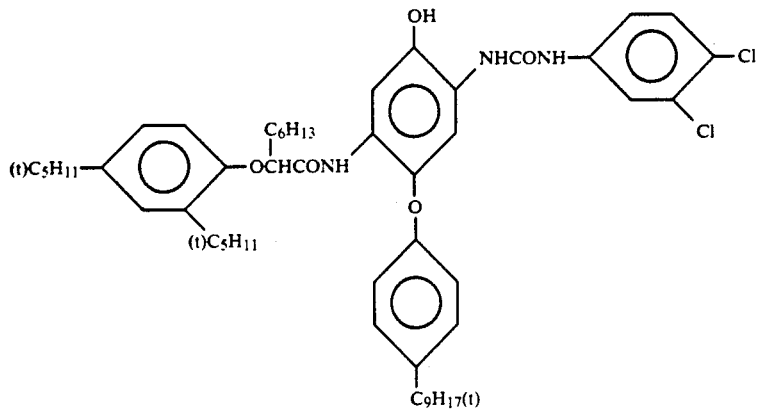
C-29
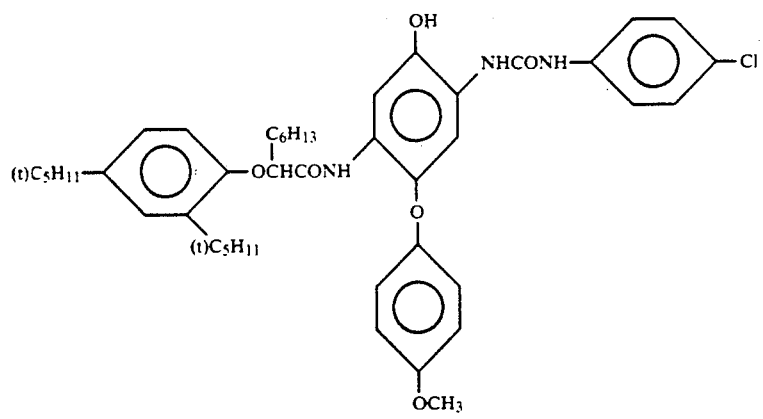
C-30
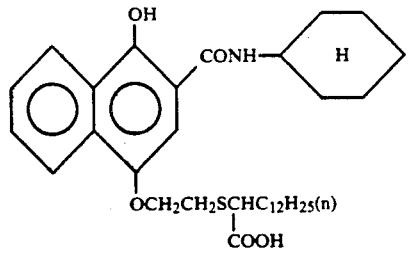
C-31
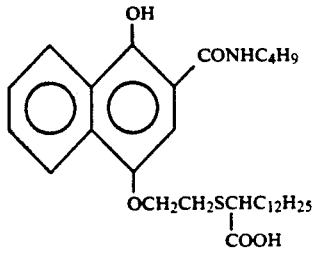

-continued
C-32
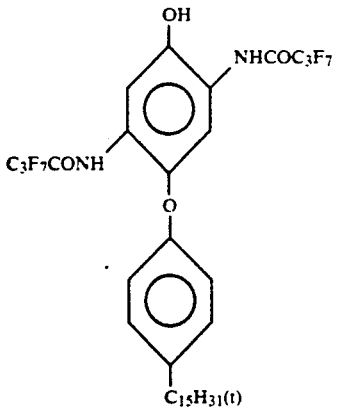
C-33
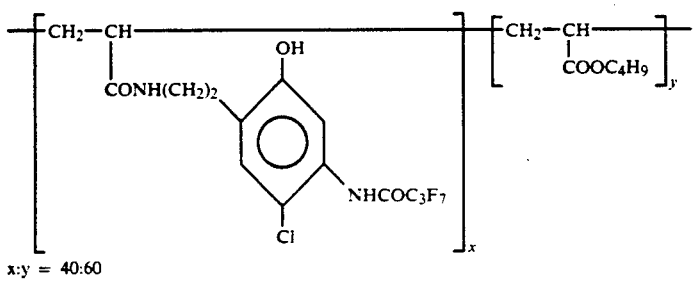
C-34
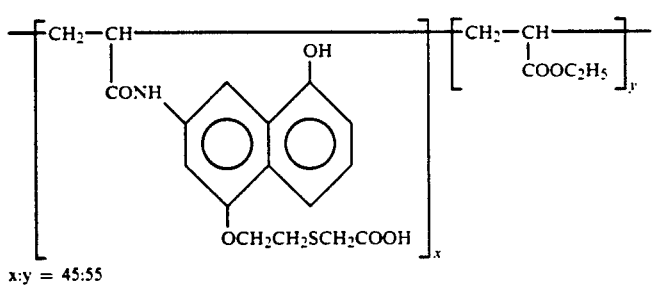
C-35
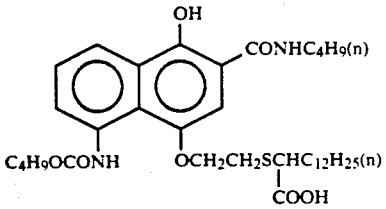
C-36
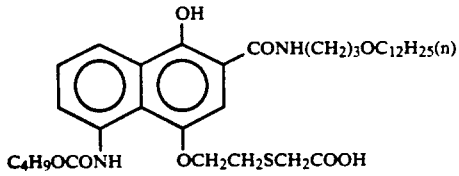
C-37
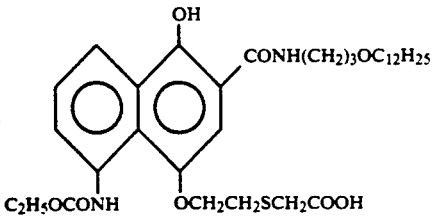
The coated amount of a two-equivalent cyan or yellow coupler to be used in the present invention is preferably in the range of $5\times10^{-5}$ to $2\times10^{-3}$ mol/m$^2$, more preferably in the range of $1\times10^{-4}$ to $2\times10^{-3}$ mol/m$^2$, particularly in the range of $2\times10^{-4}$ to $2\times10^{-3}$ mol/m$^2$. The coated amount of a two-equivalent magenta coupler is preferably in the range of $2\times10^{-5}$ to $1\times10^{-3}$ mol/m$^2$, more preferably in the range of $5\times10^{-5}$ to $1\times10^{-3}$ mol/m$^2$, particularly in the range of $1\times10^{-4}$ to $1\times10^{-3}$ mol/m$^2$.

The less the silver content in the present light-sensitive material containing a two-equivalent is, the less is the deterioration in the photographic properties due to heat. However, if the silver content is 3.0 g/m$^2$ or less, the color light-sensitive material which has just been prepared exhibits a poor graininess which makes it impossible to provide the maximum density required by the color light-sensitive material. Therefore, the silver content in the light-sensitive material is preferably not more than 6.5 g/m$^2$, more preferably in the range of 4.5 to 6.0 g/m$^2$.

The reduction in the silver content may be preferably effected in the layers comprising a two-equivalent magenta coupler, more preferably in all the emulsion layers. If the two-equivalent magenta coupler is incorporated in a high sensitivity green-sensitive silver halide emulsion layer, the silver content in the emulsion layer is in the range of 0.5 to 1.0 g/m$^2$ and the molar ratio of Ag to coupler is preferably in the range of 5 to 400, more preferably in the range of 10 to 100.

In the present invention, the photographic emulsion may comprise various compounds for the purpose of inhibiting fogging during the preparation, storage or photographic processing of the light-sensitive material or ° stabilizing the photographic properties of the light-sensitive material. Examples of suitable such compounds which may be incorporated in the light-sensitive material include azoles (e.g., benzothiazolium salts, nitroindazoles, triazoles, benzotriazoles, benzimidazoels (particularly nitro- or halogen-substituted benzimidazoles)), heterocyclic mercapto compounds (e.g., mercaptothiazoles, mercaptobenzothiazoels, mercaptobenzimidazoles, mercaptothiadiazoles, mercaptotetrazoles (particularly 1-phenyl-5-mercaptotetrazole), mercaptopyrimidines), heterocyclic mercapto compounds containing water-soluble groups such ask carboxyl group or sulfon group, thioketo compounds (e.g., oxazolinethione), azaindenes (e.g., tetraazaindenes (particularly 4-hydroxy-substituted (1,3,3a,7)tetraazaindenes)), benzenethiosulfonic acids, benzenesulfinic acids, and many other compounds known as fog inhibitors or stabilizers.

For details, E. J. Birr, *Stabilization of Photographic Silver halide Emulsion*, Focal Press, 1974, can be referenced.

In the present invention, the photographic emulsion may particularly preferably comprise a compound represented by the general formula (XI):

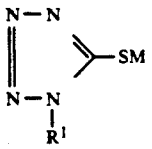

(XI)

wherein $R^1$ represents an aliphatic, aromatic or heterocyclic group substituted by at least one —COOM or —$SO_3M$; and M represents a hydrogen atom, alkaline and metal atom, quaternary ammonium or quaternary phosphonium.

Specific examples of suitable compounds of the general formula (XI) which can be used in the present invention will be shown hereinafter, but the present invention should not be construed as being limited there.

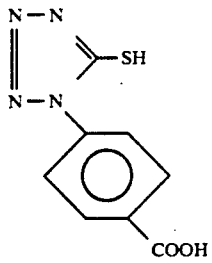

(1)

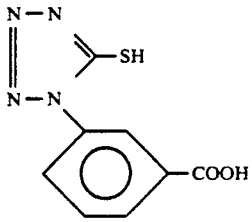

(2)

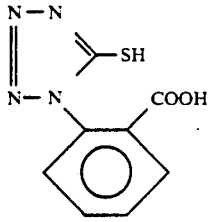

(3)

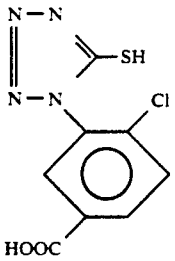

(4)

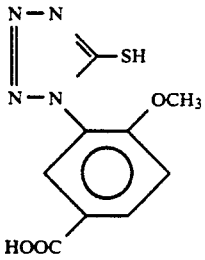

(5)

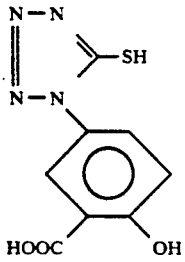

(6)

-continued (7)

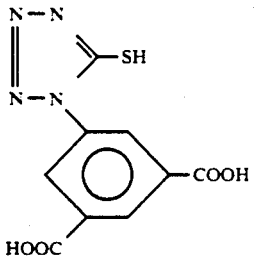

(8)

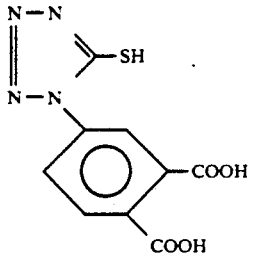

(9)

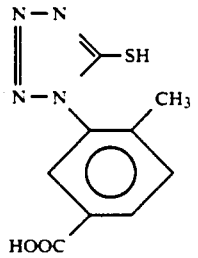

(10)

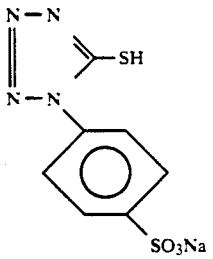

(11)

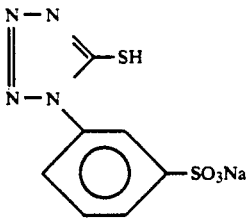

(12)

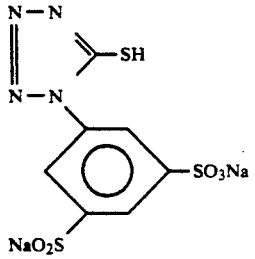

-continued (13)

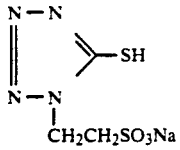

(14)

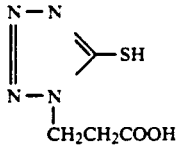

(15)

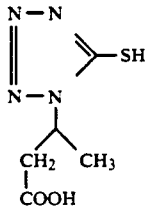

In the present invention, the photographic emulsion may comprise a coupler which releases a development inhibitor upon development (so-called DIR coupler).

Examples of such a DIR coupler include those which release a heterocyclic mercapto development inhibitor as described in, for example U.S. Pat. No. 3,227,554, those which release a benzotriazole derivative as a development inhibitor as described in JP-B-58-9942, so-called colorless DIR couplers as described in JP-B-51-16141, those which release a nitrogen-containing heterocyclic development inhibitor with the decomposition of methylol after coupling-off reaction as described in JP-A-52-90932, those which release a development inhibitor with an intramolecular nucleophilic reaction after coupling-off reaction as described in U.S. Pat. No. 4,248,962, those which release a development inhibitor by the movement of electron through a conjugated system after coupling-off reaction as described in JP-A-56-114946, 57-56837, 57-154234, 57-188035, 58-98728, 58-209736, 58-209737, 58-209738 and 58-209740, those which release a diffusive development inhibitor which deactivates its development inhibiting capability in a development solution as described in JP-A-57-151944, and those which release a reactive compound which produces a development inhibitor or deactivates a development inhibitor as described in JP-A-60-182438 and 60-184248.

Among these DIR couplers, those which may be preferably used in combination with the present invention are developing solution deactivation type DIR couplers (so-called super DIR couplers) as described in JP-A-151944, so-called timing type DIR couplers as described in U.S. Pat. No. 4,248,962, and JP-A-57-154234, and reaction type DIR couplers as described in JP-A-60-184248. Particularly preferred among these DIR couplers are developing solution deactivation type DIR couplers (so-called super DIR couplers) as described in JP-A-57-151944 and reaction type DIR couplers as described in JP-A-60-184248.

Specific examples of suitable DIR couplers which may be used in combination with the present invention will be shown hereinafter.

D-1
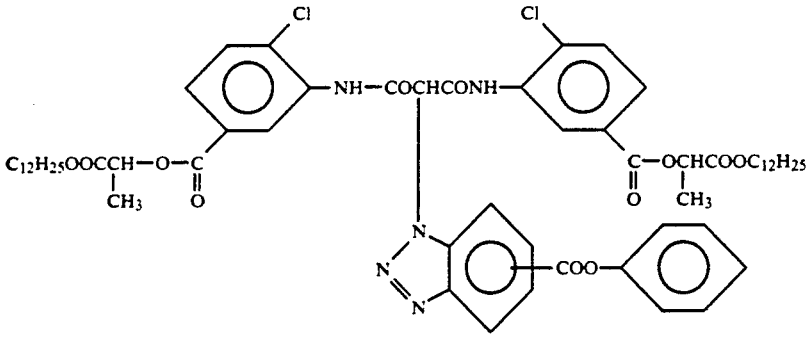
D-2
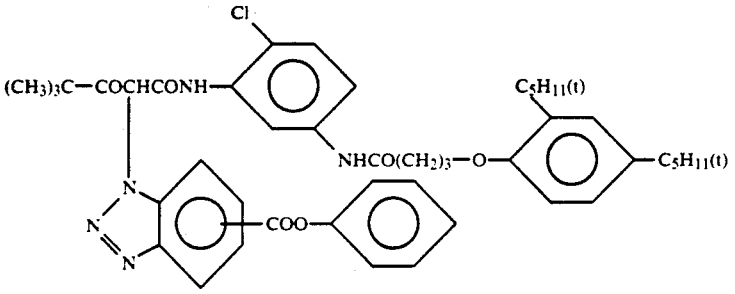
D-3
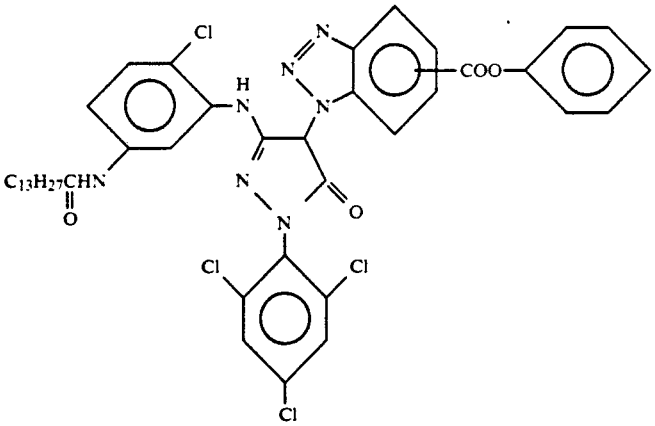
D-4
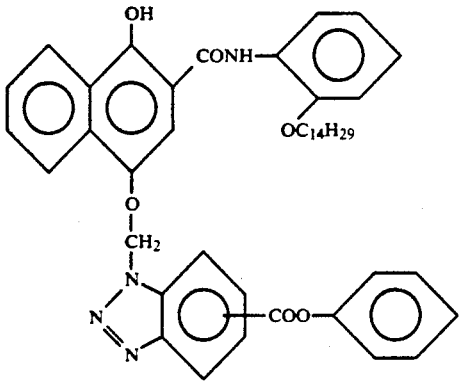

-continued
D-5
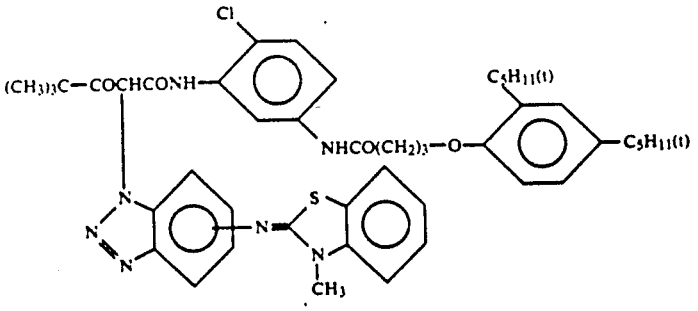
D-6
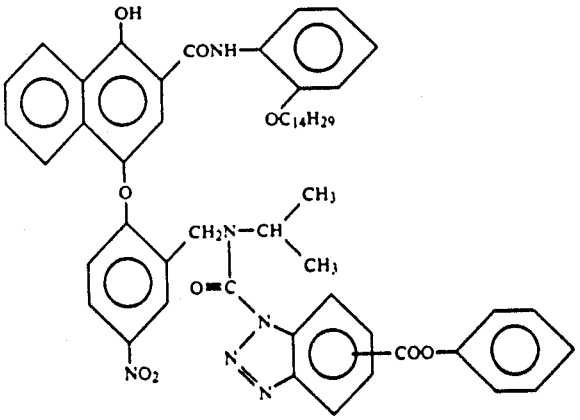
D-7
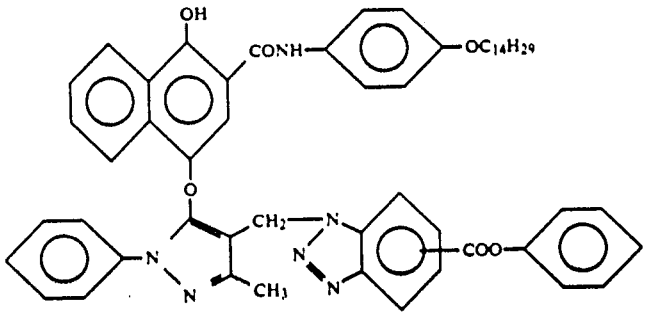
D-8
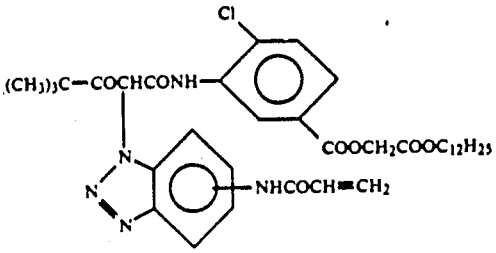

-continued
D-9
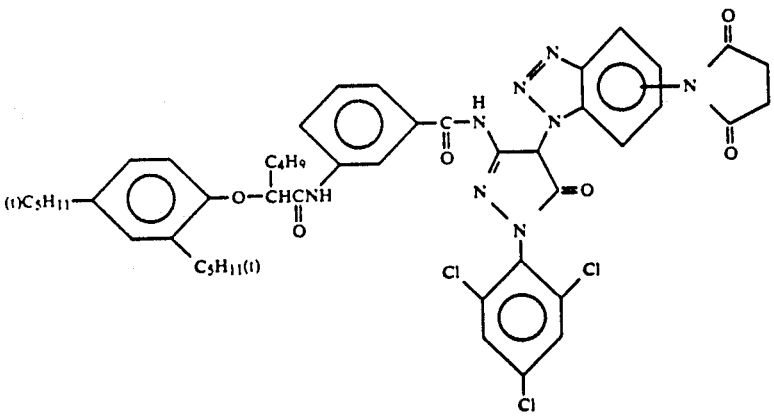
D-10
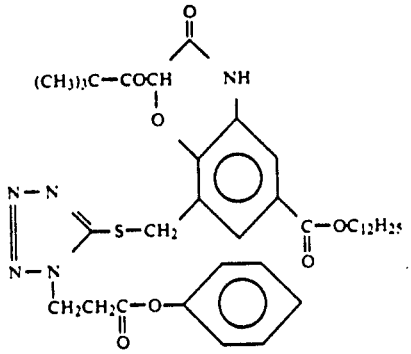
D-11
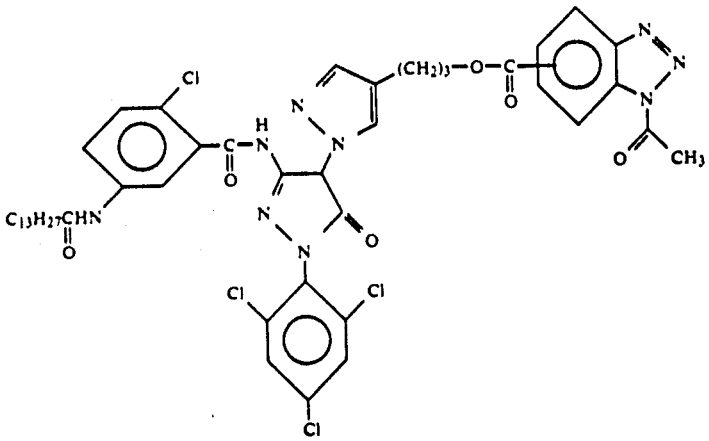
D-12
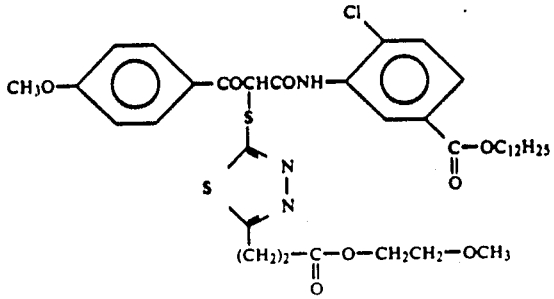

-continued
D-13
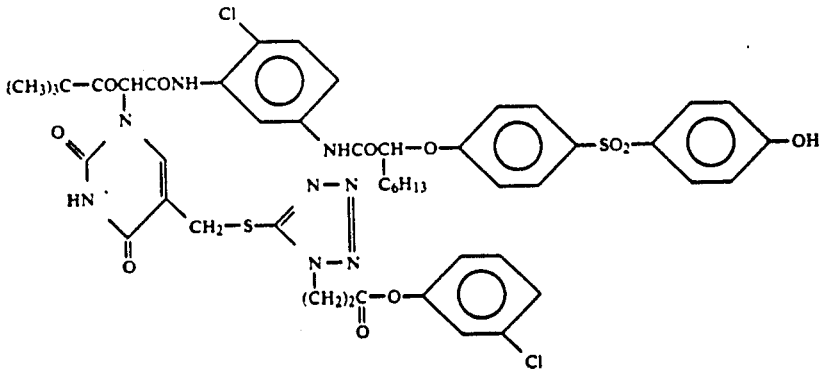
D-14
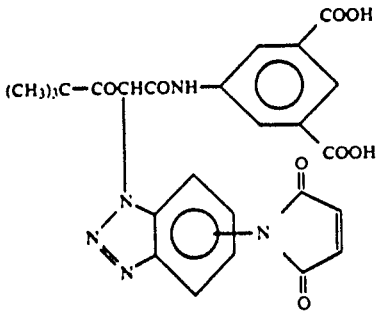
D-15
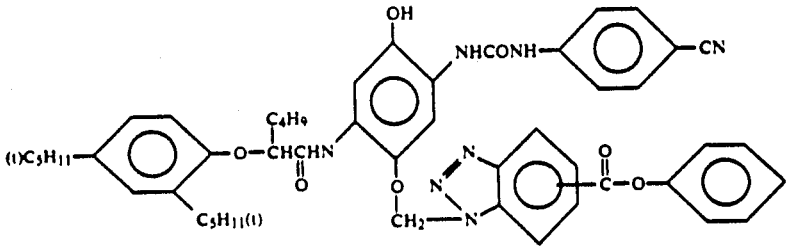
D-16
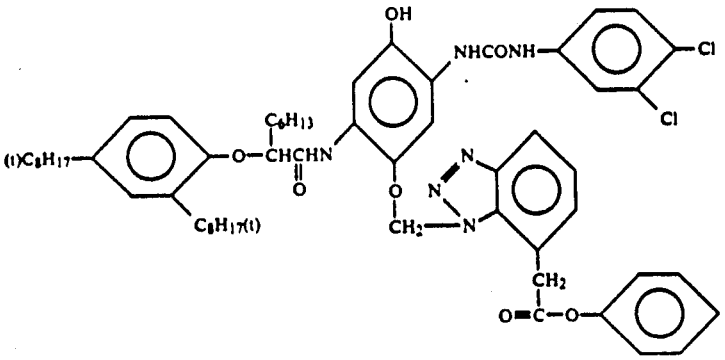

-continued
D-17
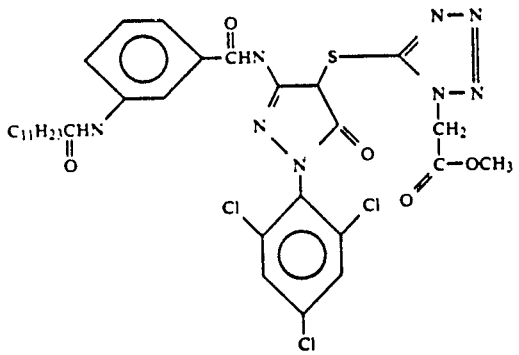
D-18
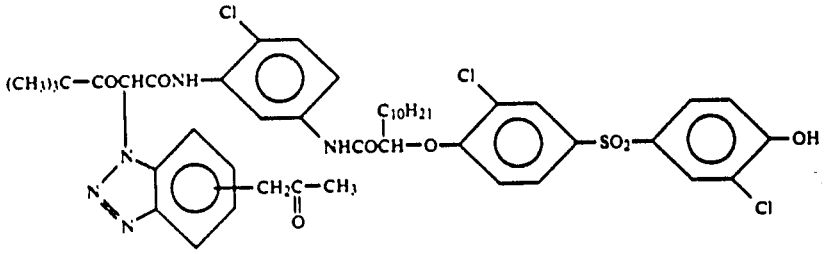
D-19
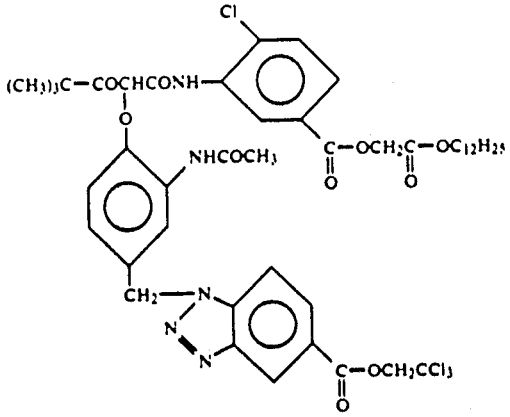
D-20
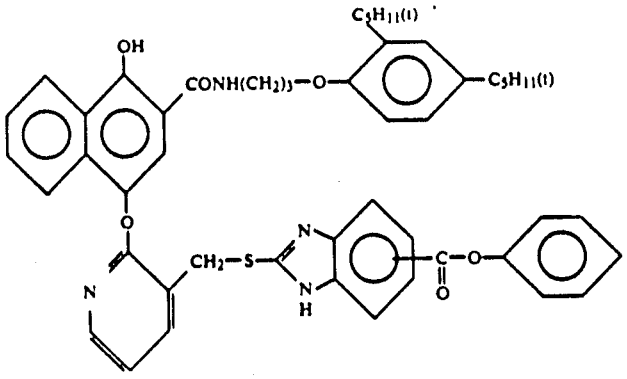

-continued
D-21
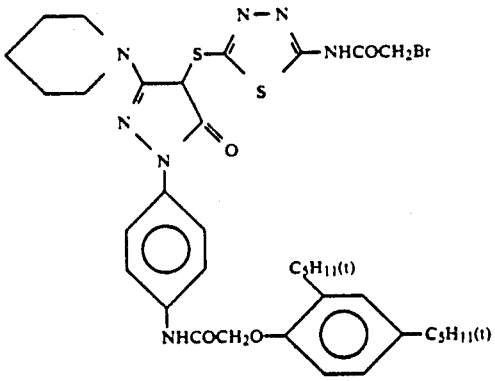
D-22
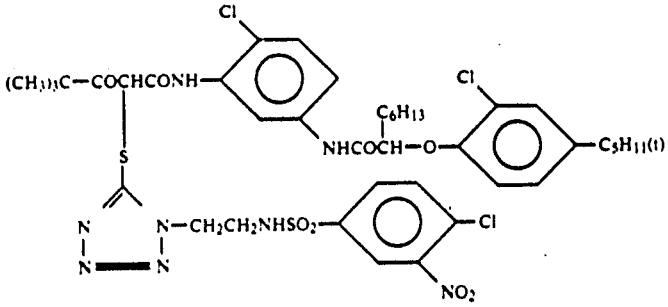
D-23
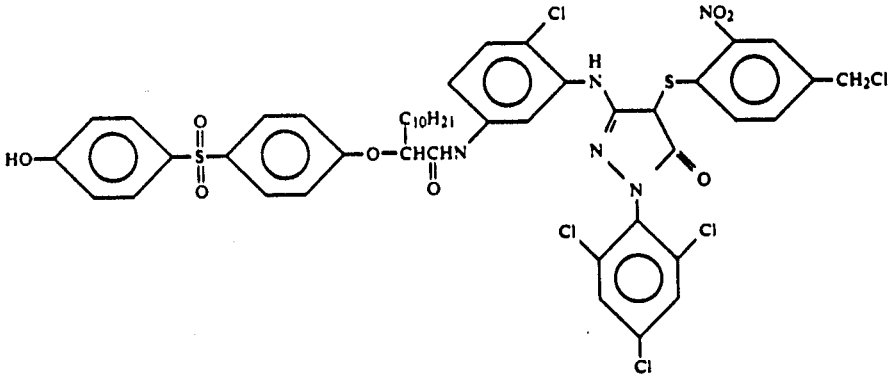
D-24
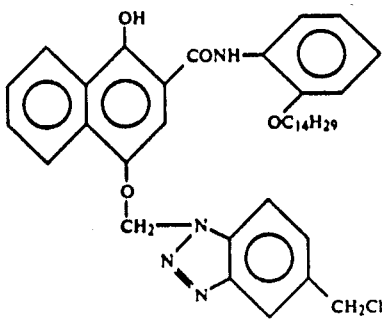

-continued
D-25
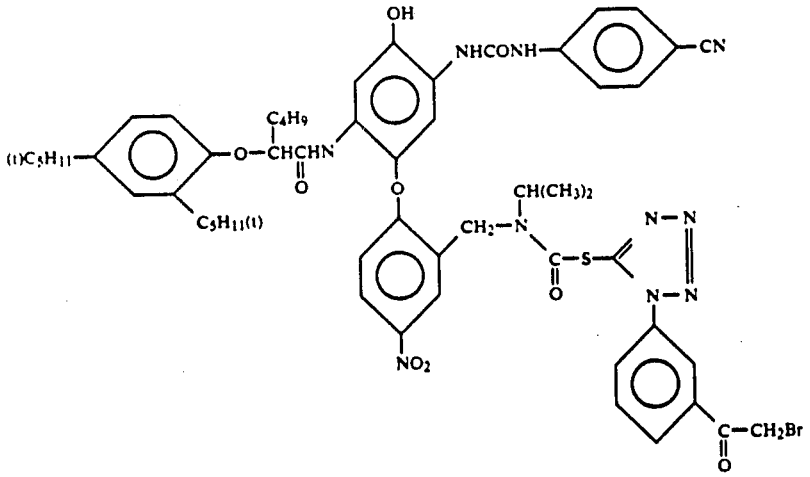
D-26
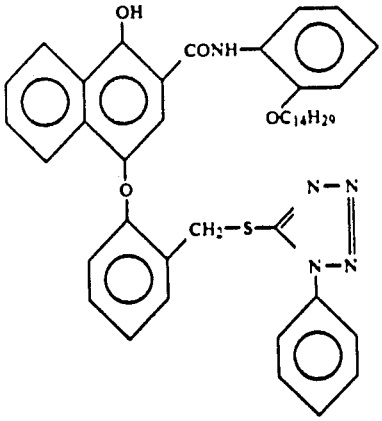
D-27
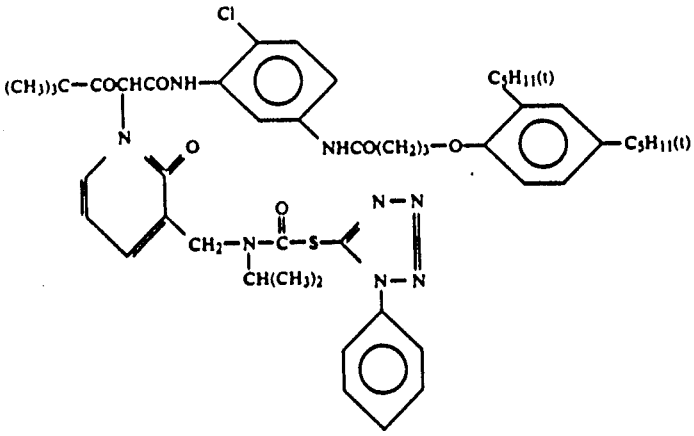

-continued
D-28
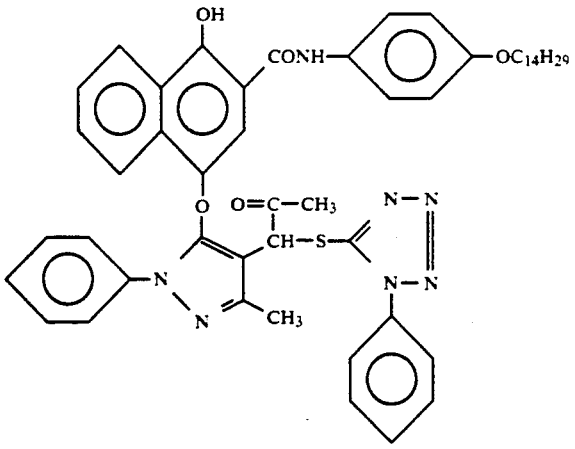
D-29
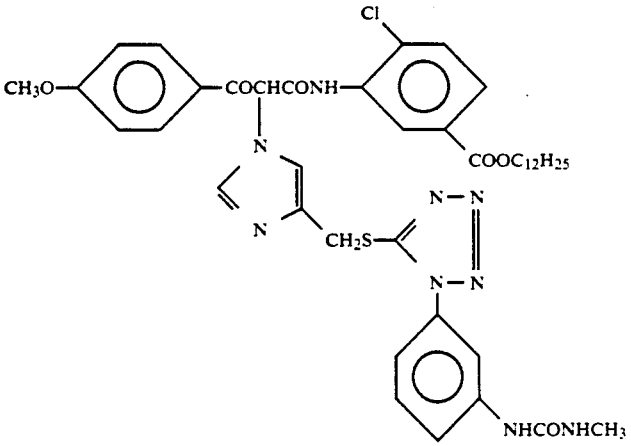
D-30
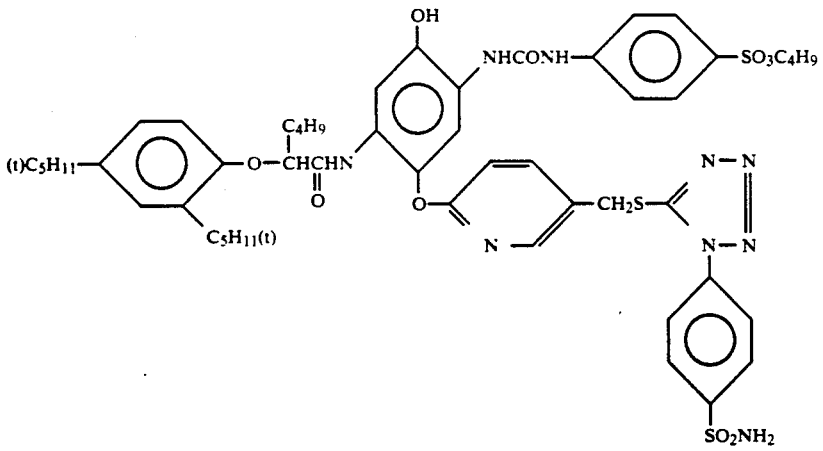
D-31
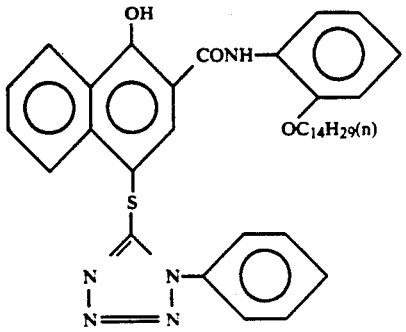

-continued
D-32
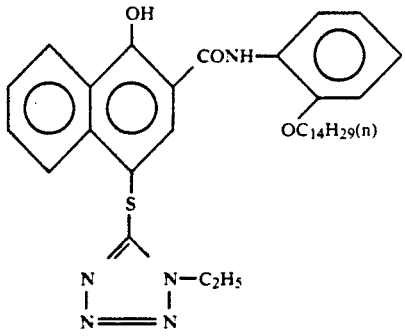
D-33
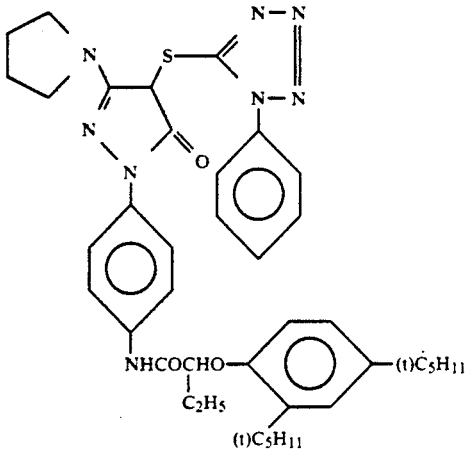
D-34
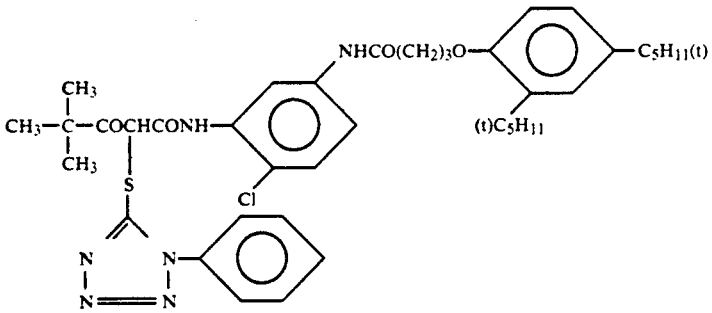
D-35
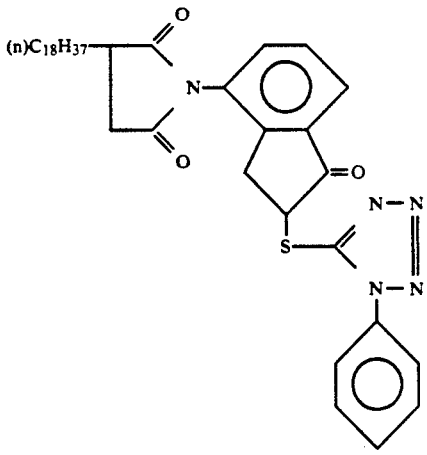

-continued
D-36
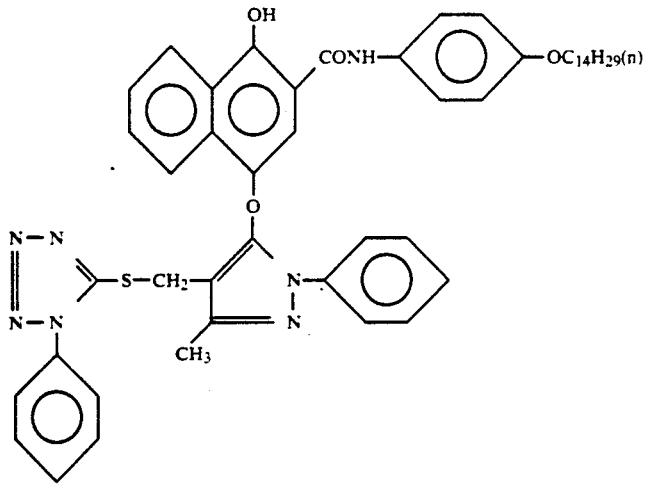
D-37
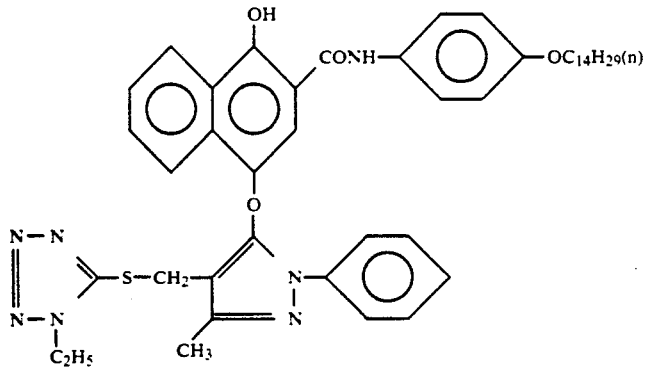
D-38
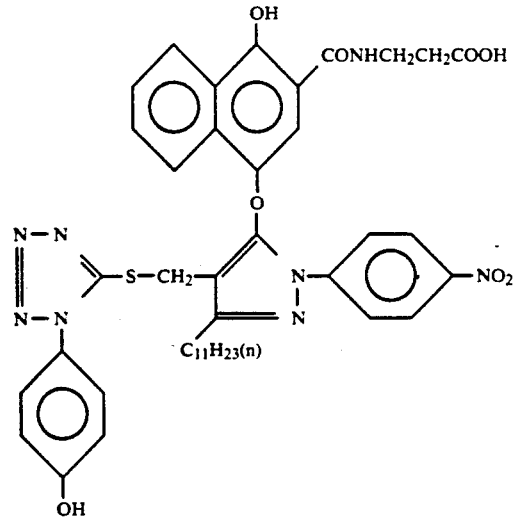

-continued

D-39

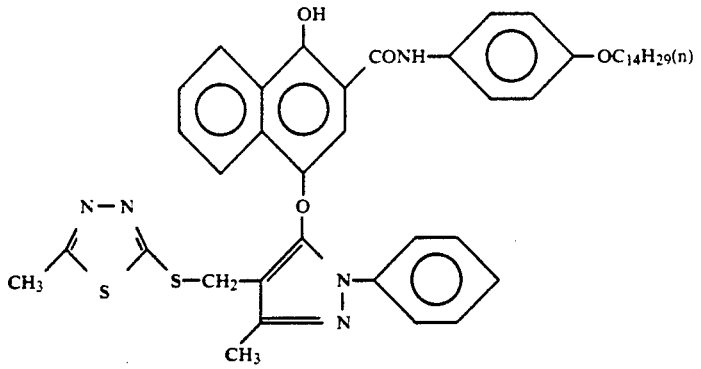

In the present invention, a colored coupler capable of correcting colors may be used in combination besides the above described couplers. Colorless DIR coupling compounds which undergo a coupling reaction to give a colorless product which releases a development inhibitor may be incorporated in the photographic emulsion besides such DIR couplers.

In the present invention, it is possible to attain a high sensitivity by using a compound capable of forming a development accelerator or fogging agent upon silver development (hereinafter referred to as "FR compound"). The synthesis of these FR compounds may be easily accomplished by any suitable method as described in U.S. Pat. Nos. 4,390,618, 4,518,682, 4,526,863, and 4,482,629, and JP-A-59-157638, 59-170840, 60-185950, and 60-107029.

Two or more of these FR compounds may be used in combination. The amount of such an FR compound to be incorporated is generally in the range of from $10^{-10}$ to 0.2 mol, more preferably from $10^{-7}$ to 0.02 mol per 1 mol of silver to be incorporated in the same layer or its adjacent layers. Such an FR compound may be incorporated in the silver halide emulsion layer singly or in combination with a dye-forming coupler by an oildrop-in-water dispersion process known as oil protect process to attain the desired objects.

Typical examples of such an FR compound will be shown hereinafter.

FR-1

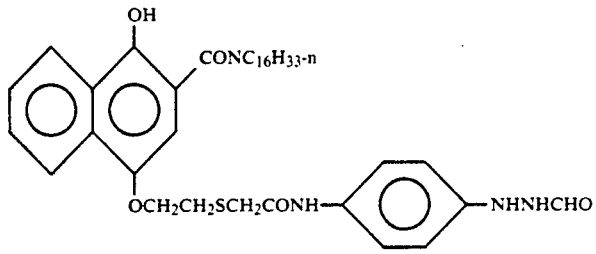

FR-2

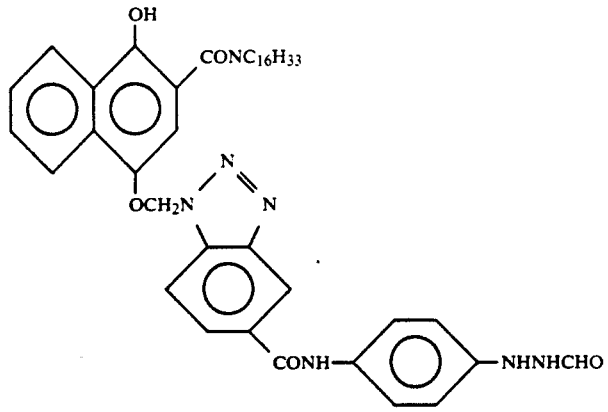

FR-3

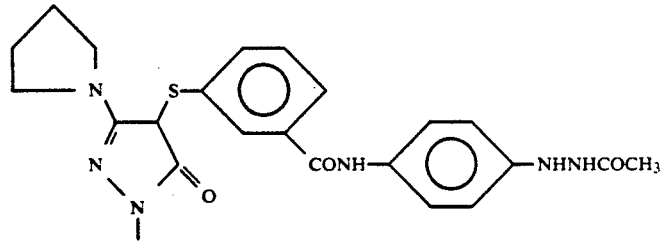

-continued
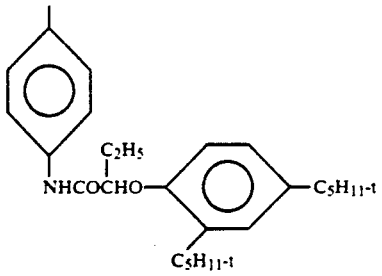
FR-4
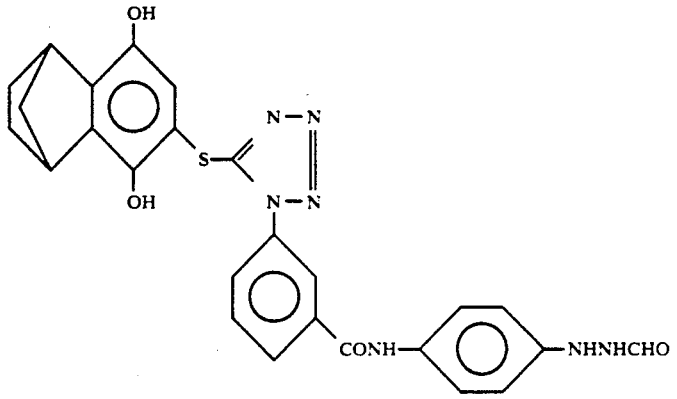
FR-5
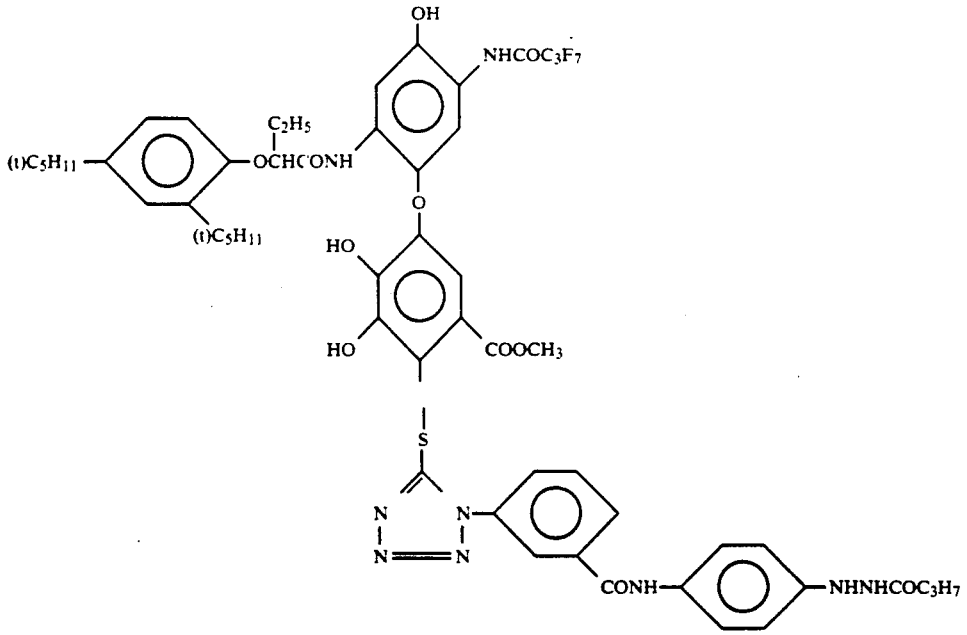
FR-6
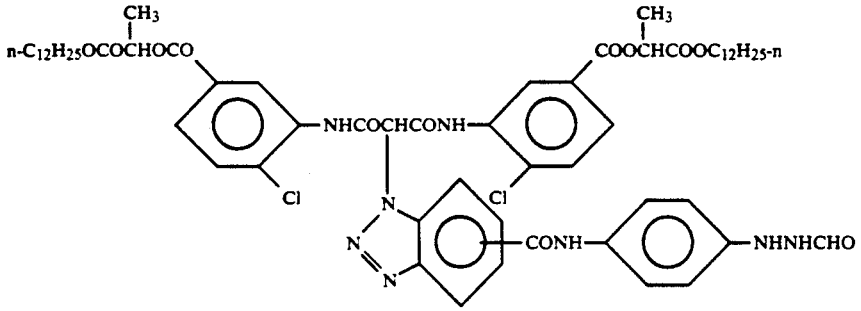

-continued
FR-7
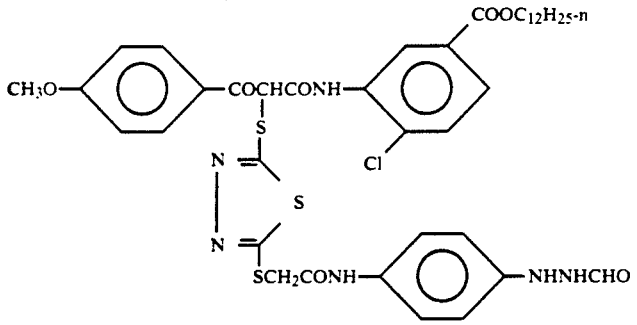
FR-8
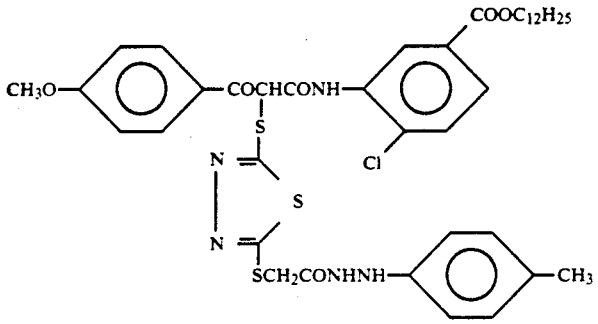
FR-9
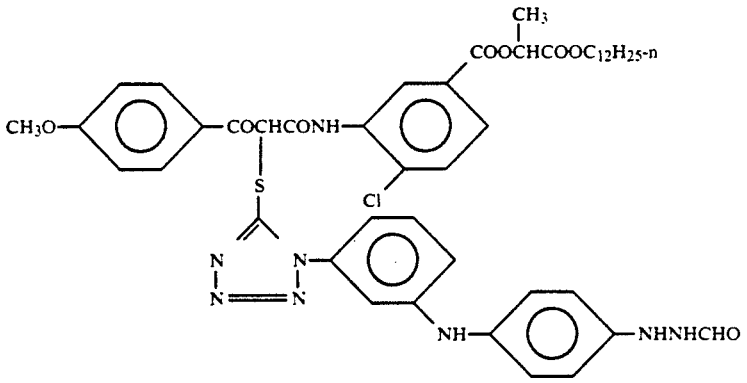
FR-10
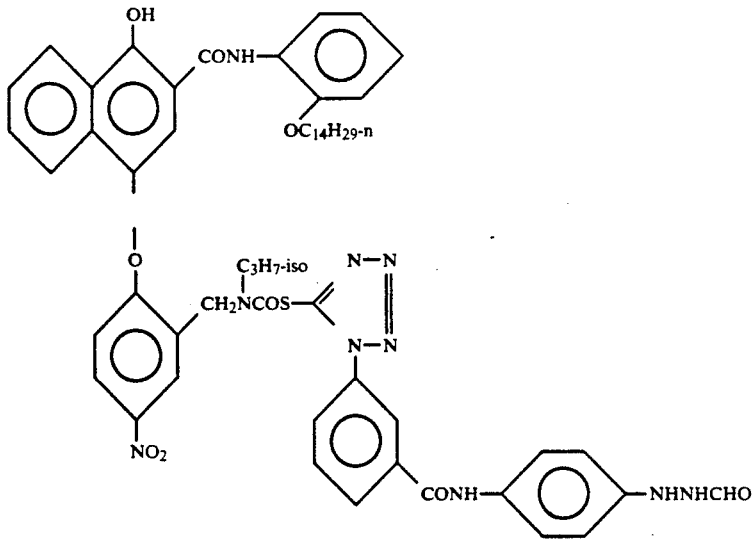

-continued
FR-11
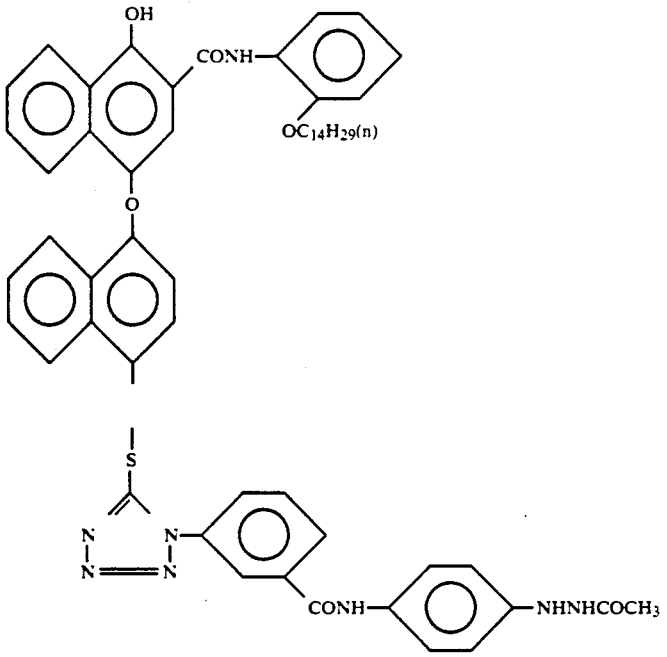
FR-12
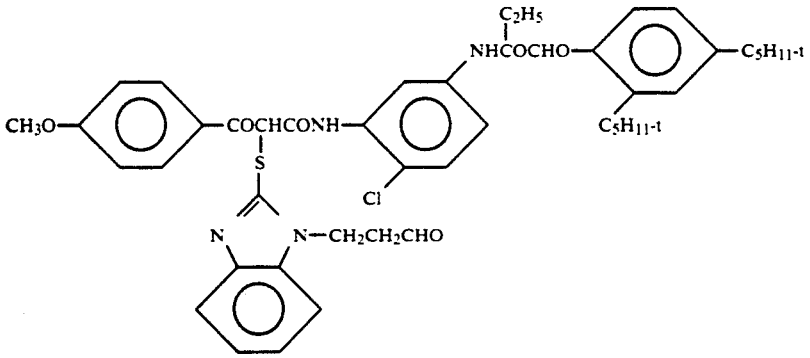
FR-13
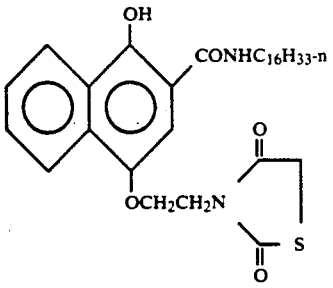
FR-14
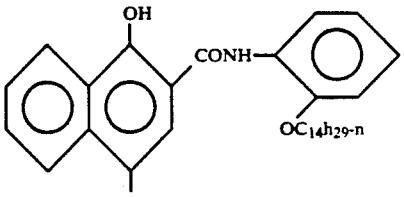

-continued
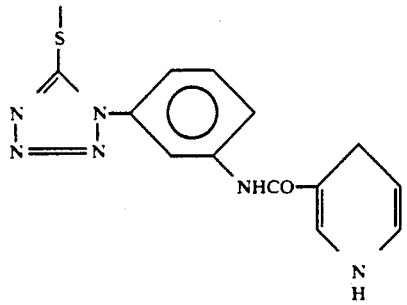
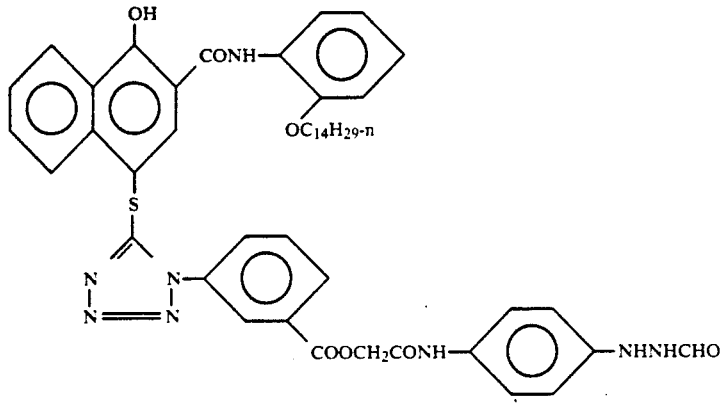
FR-15
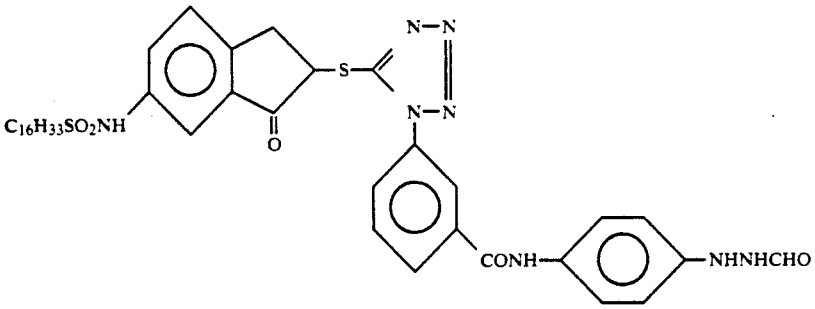
FR-16
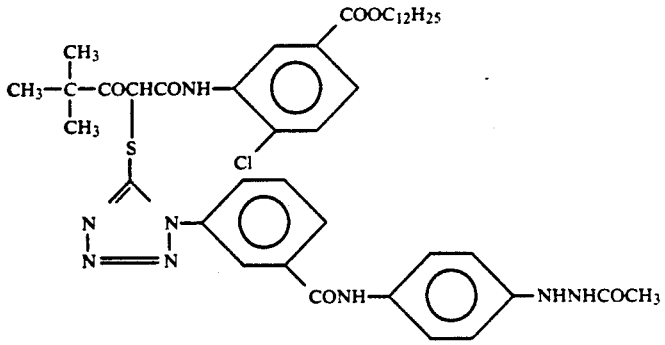
FR-17

-continued
FR-18
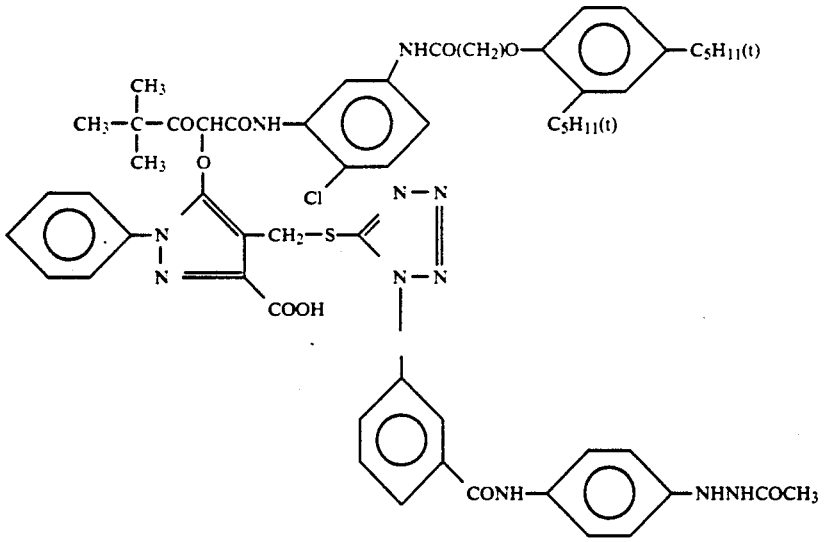
FR-19
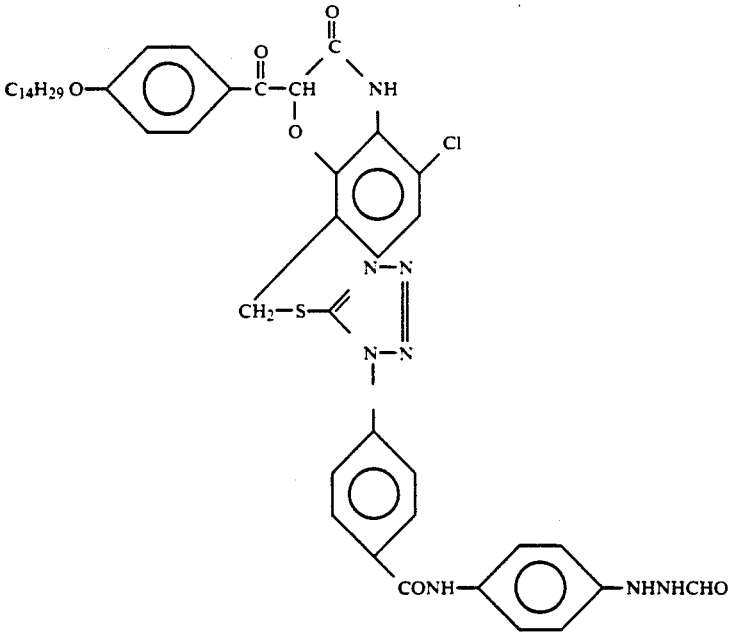
FR-20
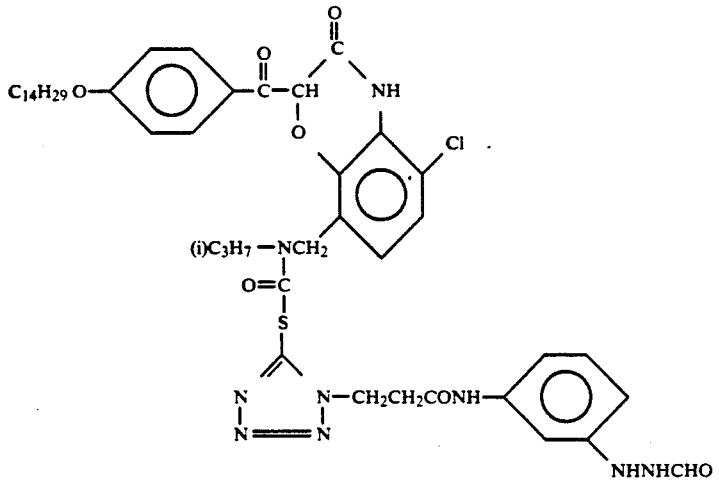

-continued

FR-21

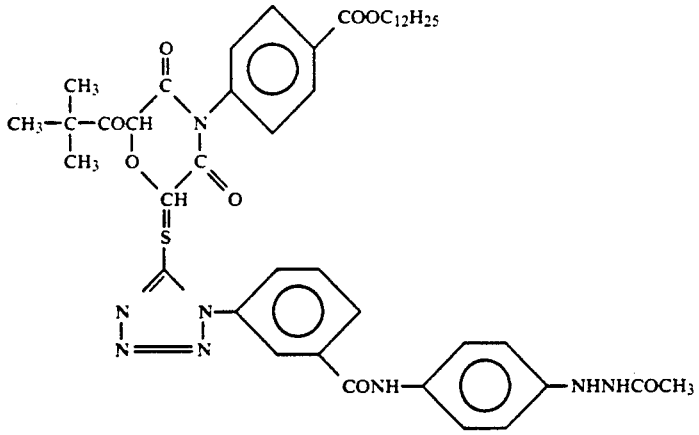

FR-22

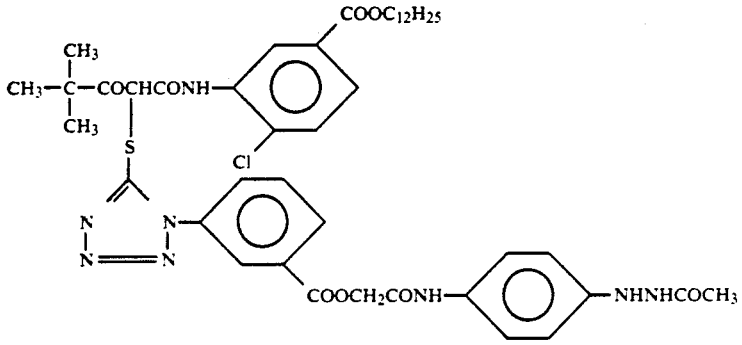

FR-23

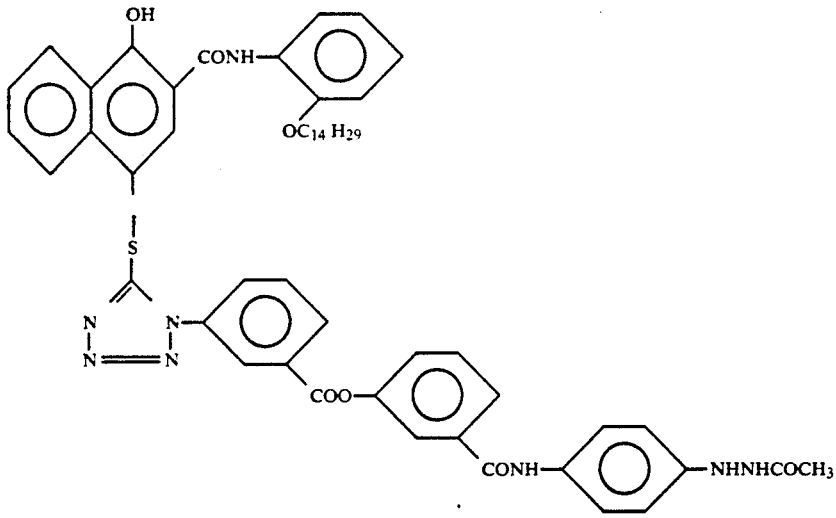

In order to satisfy the properties required for the light-sensitive material, these couplers may be used in combination in the same layer or may be used singly in two or more different layers.

The incorporation of such a coupler in the silver halide emulsion layer may be accomplished by any suitable known method as described in U.S. Pat. No. 2,322,027. For example, the coupler may be dispersed in a hydrophilic colloid in the form of a solution in a high boiling organic solvent such as phthalic alkyl ester (e.g., dibutyl phthalate, dioctyl phthalate), phosphoric ester (e.g., diphenyl phosphate, triphenyl phosphate, tricresyl phosphate, dioctyl butyl phosphate), citric ester (e.g., tributyl acetylcitrate), benzoic ester (e.g., benzoic octyl), alkyl amide (e.g., diethyl laurylamide), aliphatic ester (e.g., dibutoxyethyl succinate, diethyl azerate), and trimethinic ester (e.g., tributyl trimethinate) or a low boiling organic solvent having a boiling point of about 30° to 150° C. such as lower alkyl acetate (e.g., ethyl acetate, butyl acetate), propionic ethyl, secondary butyl alcohol, methyl isobutyl ketone, β-ethoxy ethyl acetate, and methyl cellosolve acetate. Such a high boiling organic solvent and such a low boiling organic solvent may be used in admixture.

Alternatively, a dispersion process using a polymerized material as described in JP-B-51-39853 and JP-A-51-59943 may be used in the present invention.

If the coupler to be used contains an acid group such as carboxylic acid or sulfonic acid, it may be incorporated in the hydrophilic colloid in the form of an alkaline aqueous solution.

The photographic color coupler to be used in the present invention may be advantageously selected so as to provide a dye having an intermediate scale. It is desired that the maximum absorption band of a cyan dye produced by a cyan coupler be in the range of between about 600 nm and about 720 nm, the maximum absorption band of a magenta dye produced by a magenta coupler be in the range of between about 500 nm and about 580 nm and the maximum absorption band of a yellow dye produced by a yellow coupler be in the range of between about 400 nm and about 480 nm.

The present light-sensitive material may comprise some dyes in the hydrophilic colloid layer as filter dyes or for the purpose of inhibiting irradiation or other various purposes. Examples of such dyes include oxonol dye, hemioxonol dye, styryl dye, merocyanine dye, cyanine dye and azo dye. Particularly useful among these dyes are oxonol dye, hemioxonol dye and merocyanine dye. Specific examples of such dyes which can be used in the present invention include those described in British Patents 584,609, and 1,177,429, JP-A-48-85130, 49-96620, 49-114420, and 52-108115, and U.S. Pat. Nos. 2,255,077, 2,274,782, 2,390,707, 2,493,747, 2,533,472, 2,843,486, 2,956,879, 3,148,187, 3,177,078, 3,247,127, 3,540,887, 3,575,704, 3,653,905, 3,718,472, 4,071,312, 4,070,352, and 4,420,555.

In the present light-sensitive material, if the hydrophilic colloid layer contains some dyes or ultraviolet absorbers, these dyes or ultraviolet absorbers may be mordanted with a cationic polymer or the like. Examples of such a cationic polymer include polymers as described in British Patent 685,475, U.S. Pat. Nos. 2,675,316, 2,839,401, 2,882,156, 3,048,487, 3,184,309, and 3,445,231, West German Patent (OLS) No. 1,914,362, and JP-A-50-47624, and 50-71332.

The color negative photographic light-sensitive material of the present invention normally comprise a yellow filter layer. The yellow filter layer preferably comprises colloidal silver or a yellow filter dye represented by the general formula (XII) as described in Japanese Patent Application No. 61-183945 having an excellent filter effect and a remarkably high sensitivity in the green-sensitive emulsion layer as compared to the case where colloidal silver is used may be preferably used.

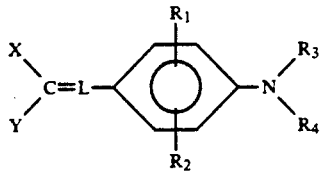

(XII)

wherein X and Y may be the same or different and each represents a cyano group, carboxy group, alkylcarbonyl group, arylcarbonyl group, alkoxycarbonyl group, aryloxycarbonyl group, carbamoyl group, sulfonyl group or sulfamoyl group, with the proviso that the combination of X and Y excludes [cyano group, substituted or unsubstituted alkylcarbonyl group] and [cyano group, sulfonyl group]; $R_1$ and $R_2$ may be the same or different and each represents a hydrogen atom, halogen atom, alkyl group, alkoxy group, hydroxy group, carboxy group, substituted amino group, carbamoyl group, sulfamoyl group or alkoxycarbonyl group; $R_3$ and $R_4$ may be the same or different and each represents a hydrogen atom, alkyl group or aryl group and $R_3$ and $R_4$ may together form a five- or six-membered ring, $R_1$ and $R_3$, and $R_2$ and $R_4$ may be connected to each other to form a five- or six-membered ring; and L represents a methine group.

Specific examples of eh yellow dye represented by the general formula (XIII) will be shown hereinafter.

YF-1

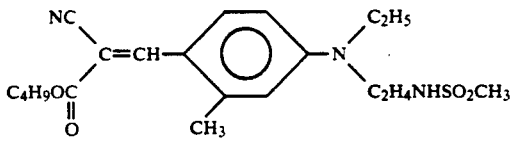

YF-2

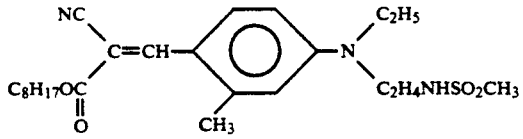

YF-3

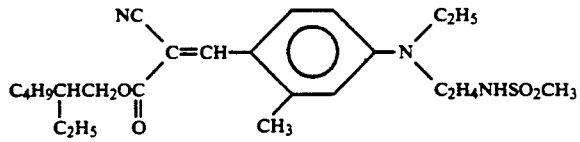

YF-4

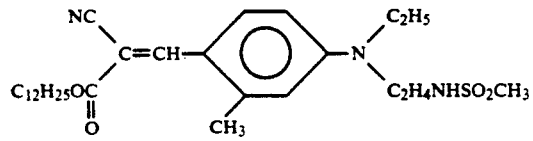

-continued

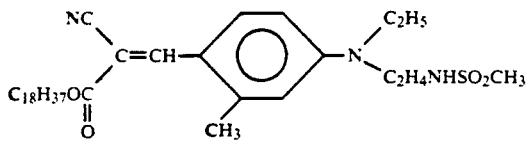

YF-5

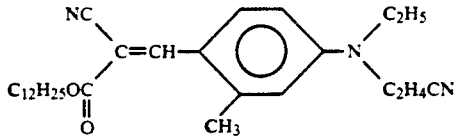

YF-6

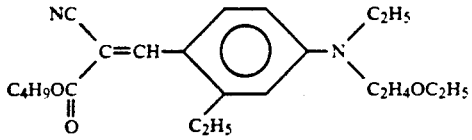

YF-7

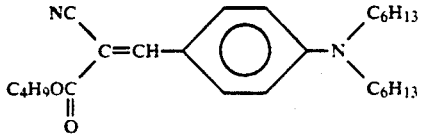

YF-8

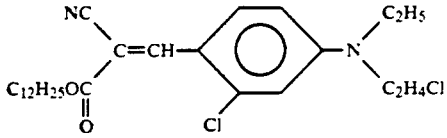

YF-9

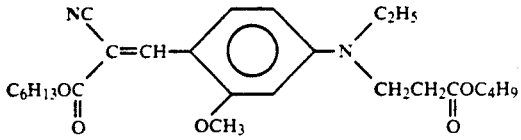

YF-10

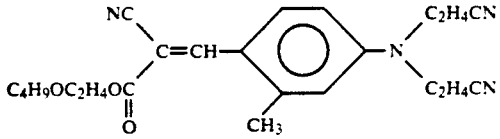

YF-11

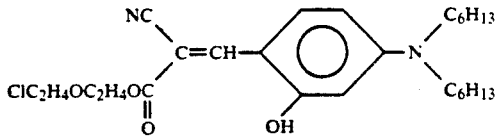

YF-12

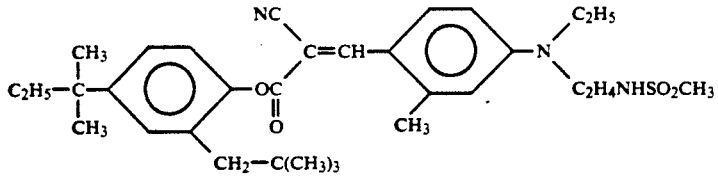

YF-13

These yellow dyes not only are means of minimizing the silver content to eliminate the need for yellow colloidal silver but also lead to a specific sensitizing effect. These yellow dyes have sharp light absorption characteristics in which the light effective for the green-sensitive and red-sensitive silver halide layers is not absorbed but is transmitted. Therefore, these yellow dyes are extremely advantageous in that they give the underlayer a higher sensitivity. Furthermore, physical phenomena which can easily occur due to the adjacent colloidal silver can be avoided by these yellow dyes. Therefore, these yellow dyes are advantageous in that a high sensitivity emulsion which has been throughly afterripened can be easily used in the blue-sensitive and green-sensitive layers.

Once the use of such of a yellow dye makes it easy to give the green-sensitive layer a higher sensitivity, it is possible to maintain the high sensitivity even if the silver content in the green-sensitive layer is lowered. If a two-equivalent coupler is incorporated in the green-sensitive layer, particularly both the high sensitivity layer and low sensitivity layer, the efficiency of dye formation can be improved, making it possible to minimize the silver content without deteriorating the graininess.

Furthermore, if the silver content in the green-sensitive layer is lowered, the efficiency of utilization of light by the red-sensitive layer which is one of the underlayers. Combined with the supersensitizing effect by the use of the compound of the general formula (II), this can maintain the high sensitivity despite the reduction in the silver content.

In the present invention, the thickness of the light-sensitive material between the light-sensitive layer nearest to the support and the surface thereof (film thickness) is in the range of 22 μm or less, preferably 15 to 22 μm, particularly 16 to 21 μm.

When the silver content exceeds 9.0 g/m$^2$, and the film thickness is not greater than 22 μm, the distance between the silver halide particles becomes smaller, deteriorating the graininess.

Therefore, the silver content and the film thickness are preferably 9.0 g/m$^2$ or less and 22 μm or less, respectively.

If the silver content is lowered, light scattering is reduced, improving the image sharpness. Combined with the reduction in the film thickness, the image sharpness can be further improved.

However, if the film thickness is too small, there may occur some troubles such as deterioration in graininess shortly after the preparation of the light-sensitive material, fog caused by application of pressure on the light-sensitive material before or after the exposure, and change in the photographic properties such as sensitivity.

The present light-sensitive material may comprise various additives which are commonly used in a silver halide light-sensitive material. Examples of such materials are described in U.S. Pat. No. 4,599,301.

Typical examples of such additives include surface active agents as described in the 33rd column, line 12 to 38th column, line 45, water-insoluble or difficultysoluble polymers as described in the 33rd and 34th columns, ultraviolet absorbers as described in the 37th and 38th columns, color fog inhibitors as described in the 38th column and hydroquinones as described in the 38th column in U.S. Pat. No. 4,599,301.

The development of the present light-sensitive material may be accomplished by any suitable method as described in the 34th and 35th columns in U.S. Pat. No. 4,599,301. A stabilization process or rinsing process as described in JP-A-61-35,446 may be used to drastically save water to be used in the steps following the desilvering step.

The present invention will be further described in the following examples, but the present invention should not be construed as being limited thereto.

In the following Examples chloroauric acid is used as a gold sensitizer; and sulfur sensitization is conducted using sodium thiosulfate in an amount of from 1.5 to 5.0 mg per 100 g silver.

EXAMPLE A-1

A multilayer color light-sensitive material specimen A-101 was prepared by coating various layers of the undermentioned compositions on an undercoated cellulose triacetate film support.

Composition of light-sensitive layer

The coated amount of each component is represented in g/m$^2$. The coated amounts of silver halide and the gold sensitizer are represented in terms of amount of silver and gold, respectively. The coated amount of sensitizing dye is represented by molar amount per 1 mol of silver halide to be incorporated in the same layer.

| Specimen A-101 | |
|---|---|
| 1st layer: antihalation layer | |
| Black colloidal silver | 0.18 (silver) |
| Gelatin | 1.40 |
| 2nd layer: intermediate layer | |
| 2,5-Di-t-pentadecyl hydroquinone | 0.18 |
| EX-1 | 0.07 |
| EX-3 | 0.02 |
| EX-13 | 0.004 |
| U-1 | 0.08 |
| U-2 | 0.08 |
| HBS-1 | 0.10 |
| HBS-2 | 0.02 |
| Gelatin | 1.04 |
| 3rd layer: 1st red-sensitive emulsion layer | |
| Silver bromoiodide emulsion (0.6 μm) | 1.52 (in terms of silver) |
| | $24.3 \times 10^{-6}$ (in terms of gold) |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-2 | 0.350 |
| HBS-1 | 0.005 |
| EX-10 | 0.020 |
| Gelatin | 0.87 |
| 4th layer: 2nd red-sensitive emulsion layer | |
| Silver bromoiodide emulsion (0.8 μm) | 1.38 (in terms of silver) |
| | $19.3 \times 10^{-6}$ (in terms of gold) |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| EX-2 | 0.300 |
| EX-3 | 0.050 |
| EX-10 | 0.015 |
| HBS-2 | 0.050 |
| Gelatin | 1.19 |
| 5th layer: 3rd red-sensitive emulsion layer | |
| Silver bromoiodide emulsion (1.1 μm) | 2.08 (in terms of silver) |
| | $23.9 \times 10^{-6}$ (in terms of gold) |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| EX-5 | 0.050 |
| EX-3 | 0.055 |
| EX-4 | 0.150 |
| HBS-1 | 0.32 |
| Gelatin | 1.56 |
| 6th layer: intermediate layer | |
| Gelatin | 1.06 |
| 7th layer: 1st green-sensitive emulsion layer | |
| Silver bromoiodide emulsion (0.6 μm) | 0.64 (in terms of silver) |
| | $10.2 \times 10^{-6}$ |

-continued

| Specimen A-101 | |
|---|---|
| | (in terms of gold) |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| Gelatin | 0.64 |
| 8th layer: 2nd green-sensitive emulsion layer | |
| Silver bromoiodide emulsion (0.7 μm) | 1.12 |
| | (in terms of silver) |
| | $16.8 \times 10^{-6}$ |
| | (in terms of gold) |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| EX-12 | 0.018 |
| EX-8 | 0.010 |
| EX-1 | 0.008 |
| EX-7 | 0.012 |
| HBS-1 | 0.60 |
| Gelatin | 0.73 |
| 9th layer: 3rd green-sensitive emulsion layer | |
| Silver bromoiodide emulsion (1.0 μm) | 2.07 |
| | (in terms of silver) |
| | $24.8 \times 10^{-6}$ |
| | (in terms of gold) |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-6 | 0.065 |
| EX-12 | 0.030 |
| EX-1 | 0.025 |
| HBS-2 | 0.55 |
| Gelatin | 1.54 |
| 10th layer: yellow filter layer | |
| Yellow colloidal silver | 0.05 |
| | (in terms of silver) |
| A-1 | 0.08 |
| HBS-1 | 0.03 |
| Gelatin | 0.95 |
| 11th layer: 1st blue-sensitive emulsion layer | |
| Silver bromoiodide emulsion (0.6 μm) | 0.31 |
| | (in terms of silver) |
| | $5.0 \times 10^{-6}$ |
| | (in terms of gold) |
| Sensitizing dye VIII | $3.5 \times 10^{-4}$ |
| EX-9 | 0.85 |
| EX-8 | 0.12 |
| HBS-1 | 0.28 |
| Gelatin | 1.10 |
| 12th layer: 2nd blue-sensitive emulsion layer | |
| Silver bromoiodide emulsion (0.8 μm) | 0.39 |
| | (in terms of silver) |
| | $5.5 \times 10^{-6}$ |
| | (in terms of gold) |
| Sensitizing dye VIII | $2.1 \times 10^{-4}$ |
| EX-11 | 0.20 |
| EX-10 | 0.015 |
| HBS-1 | 0.03 |
| Gelatin | 0.78 |
| 13th layer: 3rd blue-sensitive emulsion layer | |
| Silver bromoiodide emulsion (1.3 μm) | 0.77 |
| | (in terms of silver) |
| | $7.7 \times 10^{-6}$ |
| | (in terms of gold) |
| Sensitizing dye VIII | $2.2 \times 10^{-4}$ |
| EX-11 | 0.20 |
| HBS-1 | 0.07 |
| Gelatin | 0.69 |
| 14th layer: 1st protective layer | |
| Silver bromoiodide emulsion (silver iodide content: 1 mol %; average particle diameter: 0.07 μm) | 0.10 (in terms of silver) |
| U-1 | 0.11 |
| U-2 | 0.17 |
| HBS-1 | 0.90 |
| Gelatin | 0.73 |
| 15th layer: 2nd protective layer | |
| Particulate polymethyl acrylate (diameter: about 1.5 μm) | 0.54 |
| S-1 | 0.05 |
| S-2 | 0.20 |
| Gelatin | 0.72 |

Besides the above described components, a gelatin hardener H-1 and a surface active agent were incorporated in each layer.

The properties of the silver bromoiodide emulsions used are shown in Table 1.

TABLE 1

| layer | A* | B* | C* | D* | E* | F* | G* | H |
|---|---|---|---|---|---|---|---|---|
| 3 | 0.6 | 21 | 6.0 | Internal high AgI type | 1/2 | Octa-hedron | — | $16 \times 10^{-6}$ |
| 4 | 0.8 | 38 | 8.0 | Internal high AgI type | 1/2 | Tabu-lar | 3.2 | $14 \times 10^{-6}$ |
| 5 | 1.1 | 35 | 10.2 | Internal high AgI type | 1/2 | Tabu-lar | 3.8 | $11.5 \times 10^{-6}$ |
| 7 | 0.6 | 21 | 6.0 | Internal high AgI type | 1/2 | Octa-hedron | — | $16 \times 10^{-6}$ |
| 8 | 0.7 | 40 | 9.0 | Internal high AgI type | 1/2 | Tabu-lar | 3.2 | $15 \times 10^{-6}$ |
| 9 | 1.0 | 36 | 12.0 | Internal high AgI type | 1/2 | Tabu-lar | 3.6 | $12 \times 10^{-6}$ |
| 11 | 0.6 | 21 | 6.0 | Internal high AgI type | 1/2 | Octa-hedron | — | $16 \times 10^{-6}$ |
| 12 | 0.8 | 40 | 10.0 | Internal high AgI type | 1/2 | Tabu-lar | 3.5 | $14 \times 10^{-6}$ |
| 13 | 1.3 | 35 | 14.0 | Internal high AgI type | 1/1 | Tabu-lar | 3.2 | $10 \times 10^{-6}$ |

*:
A: average particle diameter (as calculated in terms of diameter of sphere) (μm)
B: coefficient of fluctuation in diameter (as calculated in terms of diameter sphere) (%)
C: average silver iodide content (mol %)
D: structure
E: core/shell ratio
F: shape
G: Diameter/thickness ratio
H: Au/Ag ratio (by weight)

Specimen A-102

Specimen A-102 was prepared in the same manner as for preparation of Specimen A-101 except that the amount of gold to be incorporated was changed as shown in Table 2.

TABLE 2

| | A-101 | A-102 |
|---|---|---|
| Au/Ag ratio (by weight) | $12.1 \times 10^{-6}$ | $2.2 \times 10^{-6}$ |

The amount of gold to be incorporated was changed in the following manner. An ion exchange resin (Dowex 1×8) was added to the silver halide emulsion as used in Specimen A-101 which had been subjected to gold/sulfur sensitization and maintained at a temperature of 40° C in an amount of 4.5 g per 500 g thereof. The mixture was then stirred for 15 to 30 minutes to adjust the amount of gold to be incorporated. The emulsion was then filtered to remove the ion exchange resin from the silver halide emulsion. The pH value and the pAg value of the emulsion were then adjusted to their original values.

The determination of the amount of gold was effected by the atomic-absorption spectroscopy in accordance with the procedure described herein.

The determination of the amount of silver, too, was effected by the atomic-absorption spectroscopy.

The structure and name of the compounds used in Example 1 will be shown hereinafter.

U-1

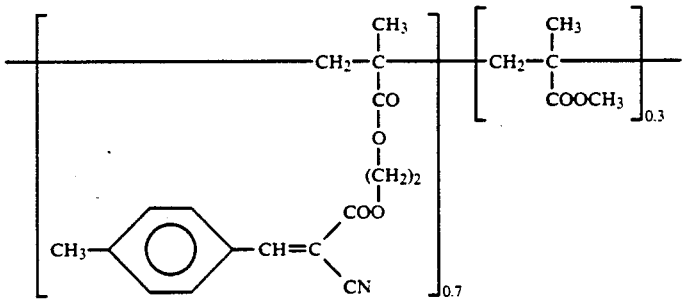

(MW: about 10,000)

U-2

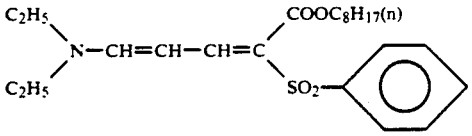

EX-1

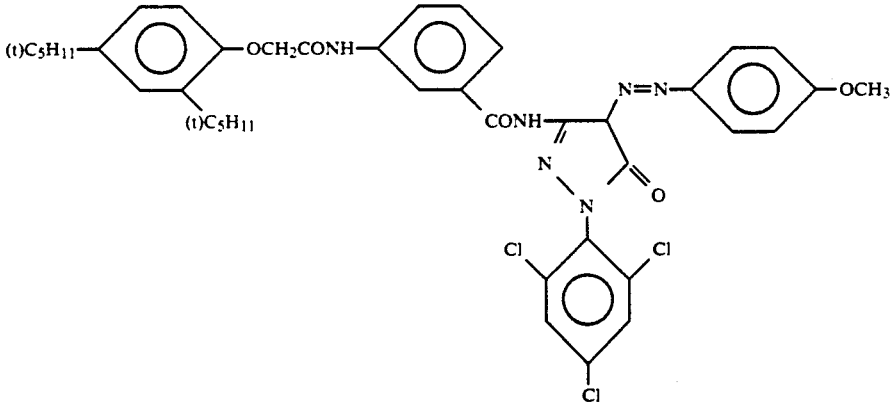

EX-2

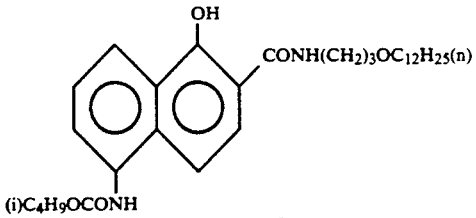

EX-3

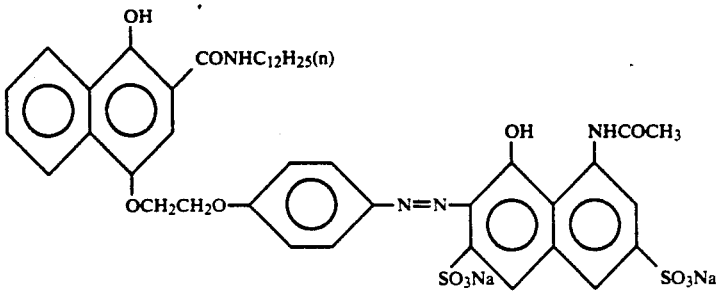

-continued
EX-4
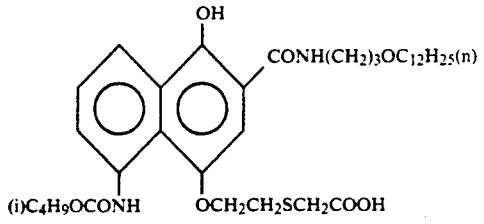
EX-5
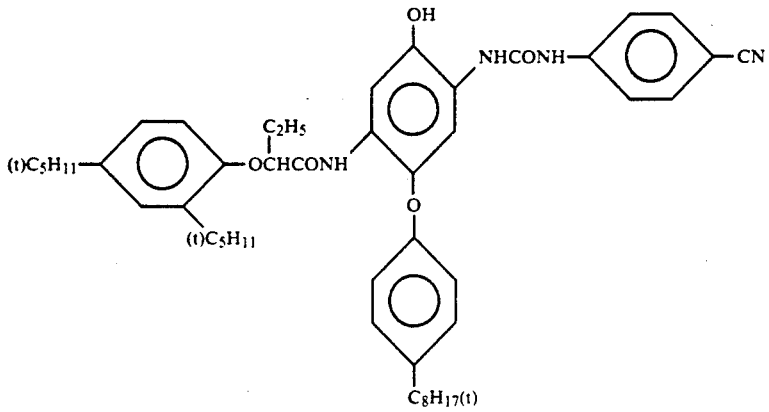
EX-6
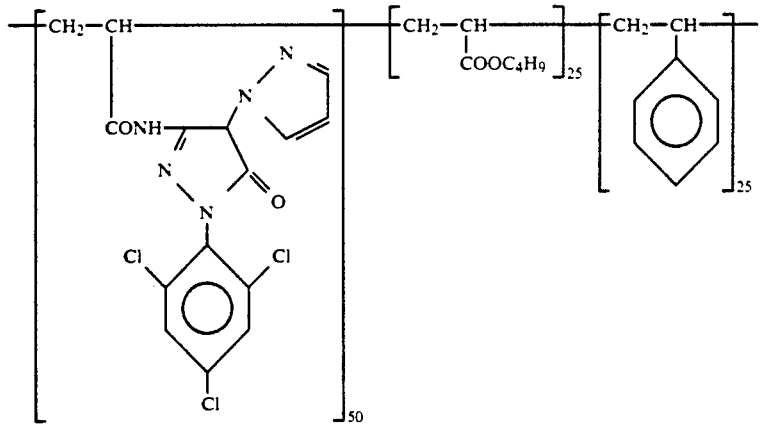
Average molecular weight: 30,000
EX-7
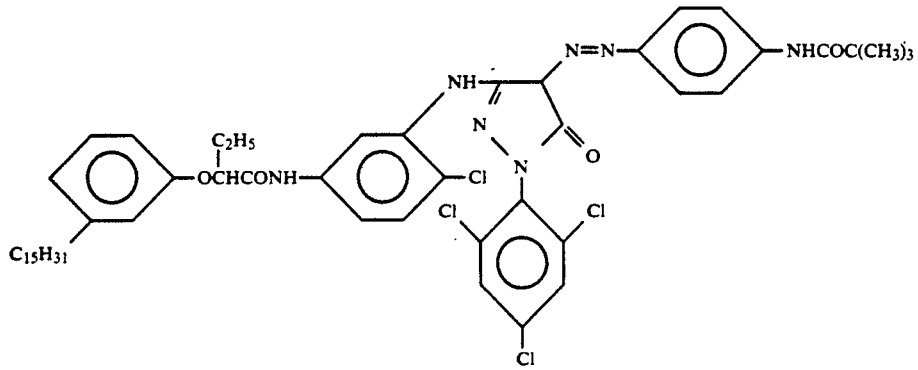

-continued
EX-8
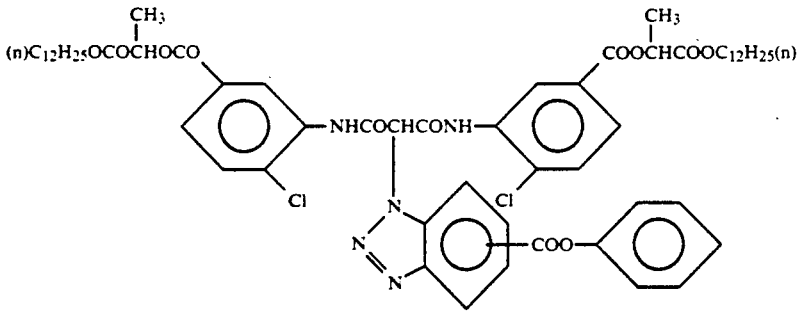
EX-9
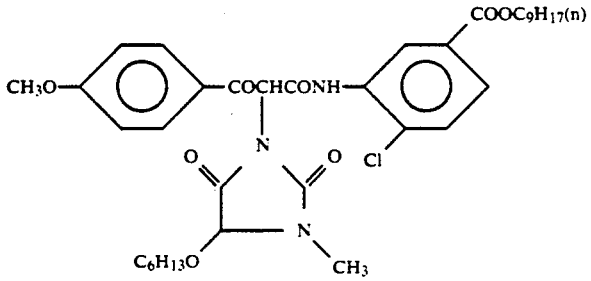
EX-10
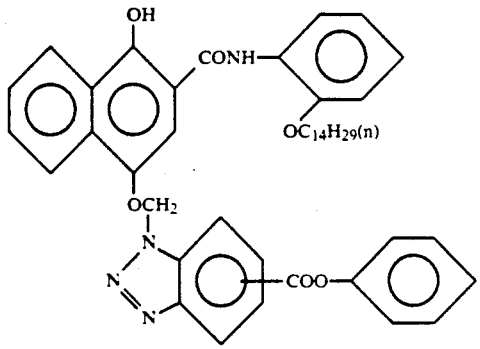
EX-11
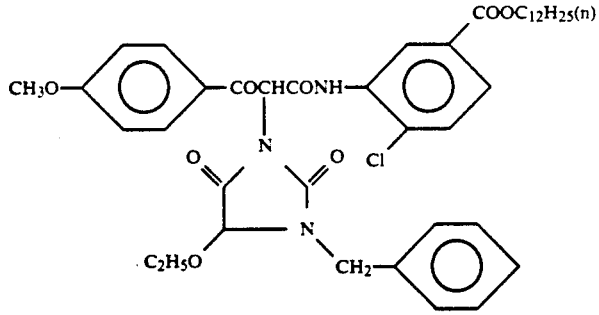
EX-12
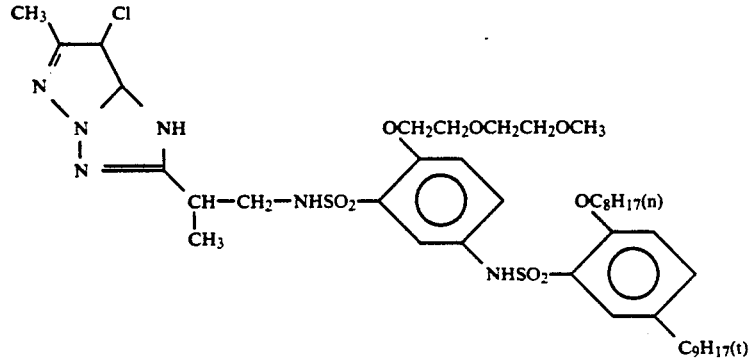

-continued
EX-13
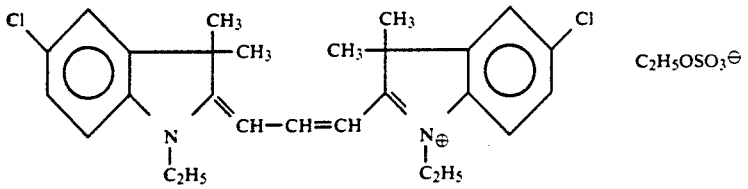
S-1
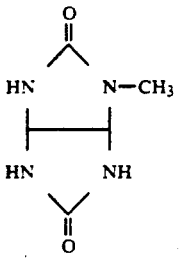
S-2
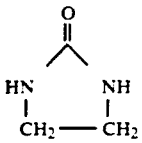
Tricresylphosphate HBS-1
Dibutylphthalate HBS-2
H-1
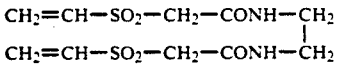
Sensitizing Dyes
I
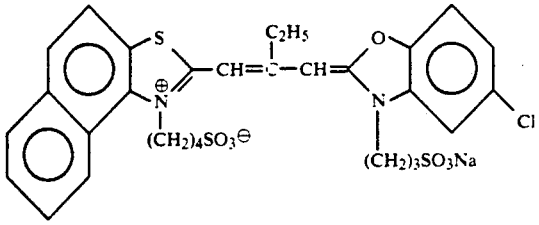
II
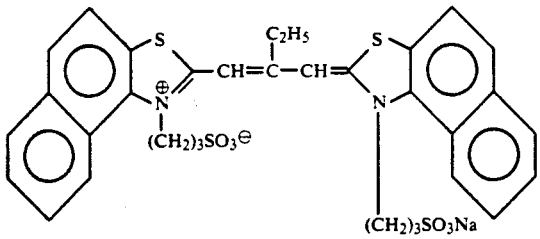
III
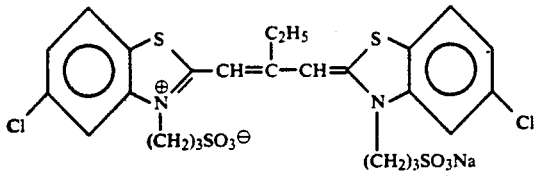
IV
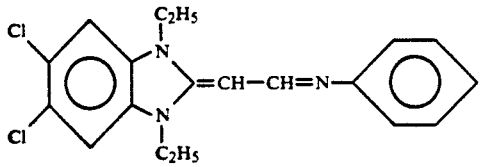

-continued

V

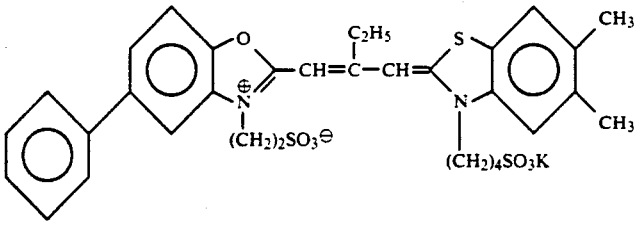

VI

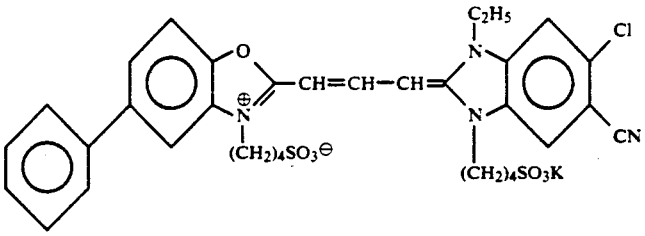

VII

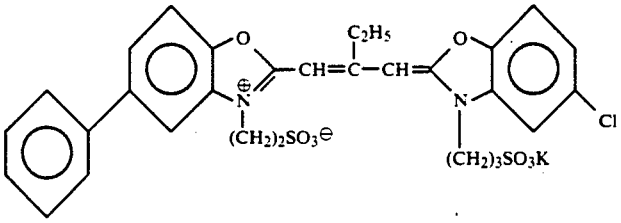

VIII

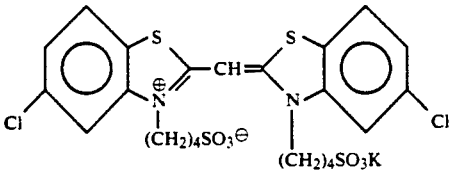

IX

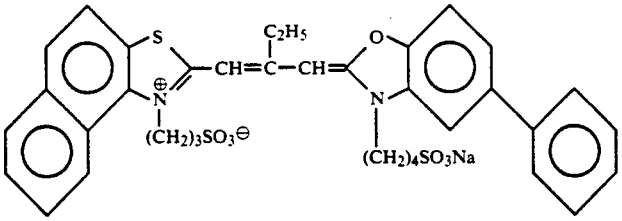

A-1

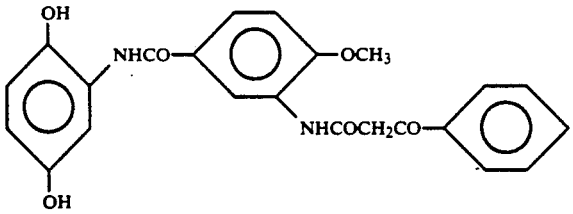

Specimens A-101 and A-102 were stored in an atmosphere of a temperature of 25° C. and a relative humidity of 60% for 3 days. Another group of Specimens A-101 and 102 was stored in an atmosphere of a temperature of 60° C. and a relative humidity of 30% for 3 days. These specimens were then subjected to exposure, development and measurement for photographic properties in accordance with the specific photographic sensitivity measurement method described in the Detailed Description of the Invention.

The results thus obtained are shown in Table 3.

TABLE 3

| | 25° C., 60%, 3 days | | | | | | 60° C., 30%, 3 days | | | | | |
|---|---|---|---|---|---|---|---|---|---|---|---|---|
| | Relative Sensitivity* | | | Fog | | | Relative Sensitivity* | | | Fog | | |
| Specimen | B | G | R | B | G | R | B | G | R | B | G | R |
| A-101 | 100 | 100 | 100 | 0.10 | 0.11 | 0.08 | 73 | 83 | 77 | 0.31 | 0.26 | 0.23 |
| A-102 | 95 | 94 | 96 | 0.09 | 0.10 | 0.07 | 90 | 89 | 92 | 0.12 | 0.12 | 0.10 |

(*The sensitivity value was calculated relative to the value of Specimen 101 stored at 25° C. and 60% RH for 3 days as 100 each for B, G and R. The specific sensitivity of Specimens 101 and 102 which had been stored at 25° C. and 60% RH for 3 days were 415 and 394, respectively.)

After being stored at room temperature at Fuji Photo Film Co., Ltd.'s Ashigara Laboratory in Minami Ashigara-shi, Kanagawa Prefecture for 1 year (about 20°-30° C., 60% RH), Specimens A-101 and A-102 were subjected to sensitometry.

The results thus obtained are shown in Table 4.

TABLE 4

| | Comparative (immediately after prepared) | | | | After stored for 1 year | | | |
|---|---|---|---|---|---|---|---|---|
| Specimen | Specific Sensitivity | Fog B | Fog G | Fog R | Specific Sensitivity | Fog B | Fog G | Fog R |
| A-101 (Comparison) | 423 | 0.10 | 0.11 | 0.08 | 363 | 0.14 | 0.16 | 0.13 |
| A-102 (Invention) | 401 | 0.09 | 0.10 | 0.07 | 385 | 0.12 | 0.13 | 0.10 |

The results shown in Table 3 and Table 4 show that the light-sensitive material of the present invention exhibits excellent preservability.

Specimens A-101 and A-102 were then subjected to hydrogen sensitization by being exposed to hydrogen gas at room temperature for 60 minutes.

The results thus obtained are shown in Table 5.

TABLE 5

| Specimen | Comparative (not hydrogen-sensitized) Specific photographic sensitivity | Hydrogen-sensitized Specific photographic sensitivity |
|---|---|---|
| A-101 (Comparison) | 423 | 564 |
| A-102 (Invention) | 402 | 568 |

The results show that the specimen having a decreased Au/Ag ratio exhibits a great increase in the sensitivity by a reduction sensitization with hydrogen gas.

EXAMPLE A-2

Specimens A-103 and A-104 were prepared in the same manner as in Specimens A-101 and A-102 except that the two-equivalent couplers EX-5 and EX-4 to be incorporated in the 5th layer (3rd red-sensitive layer) were replaced by EX-2 in the equimolecular amount.

Specimens A-101 to A-104 were stored in an atmosphere of a temperature of 25° C. and a relative humidity of 60% for 3 days. Another group of Specimens A-101 to A-104 was stored in an atmosphere of a temperature of 60° C. and a relative humidity of 30% for 3 days. These . specimens were then subjected to sensitometry in the same manner as in Example A-1.

The results are shown in Table 6.

TABLE 6

| | | 25° C., 60%, 3 days | | 60° C., 30%, 3 days | |
|---|---|---|---|---|---|
| Specimen | Coupler | Relative red-Sensitivity | Red fog | Relative red-Sensitivity | Red fog |
| A-101* | Two-equivalent | 100 | 0.08 | 77 | 0.23 |
| A-102** | Two-equivalent | 96 | 0.07 | 92 | 0.10 |
| A-103* | Four-equivalent | 74 | 0.06 | 68 | 0.09 |
| A-104** | Four-equivalent | 72 | 0.05 | 70 | 0.06 |

Notes:
*Comparative
**Invention

Table 6 shows that the specimens comprising a two-equivalent coupler exhibits a more remarkable effect of the present invention than that comprising a four-equivalent coupler.

EXAMPLE A-3

Specimens A-105 and A-106 were prepared in the same manner as in Specimens A-101 and A-102 except that the amount of silver to be incorporated in the 5th layer was changed from 2.08 g/m$^2$ to 1.46 g/m$^2$.

Specimens A-101, A-102, A-105 and A-106 were stored at room temperature in the same manner as in Example A-1 and then subjected to sensitometry.

The results thus obtained are shown in Table 7.

TABLE 7

| | | Comparative (immediately after prepared) | | Stored for 1 year | |
|---|---|---|---|---|---|
| Specimen | Coupler | Relative red-Sensitivity | Red fog | Relative red-Sensitivity | Red fog |
| A-101* | Two-equivalent | 100 | 0.08 | 83 | 0.13 |
| A-102** | Two-equivalent | 96 | 0.07 | 90 | 0.10 |
| A-105* | Two-equivalent | 97 | 0.08 | 90 | 0.11 |
| A-106** | Two-equivalent | 94 | 0.07 | 93 | 0.08 |

Notes:
*Comparative
**Invention

Table 7 shows that the reduction in Au/Ag ratio and the amount of silver to be incorporated gives a further remarkable effect of the present invention.

EXAMPLE B-1

Specimen B-101

Specimen B-101 was prepared in the same manner as for preparation of Specimen A-101 except that the amounts of silver and gold in layers were as shown in Table 8.

The properties of the silver bromoiodide emulsions were the same as shown in Table 1.

Specimens B-102, B-103, and B-104

Specimen B-102, B-103, and B-104 were prepared in the same manner as for preparation of Specimen B-101 except that the amounts of gold and silver to be incorporated was changed. The amount of gold was changed in the same manner as for preparation of Specimen A-102 except that the mixture of the emulsion and the ion exchange resin was stirred for 5 to 20 minutes.

TABLE 8

| Layer | B-101 A | B-101 B | B-102 A | B-102 B | B-103 A | B-103 B | B-104 A | B-104 B |
|---|---|---|---|---|---|---|---|---|
| 3 | 0.50 | $16 \times 10^{-6}$ | 0.50 | $5.6 \times 10^{-6}$ | 1.52 | $16 \times 10^{-6}$ | 1.52 | $5.6 \times 10^{-6}$ |
| 4 | 0.97 | $14 \times 10^{-6}$ | 0.97 | $4.2 \times 10^{-6}$ | 1.38 | $14 \times 10^{-6}$ | 1.38 | $4.2 \times 10^{-6}$ |
| 5 | 1.46 | $11.5 \times 10^{-6}$ | 1.46 | $3.1 \times 10^{-6}$ | 2.08 | $11.5 \times 10^{-6}$ | 2.08 | $3.1 \times 10^{-6}$ |
| 7 | 0.31 | $16 \times 10^{-6}$ | 0.31 | $5.6 \times 10^{-6}$ | 0.64 | $16 \times 10^{-6}$ | 0.64 | $5.6 \times 10^{-6}$ |
| 8 | 0.72 | $15 \times 10^{-6}$ | 0.72 | $4.5 \times 10^{-6}$ | 1.12 | $15 \times 10^{-6}$ | 1.12 | $4.5 \times 10^{-6}$ |
| 9 | 1.66 | $12 \times 10^{-6}$ | 1.66 | $3.2 \times 10^{-6}$ | 2.07 | $12 \times 10^{-6}$ | 2.07 | $3.2 \times 10^{-6}$ |
| 11 | 0.22 | $16 \times 10^{-6}$ | 0.22 | $5.6 \times 10^{-6}$ | 0.31 | $16 \times 10^{-6}$ | 0.31 | $5.6 \times 10^{-6}$ |
| 12 | 0.45 | $14 \times 10^{-6}$ | 0.45 | $4.2 \times 10^{-6}$ | 0.39 | $14 \times 10^{-6}$ | 0.39 | $4.2 \times 10^{-6}$ |
| 13 | 0.77 | $10 \times 10^{-6}$ | 0.77 | $2.7 \times 10^{-6}$ | 0.77 | $10 \times 10^{-6}$ | 0.77 | $2.7 \times 10^{-6}$ |
| 14 | 0.10 | — | 0.10 | — | 0.10 | — | 0.10 | — |

TABLE 9

| | B-101 | B-102 | B-103 | B-104 |
|---|---|---|---|---|
| C | 7.4 | 7.4 | 10.6 | 10.6 |
| D | $12.4 \times 10^{-6}$ | $3.63 \times 10^{-6}$ | $13.0 \times 10^{-6}$ | $3.9 \times 10^{-6}$ |

A: The amount of silver halide emulsion represented in terms of the amount of silver ($g/m^2$)
B: Au/Ag ratio (by weight)
C: Total amount of Ag ($g/m^2$)
D: Total amount of Au/total amount of Ag (by weight)

Specimens were stored in the same manner as in Example A-1 and the results thus obtained are shown in Table 10.

TABLE 10

| Specimen | 25° C., 60%, 3 Days Sensitivity* | Fog B | Fog G | Fog R | 60° C., 30%, 3 Days Sensitivity* | Fog B | Fog G | Fog R |
|---|---|---|---|---|---|---|---|---|
| B-101 (Comparison) | 415 | 0.10 | 0.09 | 0.07 | 349 | 0.29 | 0.22 | 0.19 |
| B-102 (Invention) | 424 | 0.09 | 0.09 | 0.08 | 388 | 0.15 | 0.13 | 0.12 |
| B-103 (Comparison) | 420 | 0.10 | 0.11 | 0.08 | 303 | 0.31 | 0.26 | 0.23 |
| B-104 (Comparison) | 430 | 0.09 | 0.10 | 0.08 | 368 | 0.20 | 0.18 | 0.17 |

*Specific photographic sensitivity

After being stored at 25° C., under a relative humidity (RH) of 60% for 1 year at Osaka, Japan, specimens were subjected to sensitometry.

The results thus obtained are shown in Table 11.

TABLE 11

| Specimen | Comparative (immediately after preparation) Sensitivity | Fog B | Fog G | Fog R | After stored for 1 year Sensitivity | Fog B | Fog G | Fog R |
|---|---|---|---|---|---|---|---|---|
| B-101 (Comparison) | 415 | 0.10 | 0.09 | 0.07 | 384 | 0.14 | 0.15 | 0.14 |
| B-102 (Invention) | 424 | 0.09 | 0.09 | 0.08 | 410 | 0.11 | 0.12 | 0.12 |
| B-103 (Comparison) | 420 | 0.10 | 0.11 | 0.08 | 369 | 0.18 | 0.20 | 0.18 |
| B-104 (Comparison) | 430 | 0.09 | 0.10 | 0.08 | 378 | 0.16 | 0.17 | 0.14 |

The results shown in Tables 10 and 11 show that the light-sensitive material of the present invention exhibits excellent preservability.

EXAMPLE B-2

Specimen B-105 was prepared in the same manner as in Specimen B-102 except that the two-equivalent couplers EX-5 and EX-4 to be incorporated in the 5th layer (3rd red-sensitive layer) were replaced by EX-2 in the equimolar amount. Specimen B-106 was prepared in the same manner as in Specimen B-105 except that the size of particles incorporated in the silver bromoiodide emulsion of the fifth layer was changed from 1.1 pm to 1.5 pm and the silver content in the silver bromoiodide emulsion was changed from 1.46 $g/m^2$ to 1.9 $g/m^2$. These specimens were subjected to sensitometry in the same manner as in Example B-1. On the other hand, another group of these specimens was subjected to preservability test as in Example B-1. The results are shown in Table 12.

TABLE 12

| Specimen | Comparative (immediately after prepared) Relative red sensitivity | Red Fog | After stored for 1 year Relative red sensitivity | Red Fog |
|---|---|---|---|---|
| B-102 (Invention) | 100 | 0.08 | 95 | 0.12 |
| B-105 (Invention) | 75 | 0.06 | 73 | 0.08 |
| B-106 (Invention) | 98 | 0.08 | 83 | 0.15 |

Table 12 shows that if a two-equivalent coupler is used instead of a four-equivalent coupler, the sensitivity of the light-sensitive material is lowered, and it is necessary to increase the silver content by using particulate silver halide with a larger particle size. This results in an increase in the generation of fog and a reduction in the sensitivity due to natural radiation. Accordingly, it is found that a two-equivalent coupler is preferably used in the present invention.

EXAMPLE C-1

Specimen C-101

Specimen C-101 was prepared in the same manner as for preparation of Specimen A-101 except that the amounts of silver and gold in layers were as shown in Table 13.

The properties of the silver bromoiodide emulsions were the same as shown in Table 1.

Specimens C-102, C-103, and C-104

Specimen C-102, C-103, and C-104 were prepared in the same manner as for preparation of Specimen C-101 except that the amount of gold and silver to be incorporated was changed. The amount of gold was changed in the same manner s for preparation of Specimen A-102 except that the mixture of the emulsion and the ion exchange resin was stirred for 5 to 20 minutes.

TABLE 13

| | C-101 (Comparative) | | C-102 (Invention) | | C-103 (Comparative) | | C-104 (Invention) | |
|---|---|---|---|---|---|---|---|---|
| Layer | A | B | A | B | A | B | A | B |
| 3 | 0.50 | $16 \times 10^{-6}$ | 0.50 | $8.2 \times 10^{-6}$ | 0.76 | $16 \times 10^{-6}$ | 0.76 | $8.0 \times 10^{-6}$ |
| 4 | 0.97 | $14 \times 10^{-6}$ | 0.97 | $6.7 \times 10^{-6}$ | 0.69 | $14 \times 10^{-6}$ | 0.69 | $6.6 \times 10^{-6}$ |
| 5 | 1.46 | $11.5 \times 10^{-6}$ | 1.46 | $5.0 \times 10^{-6}$ | 1.04 | $11.5 \times 10^{-6}$ | 1.04 | $4.8 \times 10^{-6}$ |
| 7 | 0.31 | $16 \times 10^{-6}$ | 0.31 | $8.2 \times 10^{-6}$ | 0.32 | $16 \times 10^{-6}$ | 0.32 | $8.0 \times 10^{-6}$ |
| 8 | 0.72 | $15 \times 10^{-6}$ | 0.72 | $7.2 \times 10^{-6}$ | 0.56 | $15 \times 10^{-6}$ | 0.56 | $7.0 \times 10^{-6}$ |
| 9 | 1.66 | $12 \times 10^{-6}$ | 1.66 | $5.1 \times 10^{-6}$ | 1.03 | $12 \times 10^{-6}$ | 1.03 | $5.0 \times 10^{-6}$ |
| 11 | 0.22 | $16 \times 10^{-6}$ | 0.22 | $8.2 \times 10^{-6}$ | 0.16 | $16 \times 10^{-6}$ | 0.16 | $8.0 \times 10^{-6}$ |
| 12 | 0.45 | $14 \times 10^{-6}$ | 0.45 | $6.7 \times 10^{-6}$ | 0.20 | $14 \times 10^{-6}$ | 0.20 | $6.6 \times 10^{-6}$ |
| 13 | 0.77 | $10 \times 10^{-6}$ | 0.77 | $4.3 \times 10^{-6}$ | 0.39 | $10 \times 10^{-6}$ | 0.39 | $4.2 \times 10^{-6}$ |
| C | 7.4 | | 7.4 | | 5.3 | | 5.3 | |
| D | $12.4 \times 10^{-6}$ | | $5.8 \times 10^{-6}$ | | $13 \times 10^{-6}$ | | $5.9 \times 10^{-6}$ | |

Notes:
A: The amount of silver halide emulsion represented in terms of the amount of silver ($g/m^2$)
B: Au/Ag ratio (by weight)
C: Total amount of Ag ($g/m^2$)
D: Total amount of Au/total amount of Ag (by weight)

Specimens were stored in the same manner as in Example A-1 and the results thus obtained are shown in Table 14.

TABLE 14

| | 25° C., 60%, 3 Days | | | | 60° C., 30%, 3 Days | | | |
|---|---|---|---|---|---|---|---|---|
| Specimen | Relative Sensitivity* | Fog B | Fog G | Fog R | Relative Sensitivity* | Fog B | Fog G | Fog R |
| C-101 (Comparative) | 100 | 0.10 | 0.09 | 0.07 | 84 | 0.29 | 0.22 | 0.19 |
| C-102 (Invention) | 102 | 0.09 | 0.09 | 0.08 | 89 | 0.18 | 0.15 | 0.14 |
| C-103 (Comparison) | 99 | 0.10 | 0.07 | 0.06 | 85 | 0.27 | 0.19 | 0.16 |
| C-104 (Invention) | 101 | 0.09 | 0.09 | 0.08 | 93 | 0.15 | 0.13 | 0.12 |

*The sensitivity value was calculated relative to the value of Specimen C-101 stored at 25° C. and 60% RH for 3 days as 100. The specific photographic sensitivity of Specimen C-101 thus stored was 415.

From the results shown in Table 14 it is evident that the light-sensitive material of the present invention exhibits less formation of fog, less reduction of sensitivity and excellent preservability.

EXAMPLE C-2

Specimens C-105 and C-106 were prepared in the same manner as in Specimens C-101 and C-104 except that the two-equivalent couplers EX-6 and EX-12 to be incorporated in the 9th layer (3rd green-sensitive material) were replaced by the four-equivalent coupler EX-14 in the equimolar amount, respectively.

Specimens C-101, C-104, C-105 and C-106 were stored at a temperature of 25° C. and a relative humidity of 60% for 3 days. Another group of Specimens C-101, C-104, C-105 and C-106 was stored at a temperature of 60° C. and a relative humidity of 30% for 3 days. These specimens were then subjected to exposure, development and measurement for photographic properties in the same manner as in Example A-1. The results are shown in Table 15.

TABLE 15

| | | 25° C., 60%, 3 Days | | 60° C., 30%, 3 Days | |
|---|---|---|---|---|---|
| Speci- | | Relative red-Sensi- | Green | Relative red-Sensi- | Green |
| men | Coupler | tivity | fog | tivity | fog |
| C-101* | Two-equivalent | 100 | 0.09 | 85 | 0.22 |
| C-104** | Two-equivalent | 101 | 0.09 | 96 | 0.13 |
| C-105* | Four-equivalent | 79 | 0.06 | 73 | 0.09 |
| C-106** | Four-equivalent | 77 | 0.06 | 75 | 0.08 |

Notes:
*Comparative
**Invention

Table 15 shows that the present specimen comprising the two-equivalent coupler exhibits a further remarkable effect of the present invention.

The structural formula of Compound EX-14 used in Example C-2 will be shown below.

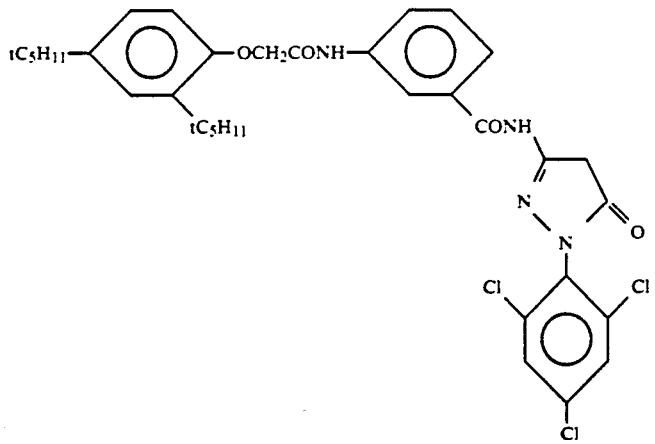

EXAMPLE C-3

A multilayer color light-sensitive material specimen C-107 was prepared by coating various layers of the undermentioned composition on an undercoated cellulose triacetate film support.

Composition of light-sensitive layer

The coated amount of each component is represented in g/m$^2$. The coated amount of silver halide is represented in terms of amount of silver. The coated amount of sensitizing dye is represented by molar amount per 1 mol of silver halide to be incorporated in the same layer.

| Specimen C-107 | |
|---|---|
| 1st layer: antihalation layer | |
| Black colloidal silver | 0.18 (silver) |
| Gelatin | 1.40 |
| 2nd layer: intermediate layer | |
| 2,5-Di-5-pentadecyl hydroquinone | 0.18 |
| EX-1 | 0.07 |
| EX-3 | 0.02 |
| EX-13 | 0.004 |
| U-1 | 0.08 |
| U-2 | 0.08 |
| HBS-1 | 0.10 |
| HBS-2 | 0.02 |
| Gelatin | 1.04 |
| 3rd layer: 1st red-sensitive emulsion layer | |
| Silver bromoiodide emulsion | 0.50 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-15 | 0.350 |
| HBS-1 | 0.005 |
| EX-10 | 0.020 |
| Gelatin | 0.87 |
| 4th layer: 2nd red-sensitive emulsion layer | |
| Silver bromoiodide emulsion | 0.97 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| EX-15 | 0.300 |
| EX-3 | 0.050 |
| EX-10 | 0.015 |
| HBS-2 | 0.050 |
| Gelatin | 1.19 |
| 5th layer: 3rd red-sensitive emulsion layer | |
| Silver bromoiodide emulsion | 1.46 |
| Sensitizing dye IX | $5.4 \times 10^{-5}$ |
| Sensitizing dye II | $1.4 \times 10^{-5}$ |

-continued

| Specimen C-107 | |
|---|---|
| Sensitizing dye III | $2.4 \times 10^{-4}$ |
| Sensitizing dye IV | $3.1 \times 10^{-5}$ |
| EX-15 | 0.020 |
| EX-3 | 0.055 |
| EX-16 | 0.180 |
| HBS-1 | 0.32 |
| Gelatin | 1.56 |
| 6th layer: intermediate layer | |
| Gelatin | 1.06 |
| 7th layer: 1st green-sensitive emulsion layer | |
| Silver bromoiodide emulsion | 1.00 |
| Sensitizing dye V | $5.1 \times 10^{-5}$ |
| Sensitizing dye VI | $1.7 \times 10^{-4}$ |
| Sensitizing dye VII | $6.4 \times 10^{-4}$ |
| EX-17 | 0.278 |
| EX-1 | 0.031 |
| EX-7 | 0.042 |
| EX-8 | 0.035 |
| HBS-1 | 0.16 |
| Gelatin | 0.64 |
| 8th layer: intermediate layer | |
| Gelatin | 0.73 |
| 9th layer: 2nd green-sensitive emulsion layer | |
| Silver bromoiodide emulsion | 1.66 |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-17 | 0.095 |
| EX-1 | 0.025 |
| HBS-2 | 0.55 |
| Gelatin | 1.54 |
| 10th layer: yellow filter layer | |
| Yellow colloidal silver | 0.05 |
| A-1 | 0.08 |
| HBS-1 | 0.03 |
| Gelatin | 0.95 |
| 11th layer: 1st blue-sensitive emulsion layer | |
| Silver bromoiodide emulsion | 0.67 |
| Sensitizing dye VIII | $5.6 \times 10^{-4}$ |
| EX-18 | 0.85 |
| EX-19 | 0.20 |
| EX-8 | 0.14 |
| EX-10 | 0.015 |
| HBS-1 | 0.31 |
| Gelatin | 1.88 |
| 12th layer: 2nd blue-sensitive emulsion layer | |
| Silver bromoiodide emulsion | 0.77 |
| Sensitizing dye VIII | $2.2 \times 10^{-4}$ |
| EX-18 | 0.20 |
| HBS-1 | 0.07 |
| Gelatin | 0.69 |
| 13th layer: 1st protective layer | |
| Silver bromoiodide emulsion (silver iodide content: 1 mol; average particle diameter: | 0.10 |

-continued

| Specimen C-107 | |
|---|---|
| 0.07 μm) | |
| U-1 | 0.11 |
| U-2 | 0.17 |
| HBS-1 | 0.90 |
| Gelatin | 0.73 |
| 14th layer: 2nd protective layer | |
| Particle polymethyl acrylate (diameter: about 1.5 μm) | 0.54 |
| S-1 | 0.05 |
| S-2 | 0.20 |
| Gelatin | 0.72 |

Besides the above components, a gelatin hardener H-1 or a surface active agent was incorporated in each layer.

The characteristics of the silver bromoiodide used are shown in Table 16.

TABLE 16

| Layer | A* | B* | C* | D* | E* | F* | G* |
|---|---|---|---|---|---|---|---|
| 3 | 0.6 | 21 | 6.0 | Internal high AgI type | ½ | Octahedron | — |
| 4 | 0.8 | 38 | 8.0 | Internal high AgI type | ½ | Tabular | 3.2 |
| 5 | 1.1 | 35 | 10.2 | Internal high AgI type | ½ | " | 3.8 |
| 7 | 0.7 | 21 | 6.0 | Internal high AgI type | ½ | Octahedron | — |
| 9 | 1.0 | 36 | 12.0 | Internal high AgI type | ½ | Tabular | 3.6 |
| 11 | 0.7 | 21 | 6.0 | Internal high AgI type | ½ | Octahedron | — |
| 12 | 1.3 | 35 | 14.0 | Internal high AgI type | 1/1 | Tabular | 3.2 |

*:
A: Average particle diameter (as calculated in terms of sphere) (μm)
B: Coefficient of fluctuation in diameter (as calculated in terms of sphere) (%)
C: Average silver iodide content (mol %)
D: Structure
E: Core/shell ratio
F: Shape
G: Diameter/thickness ratio Specimen C-108 was prepared in the same manner as in Specimen C-107 except that the silver and gold contents were changed as shown in Table 17. The adjustment of the gold content was effected in the manner as used in Example A-1.

TABLE 17

| | C-107 (Comparative) | | C-108 (Invention) | |
|---|---|---|---|---|
| | A | B | A | B |
| 3 | 0.50 | $16 \times 10^{-6}$ | 0.76 | $8.0 \times 10^{-6}$ |
| 4 | 0.97 | $14 \times 10^{-6}$ | 0.69 | $6.8 \times 10^{-6}$ |
| 5 | 1.46 | $11.5 \times 10^{-6}$ | 1.04 | $4.8 \times 10^{-6}$ |
| 7 | 1.00 | $15 \times 10^{-6}$ | 0.88 | $7.3 \times 10^{-6}$ |
| 9 | 1.66 | $12 \times 10^{-6}$ | 1.03 | $5.0 \times 10^{-6}$ |
| 11 | 0.67 | $15 \times 10^{-6}$ | 0.36 | $7.2 \times 10^{-6}$ |
| 12 | 0.77 | $10 \times 10^{-6}$ | 0.39 | $4.2 \times 10^{-6}$ |
| C | 7.4 | | 5.3 | |
| D | $12.4 \times 10^{-6}$ | | $5.9 \times 10^{-6}$ | |

A: Amount of silver halide emulsion (as calculated in terms of silver) ($g/m^2$)
B: Gold/silver (weight ratio)
C: Total Ag content ($g/m^2$)
D: Total gold/total silver (weight ratio)

Specimens C-107 and C-108 were then stored under the same conditions as used in Example 1. These specimens were then subjected to exposure, development and measurement for photographic properties in the same manner as used in Example A-1.

The results are shown in Table 18 together with the results of Specimens C-101 and C-104 in Example C-1.

TABLE 18

| | 25° C., 60%, 3 Days | | | | 60° C., 30%, 3 Days | | | |
|---|---|---|---|---|---|---|---|---|
| Specimen | Relative Sensitivity | Fog B | Fog G | Fog R | Relative Sensitivity | Fog B | Fog G | Fog R |
| C-101 (Comparative) | 100 | 0.09 | 0.09 | 0.07 | 84 | 0.29 | 0.22 | 0.19 |
| C-104 (Invention) | 101 | 0.09 | 0.09 | 0.08 | 93 | 0.15 | 0.13 | 0.12 |
| C-107 (Comparison) | 98 | 0.10 | 0.10 | 0.09 | 73 | 0.31 | 0.26 | 0.23 |
| C-108 (Invention) | 99 | 0.09 | 0.09 | 0.08 | 92 | 0.17 | 0.13 | 0.14 |

Table 18 shows that even the specimens comprising as a two-equivalent magenta coupler a pyrazoloazole type coupler and having the layer structure according to the present example exhibit the effect of the present invention.

The structural formula of Compounds EX-15, EX-16, EX-17, EX-18 and EX-19 are shown hereinafter.

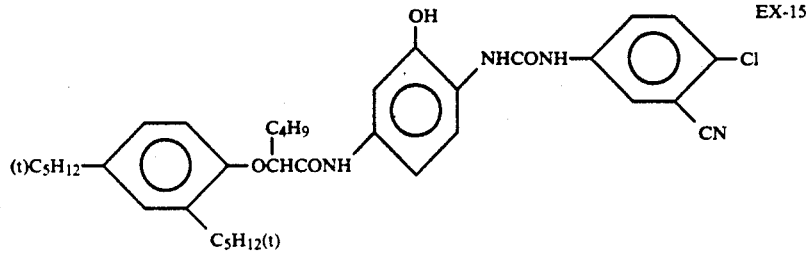

-continued

EX-16

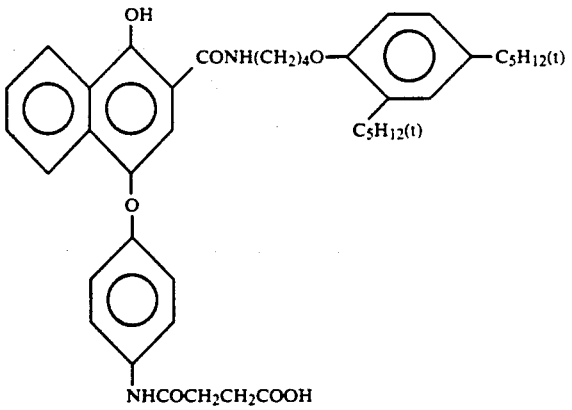

EX-17

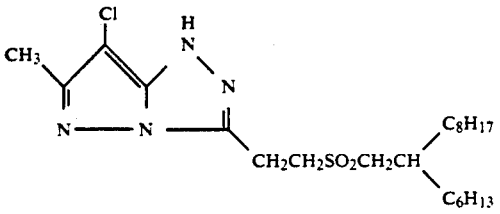

EX-18

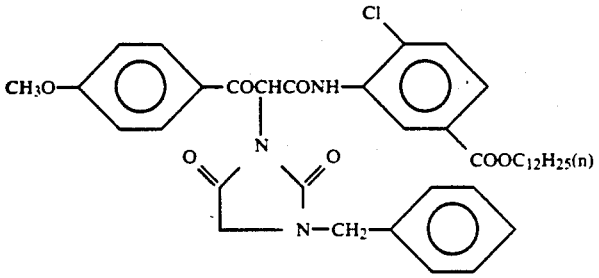

EX-19

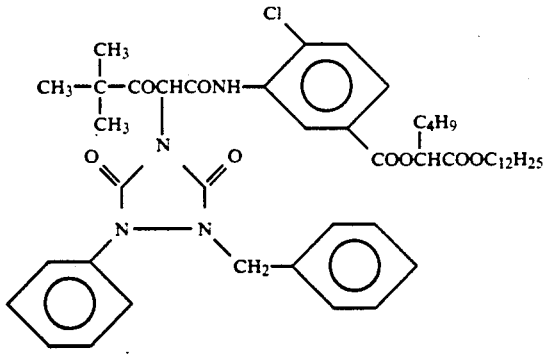

EXAMPLE C-4

Specimens C-109 and C-110 were prepared in the same manner as in Specimens C-107 and C-108 except that the coupler EX-17 in the 7th layer (1st green-sensitive emulsion layer) and the 9th layer (2nd green-sensitive emulsion layer) was replaced by the coupler EX-6 as used in Example C-1 in the equimolar amount.

These specimens were then stored in the same manner as used in Example A-1. These specimens were then subjected to exposure, development and measurement for photographic properties. The results are shown in Table 19 together with the results of Specimens C-107 and C-108 in Example C-3.

TABLE 19

| Specimen | 25° C., 60%, 3 Days | | | | 60° C., 30%, 3 Days | | | |
|---|---|---|---|---|---|---|---|---|
| | Relative Sensitivity | Fog | | | Relative Sensitivity | Fog | | |
| | | B | G | R | | B | G | R |
| C-107 (Comparative) | 98 | 0.10 | 0.10 | 0.09 | 73 | 0.31 | 0.26 | 0.23 |
| C-108 (Invention) | 99 | 0.09 | 0.09 | 0.08 | 92 | 0.17 | 0.13 | 0.14 |
| C-109 (Comparison) | 97 | 0.10 | 0.11 | 0.09 | 74 | 0.31 | 0.25 | 0.23 |
| C-110 | 99 | 0.09 | 0.10 | 0.08 | 89 | 0.17 | 0.16 | 0.14 |

TABLE 19-continued

| Specimen | 25° C., 60%, 3 Days | | | | 60° C., 30%, 3 Days | | | |
|---|---|---|---|---|---|---|---|---|
| | Relative Sensitivity | Fog | | | Relative Sensitivity | Fog | | |
| | | B | G | R | | B | G | R |
| (Invention) | | | | | | | | |

Table 19 shows that the specimens comprising as a two-equivalent magenta coupler a pyrazoloazole type coupler exhibit a greater effect of the present invention than the specimens comprising other couplers.

While the invention has been described in detail and with reference to specific embodiments thereof, it will be apparent to one skilled in the art that various changes and modifications can be made therein without departing from the spirit and scope thereof.

What is claimed is:

1. A silver halide color negative photographic material comprising a plurality of silver halide emulsion layers in which the silver halide in each layer is silver iodobromide containing 2 to 20 mol% of silver iodide, wherein said plurality of silver halide emulsion layers comprises at least one red-sensitive silver halide emulsion layer, at least one green-sensitive silver halide emulsion layer and at least one blue-sensitive silver halide emulsion layer on a support and having a specific photographic sensitivity of 320 or more; wherein said silver halide photographic material contains gold, the total silver content in said silver halide color photographic material is from 3.0 to 8.0 g/m$^2$, the weight ratio of the amount of gold per unit area to the amount of silver incorporated per unit area is from $1\times10^{-8}$ to $6.0\times10^{-6}$, and at least one of the silver halide emulsion layers is sensitized with chemical sensitizers consisting of a gold sensitizer and a sulfur sensitizer.

2. A silver halide color photographic material as in claim 1, wherein the total silver content is at least 4.5 g/m$^2$.

3. A silver halide color photographic material as in claim 1, wherein the weight ratio of the amount of gold to the amount of silver is not less than $2\times10^{-8}$.

4. A silver halide color photographic material as in claim 1, wherein the weight ratio of the amount of gold to the amount of silver is not more than $4\times10^{-6}$.

5. A silver halide color photographic material as in claim 1, wherein the photographic material contains at least one two-equivalent coupler.

6. A silver halide color photographic material as in claim 5, wherein the total silver content is not more than 6.5 g/m$^2$.

7. A silver halide color photographic material as in claim 1, wherein the photographic material contains at least one two-equivalent magenta coupler.

8. A silver halide color photographic material as in claim 1, wherein the photographic material contains at least one pyrazoloazole magenta coupler.

9. A silver halide color photographic material as in claim 1, wherein said gold sensitizer is at least one compound selected from the group consisting of chloroauric acid, potassium cloroaurate, potassium aurithiocyanate, auric trichloride, sodium aurithiosulfate, and auric-5-sulfobenzothiazole-2-sulfide chloride.

10. A silver halide color photographic material as in claim 1, wherein said sulfur sensitizing agent is at least one compound selected form the group consisting of thiosulfates, thioureas, thioazoles and rhodamines.

11. A silver halide color photographic material as in claim 1, wherein the weight ratio of the amount of gold per unit area to the amount of silver incorporated per unit area is from $2\times10^{-8}$ to $4\times10^{-6}$.

12. A silver halide color photographic material as in claim 1, wherein the weight ratio of the amount of gold per unit area to the amount of silver incorporated per unit area is from $1\times10^{-7}$ to $2\times10^{-6}$.

13. A silver halide color photographic material as in claim 1, wherein the silver content in the respective emulsion layer having the highest sensitivity in at least one red-sensitive layer, at least one green-sensitive layer and at least one blue-sensitive layer is from 0.3 to 2.5 g/m$^2$.

* * * * *